US007854685B2

(12) United States Patent
Cole et al.

(10) Patent No.: US 7,854,685 B2
(45) Date of Patent: Dec. 21, 2010

(54) TRAINING SYSTEM AND METHOD

(76) Inventors: Neil M. Cole, 1675 N. Lima Center Rd., Dexter, MI (US) 48130; Charles L. Cole, 18691 Stamford St., Livonia, MI (US) 48152-3033; Walter N. Cole, 9315 Patton St., Livonia, MI (US) 48150

( * ) Notice: Subject to any disclaimer, the term of this patent is extended or adjusted under 35 U.S.C. 154(b) by 0 days.

(21) Appl. No.: 12/759,143

(22) Filed: Apr. 13, 2010

(65) Prior Publication Data

US 2010/0279821 A1 Nov. 4, 2010

Related U.S. Application Data

(62) Division of application No. 11/945,525, filed on Nov. 27, 2007, now Pat. No. 7,785,232.

(60) Provisional application No. 60/861,186, filed on Nov. 27, 2006.

(51) Int. Cl.
*A63B 21/005* (2006.01)

(52) U.S. Cl. ..... 482/5; 601/23; 601/33; 482/8

(58) Field of Classification Search ..... 482/4, 482/5, 8, 100, 101, 133, 134, 903; 601/23, 601/33

See application file for complete search history.

(56) References Cited

U.S. PATENT DOCUMENTS 3,323,366 A * 6/1967 De Lorme, Jr. et al. .. 73/379.09
4,149,714 A 4/1979 Lambert, Jr.
4,493,485 A 1/1985 Jones
4,563,003 A 1/1986 Bugallo et al.
4,628,910 A 12/1986 Krukowski
4,691,694 A 9/1987 Boyd et al.
4,705,271 A 11/1987 Mondloch et al.
4,726,582 A 2/1988 Fulks
4,765,610 A 8/1988 Sidwell
4,765,613 A 8/1988 Voris
4,779,865 A 10/1988 Lieberman et al.
4,828,257 A 5/1989 Dyer et al.
4,842,274 A 6/1989 Oosthuizen et al.
4,865,315 A 9/1989 Paterson et al.
4,869,497 A 9/1989 Stewart et al.

(Continued)

*Primary Examiner*—Fenn C Mathew
*Assistant Examiner*—Andrew M Tecco
(74) *Attorney, Agent, or Firm*—Brooks Kushman P.C.

(57) ABSTRACT

A training system and method include providing a frame, a user support portion coupled to the frame and arranged to support a user, and a user engagement portion coupled to the frame and arranged to be engaged by the body part. A force sensor is provided for sensing a user-applied force at the user engagement portion, and a position sensor is operably connected to at least one of the user support portion and the user engagement portion for sensing a relative position therebetween. A motor is coupled to at least one of the user support portion and the user engagement portion for driving a position thereof with respect to the frame over a range of motion at a preprogrammed velocity, and a controller is provided in communication with the motor, the force sensor, and the position sensor. A knee position mechanism is movably coupled to the frame between the user support portion and the user engagement portion, the knee position mechanism including a sensor in communication with the controller for tracking a horizontal position of a knee of the user over the range of motion.

13 Claims, 42 Drawing Sheets

U.S. PATENT DOCUMENTS 4,878,384 A 11/1989 Bruhn
4,884,801 A 12/1989 Schnell
4,907,797 A 3/1990 Gezari et al.
4,919,418 A 4/1990 Miller
4,930,770 A 6/1990 Baker
4,998,721 A 3/1991 Anders et al.
5,015,926 A 5/1991 Casler
5,020,794 A 6/1991 Englehardt et al.
5,117,170 A 5/1992 Keane et al.
5,209,661 A 5/1993 Hildreth et al.
5,230,672 A 7/1993 Brown et al.
5,260,870 A * 11/1993 Tsuchiya et al. ..... 600/595
5,277,674 A * 1/1994 Tsuchiya et al. ..... 482/8
5,306,216 A 4/1994 Kato et al.
5,314,390 A * 5/1994 Westing et al. ..... 482/6
5,314,394 A 5/1994 Ronan
5,328,429 A 7/1994 Potash et al.
5,330,397 A 7/1994 Prince et al.
5,360,382 A 11/1994 Chi
5,366,432 A 11/1994 Habing et al.
5,399,147 A * 3/1995 Kaiser ..... 601/34
5,401,224 A * 3/1995 Tsuchiya et al. ..... 482/8
5,407,402 A 4/1995 Brown et al.
5,407,403 A 4/1995 Coleman
5,421,798 A * 6/1995 Bond et al. ..... 601/23
5,431,609 A 7/1995 Panagiotopoulos et al.
5,433,678 A 7/1995 Chi
5,569,120 A 10/1996 Anjanappa et al.
5,583,403 A 12/1996 Anjanappa et al.
5,616,107 A 4/1997 Simonson
5,653,666 A 8/1997 Pantoleon
5,697,869 A 12/1997 Ehrenfried et al.
5,722,937 A 3/1998 Smith
5,827,154 A 10/1998 Gill
5,830,160 A 11/1998 Reinkensmeyer
5,919,115 A 7/1999 Horowitz et al.
5,993,356 A 11/1999 Houston et al.
6,050,920 A 4/2000 Ehrenfried
6,066,074 A 5/2000 Marcinkiewicz
6,113,642 A 9/2000 Petrofsky et al.
6,228,000 B1 5/2001 Jones
6,261,205 B1 7/2001 Elefson
6,267,709 B1 7/2001 Jacques et al.
6,293,892 B1 9/2001 Slawsinski et al.
6,368,251 B1 4/2002 Casler
6,537,182 B2 3/2003 Slawinski et al.
6,558,299 B1 5/2003 Slattery
6,626,805 B1 9/2003 Lightbody
7,004,890 B2 2/2006 Webb et al.
7,011,605 B2 * 3/2006 Shields ..... 482/8
7,070,545 B2 7/2006 Lull et al.
7,083,547 B2 8/2006 LaStayo et al.
7,125,370 B1 10/2006 Schaffner et al.
7,220,221 B2 5/2007 Mosimann et al.
7,285,076 B2 10/2007 Kelly
7,470,216 B2 12/2008 Farinelli et al.
7,753,862 B2 * 7/2010 Branch et al. ..... 601/5
7,762,963 B2 * 7/2010 Ewing ..... 601/5
2002/0042328 A1 4/2002 Yoo
2003/0207734 A1 11/2003 La Stayo et al.
2006/0234842 A1 * 10/2006 Minami et al. ..... 482/99
2006/0290202 A1 12/2006 Shibata et al.
2007/0202992 A1 8/2007 Grasshoff
2008/0214372 A1 9/2008 Karp

* cited by examiner

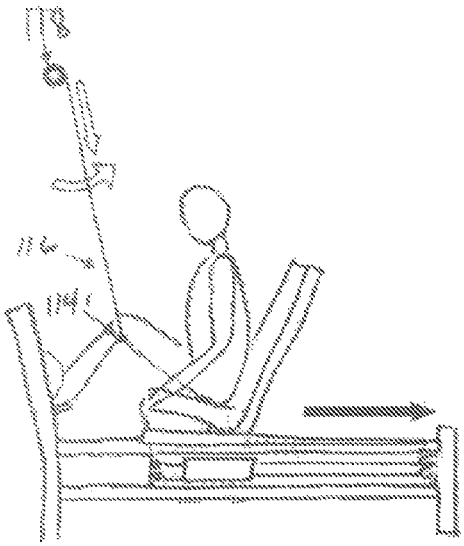
FIGURE 12b
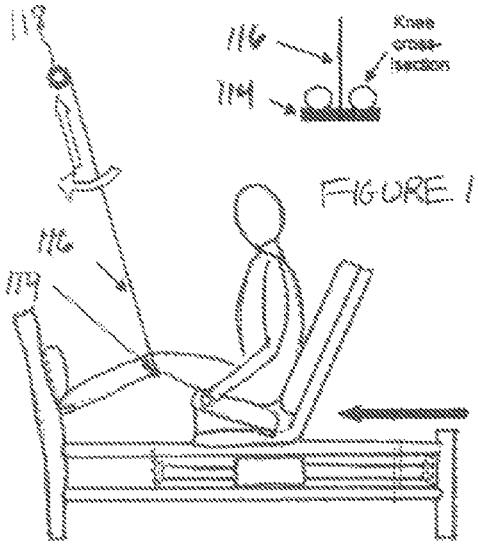
FIGURE 12c
FIGURE 12a

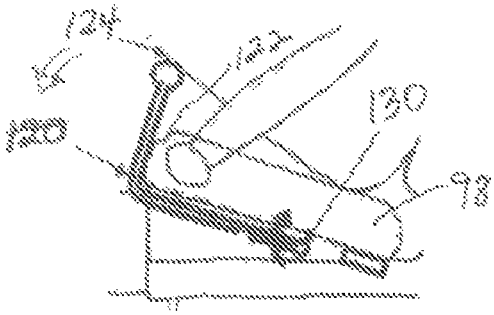
FIGURE 13a
FIGURE 13b
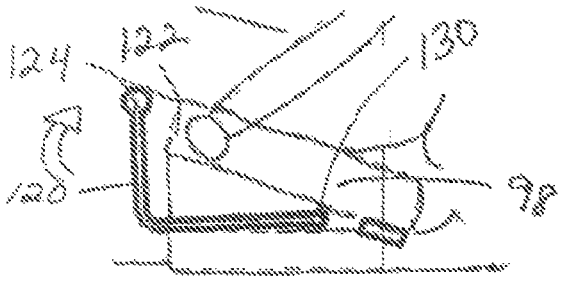
Thigh cross-sections
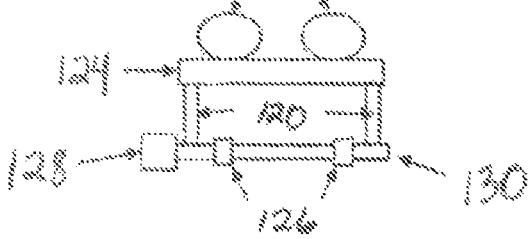
FIGURE 13c

TRAINING SYSTEM AND METHOD

CROSS-REFERENCE TO RELATED APPLICATIONS

This application is a division of U.S. application Ser. No. 11/945,525 filed Nov. 27, 2007 which, in turn, claims the benefit of U.S. provisional Application No. 60/861,186 filed Nov. 27, 2006, the disclosures of which are incorporated in their entirety by reference herein.

STATEMENT REGARDING FEDERALLY SPONSORED RESEARCH OR DEVELOPMENT

The invention was made with government support under Grant No. R44AG026167 awarded by the National Institute on Aging. The Government has certain rights in the invention.

BACKGROUND OF THE INVENTION

1. Field of the Invention

This invention relates to a training or exercising system and method.

2. Background Art

Traditional weight lifting involves selecting a fixed amount of weight to be lifted and lowered through a user's range-of-motion (ROM). This means that a constant resistance level or "load" is applied to the muscles throughout the ROM in both directions. Once the load has been selected, the user controls the velocity of each lift along with the number of repetitions to be performed.

Typical resistance training equipment utilizes a cable- and pulley-driven weight stack that works against gravity and is manipulated by a user interface. The user typically selects a fixed amount of weight to be lifted by inserting a pin at the appropriate place in the weight stack. The weight is then lifted and lowered through the user's ROM through the application of force to the user interface and the transfer of that force through the cable and pulley mechanism to the weight stack. Such "weight machines" are widespread in health clubs, physical therapy clinics, and home gyms.

Muscle mass and strength tend to increase in response to the force stimulus of a load being applied to the muscle. The greater the force (without causing injury), the greater is the training stimulus. Thus, training with weights that are a significant percentage of an individual's maximum capability tends to produce the greatest increases in strength.

For any joint in the human body, the relationship between force generation capacity and joint angle is non-constant and non-linear. That is, the maximum amount of weight that can be lifted for a given exercise varies at each position along the ROM. For example, in performing a leg press repetition, a person is substantially weaker in the position where the knees are flexed than where they are more fully extended. In fact, this strength difference may be as great as a factor of three or more. Thus, when performing a single repetition on a traditional weight machine, which can only apply a constant load, the user is restricted to selecting a weight no greater than that which can be lifted at the weakest position within the ROM. This means that with traditional weight lifting, the user is "under-training" throughout most of the ROM in that he receives a smaller training stimulus in the stronger regions.

The force generation capacity also varies with the "direction" of training (FIG. 1). When a muscle contracts, it attempts to shorten and generates tension. If this tension exceeds the externally applied load, a shortening contraction (SC) will occur and the muscle length will shorten (velocity>0 m/s). For example, when one lifts a weight or ascends the stairs, the agonist muscles undergo an SC whereby the muscle fibers contract and shorten while moving and performing work on the weight. If the external load exceeds the tension generated by the contracting muscle, the muscle will be stretched and is said to undergo a lengthening contraction (LC) (velocity<0 m/s). For example, when the weight is lowered or the stairs are descended, the muscle fibers actually lengthen as they contract and the weight performs work on them, resulting in an LC. Isometric contractions occur when a muscle develops tension but the muscle length does not change (velocity=0 m/s). Skeletal muscle routinely performs shortening, isometric, and lengthening contractions in normal daily activities.

As illustrated in FIG. 1, muscle can generate significantly greater force during lengthening contractions as compared with isometric or shortening contractions. More particularly, muscle tends to be anywhere from 1.5 to 3 times stronger in the LC phase of a lift than in the SC phase. This means that one can actually control the lowering of much more weight than can be lifted. This lengthening contraction overloading capacity can be exploited to evoke greater increases in muscle mass, strength, and power. In traditional weight training, the muscles are substantially "under-loaded" in the LC phase of the lift since the load can be no greater than the amount of weight that can be lifted in the weakest position of the weaker SC phase.

LC training has been shown to provide significant benefits, including greater strength gains and improved protection from injury, all at lower levels of perceived exertion, cardiovascular stress, and oxygen consumption, and is important for activities such as downhill skiing, tennis, basketball, downhill hiking, stair descent, and others. Once more, since traditional weight machines limit the user to selecting a single fixed weight that must be lifted and lowered through the entire ROM, the muscles are under-trained during the LC phase of training Serious athletes often try to reduce the magnitude of under-training by selecting a weight greater than they are capable of lifting. A training partner is employed to assist with the lift and then lets the user lower the weight himself to get a better loading effect in the LC phase. This type of training, often referred to as "negatives", is not generally available to casual weight lifters, the elderly, or those who train by themselves.

Gains in muscle strength tend to be specific to the type of training performed. Thus, SC training evokes greater increases in SC strength than LC training, while LC training leads to greater LC strength gains than SC training. Since everyday activities require both SC and LC movements, the American College of Sports Medicine and others recommend a strength training regimen utilizing both types of movements. Moreover, numerous training studies have demonstrated that regimens involving both SC and LC training produce the greatest increases in dynamic muscle strength and change in morphology. Also, acute hormonal responses are associated with specific SC or LC training movements. But, as described above, traditional fixed-weight training under-emphasizes the LC phase of training, while recently developed systems that focus entirely on the LC phase of training, by design, omit training the SC phase. Despite the advantages and need for such a regimen, no system exists that has the flexibility to enable both lower-load SC and higher-load LC training that is suitable for independent use.

BRIEF DESCRIPTION OF THE DRAWINGS

FIG. 12*a* is a schematic cross-sectional view of a cable suspended T-bar system according to the present invention;

FIGS. 12*b* and 12*c* are schematic illustrations of the T-bar system during shortening and lengthening contractions, respectively;

FIGS. 13*a* and 13*b* are schematic illustrations of a spring-driven thigh lever according to the present invention during the SC phase and LC phase, respectively, designed to monitor the angular position of the posterior side of the user's thighs relative to the seat and ankles;

FIG. 13*c* is a schematic cross-sectional view of the thigh lever;

DETAILED DESCRIPTION

Figure 1:
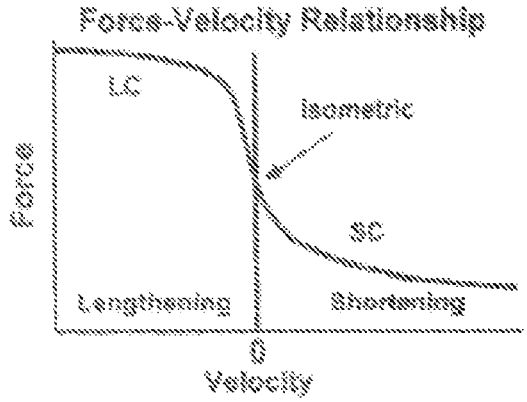
FIG. 1 is an illustration of the force-velocity relationship of skeletal muscle.

As required, detailed embodiments of the present invention are disclosed herein; however, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to variously employ the present invention.

The present invention includes an innovative strength training system and method that represents a radical departure from traditional weight machines and free weights. The system and method according to the present invention utilize a computer-controlled motor drive and real-time graphical force feedback display to guide users through advanced training protocols that cannot be performed with traditional equipment. By exploiting the physiological properties of human muscle, these customized protocols promote greater increases in strength and evoke a response within the muscle that provides improved protection from injury. In addition, the system according to the present invention is easy to use, and it is versatile enough to benefit everyone from the frail elderly to world-class athletes.

The system and method according to the present invention take an entirely different approach by regulating the velocity of movement, while enabling the user-applied load to vary across the ROM and with the direction of movement. This may be accomplished via a motor drive that controls the velocity of the user engagement portion, and a graphical display including a visual force-position target trajectory that overlays real-time performance feedback. During exercise, users may modulate their applied force to track custom or preprogrammed force-position training profiles.

With the system and method of the present invention, the applied resistance level may vary throughout the ROM to match the user's strength curve and thereby provides an appropriate challenge to the muscles across the entire ROM. The variable resistance capability of the system not only meets the needs of high-end athletes, but can be customized to enable exercise-intolerant individuals, the elderly, and rehabilitation patients to increase their strength while experiencing minimal cardiovascular stress. Moreover, a training partner is not required to use the system according to the present invention. The system provides a balanced workout by challenging the muscles in both the VSC and VLC phases of movement in a manner that can be tailored to the individual user. The present invention also provides the ability to minimize patellofemoral joint compression during training and potential aggravation of patellofemoral pathologies by reducing target resistance levels at deep knee flexion angles. As such, the system and method according to the present invention are user-customizable, safe, and more effective than traditional methods.

Figure 2:
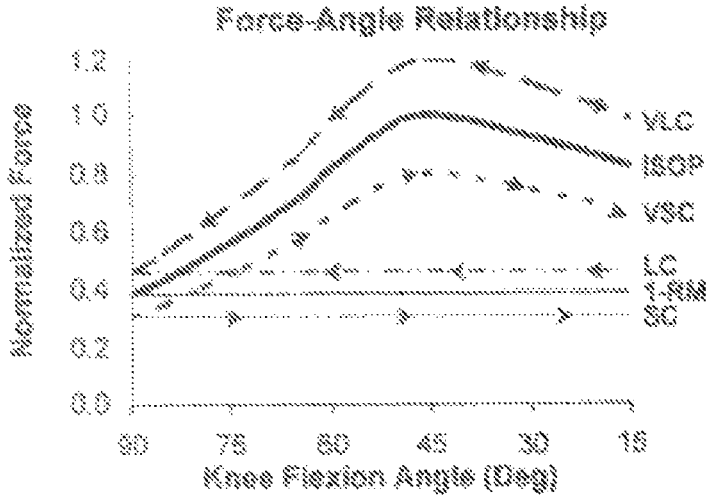
FIG. 2 depicts representative curves showing the relationship between the angular position of the knee joint and force generation on a leg press machine.

As described above, the force generating capacity of a muscle group varies across the ROM and with the type of contraction (isometric, shortening, and lengthening). FIG. 2 contains plots of leg force production versus knee flexion angle for various training protocols using a leg press system according to the present invention designed for training knee extension, hip extension, and ankle plantarflexion muscles (all leg-press movements and muscle contractions are referenced to knee flexion angle and angular velocity). The two curves, SC and LC, near the bottom of FIG. 2 represent idealized standard constant weight protocols performed slowly. The three curves toward the top, VSC (velocity-controlled SC), Isometric (zero velocity condition), and VLC (velocity-controlled LC), represent velocity-controlled variable resistance training protocols. As evident in the plots, much higher muscle loading can be achieved through the ROM when a variable resistance protocol is used.

In FIG. 2, the SC curve represents weight training with traditional shortening contractions performed at 80% of a one repetition maximum (1-RM, defined here as the maximum load a user can lift through one repetition of SC at a starting angle of 90 degrees knee flexion), the LC curve represents weight training with traditional lengthening contractions at 120% of a 1-RM, the isometric profile (ISOP) curve illustrates the maximum isometric capacity at each angle of flexion, the VSC curve illustrates a velocity-controlled shortening contraction performed at 80% of the maximum isometric capacity throughout the ROM, and the VLC curve shows a representative curve of a velocity-controlled lengthening contraction performed at 120% of the isometric capacity through the ROM.

With standard SC-LC training of leg extension, a repetition begins with flexed knees. Using an SC, the user pushes the weight away from the body until the knees are near full extension. The user then uses a submaximal LC to return the weight to the starting flexed position. As described above, in order to move the weight through a full SC-LC repetition, the user is limited to selecting a fixed weight that requires force production less than the minimum value along the isometric curve. Consequently, during conventional SC-LC training, the user is limited to lifting a weight that is lower than his/her isometric maximum at the weakest angle across the ROM. For this particular movement, the force generating capacity is lowest near 90 degrees of knee flexion which is the typical starting point. This is illustrated by the 1-RM curve in FIG. 2.

Traditional elevated-LC training methods surpass the muscle loading capacity of SC training by adding a fixed amount of weight to the user's maximum SC lifting weight. Typically, a training partner provides assistance during the lift or shortening phase of each repetition. The user then slowly lowers the weight through the ROM during the LC phase while the training partner acts as a spotter. This type of training is illustrated in FIG. 2 by the LC curve. Even in this mode, the muscle is under-loaded through much of the stroke as compared to its isometric potential.

According to the present invention, velocity-controlled, variable resistance protocols enable users to load their muscles more optimally along the entire ROM in either or both of the shortening (VSC) and lengthening (VLC) phases of a training repetition to stimulate greater muscle hypertrophy. The method according to the present invention includes controlling the velocity of movement of the legs (no spotter needed) with a computer-controlled, motor-driven system while providing real-time force feedback to the user. During training, users are instructed to modulate their contraction effort across the ROM to follow predetermined force target trajectories which may be similar to the VSC and VLC curves illustrated in FIG. 2. This figure demonstrates the increased loading capacity of the leg muscles, as the VLC has the highest load range, followed by VSC, and below these, the LC and SC curves.

Figure 3:
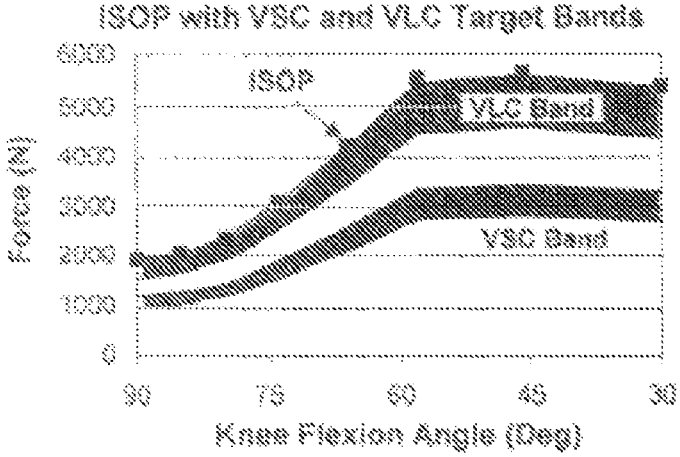
FIG. 3 shows examples of an isometric profile (ISOP) and force target trajectories for velocity-controlled SC (VSC) and velocity-controlled LC (VLC) training based on the ISOP.

FIG. 3 shows examples of an isometric profile (ISOP), which is the isometric leg extension force plotted against knee flexion angle as measured from maximum voluntary contractions, and force target trajectories (with tolerance bands) for VSC and VLC training based on the ISOP in accordance with the system and method of the present invention. Further details regarding measurement of the ISOP and determination of appropriate VSC and VLC target bands will be provided below.

Turning now to FIGS. 4-7, the present invention includes a computer-controlled, motorized, resistance training system, designated generally by reference numeral 10. Rather than exclusively using a weight stack 12, the system 10 uses an electric motor 14 under software control to apply a resistive load. The motor 14 is capable of driving a user engagement portion, such as footplate 16, (or, alternatively, a bar, handle, lever arm, etc.) in a reciprocating motion through the user's ROM at a preprogrammed velocity. As such, the system 10 enables safe and effective strength training with VSC and VLC training protocols. The user applies a force against the user engagement portion 16 throughout the ROM, and the system 10 provides programmable, variable-resistance force target trajectories across the ROM in both VSC and VLC phases of each training repetition. A display, such as a computer screen 18, may be provided to display a force vs. position curve that represents the user's target training range (for example, FIG. 3) with graphical and numerical overlays that track the user-applied force and user position in real-time. The user may then try to modulate the applied force to keep the applied force curve within the target training range displayed on the display 18. Further details regarding these methods are provided below with reference to FIGS. 24-48.

The system 10 according to the present invention may be embodied as a stand-alone, computer-controlled VSC-VLC leg press system that operates solely under motor control, or as a hybrid, combined motorized/stacked-weight system. According to one aspect of the present invention, a system may be fitted to a commercial grade leg press machine. The system 10 may provide the ability to switch easily between VSC-only, VLC-only and VSC-VLC exercises. The hybrid system also enables the user to perform traditional SC-LC weight training Additional weights to supplement the weight stack 12 may be used when needed, and the weight stack 12 may also be used to supplement the force and power capacity of the motor 14.

Figure 4:
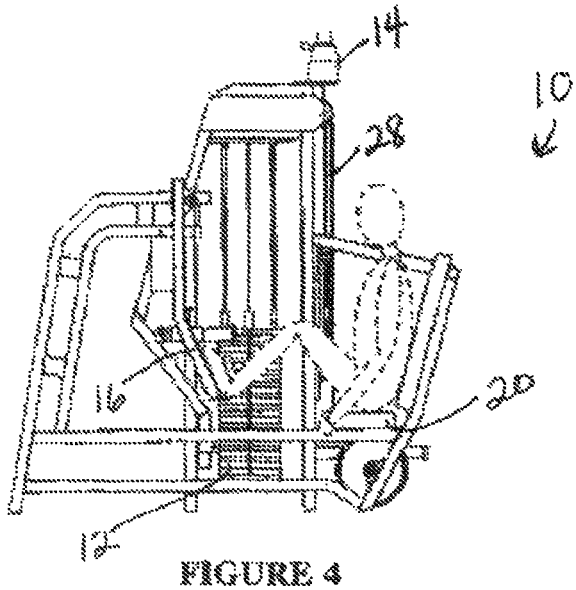
FIG. 4 illustrates a leg press system according to one aspect of the present invention with a fixed seat and hinged footplate.
Figure 5A:
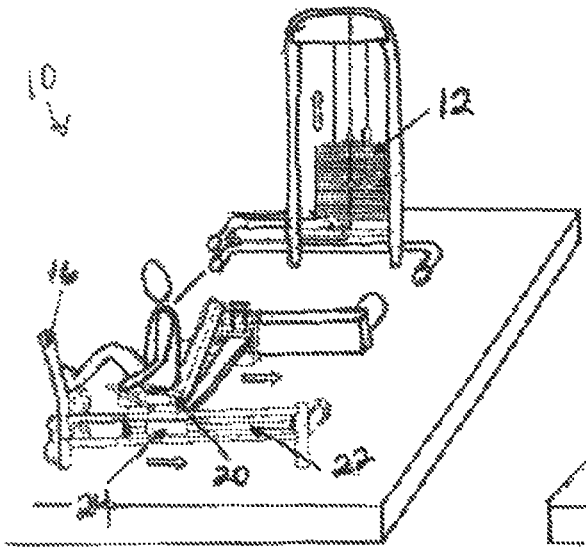
FIGS. 5*a* and 5*b* are partially exploded, schematic illustrations of a leg press system according to another aspect of the present invention, where the block arrows demonstrate the movements of the user seat, weight stack, and drive mechanism during SC/VSC and LC/VLC phases.
Figure 5B:
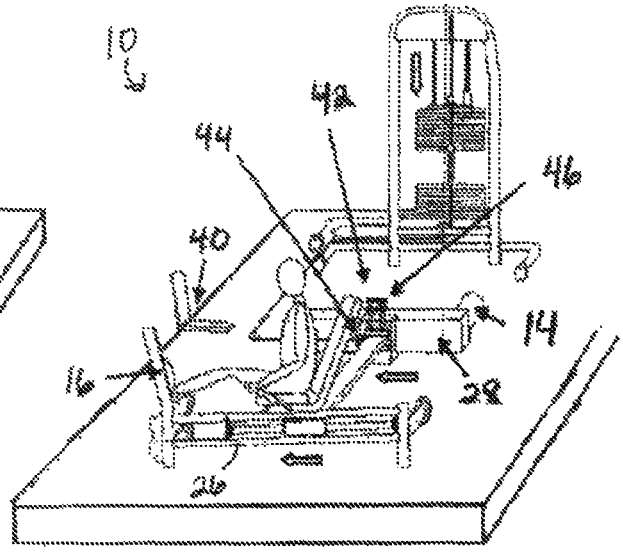

For example, using a leg press such as, but not limited to, a Magnum Model 1203 with a fixed user support portion, or seat 20, and hinged footplate 16, a system 10 may be constructed according to the present invention as shown in FIG. 4. According to another aspect of the present invention, the system 10 may be constructed based on a sled-style leg press such as, but not limited to, a Magnum Model 2203 leg press as shown in FIGS. 5*a* and 5*b*. FIGS. 5*a* and 5*b* provide partially exploded views of the system 10 that highlight several components and illustrate the SC/VSC phase (FIG. 5*a*) and LC/VLC phase (FIG. 5*b*) of motion. The footplate 16 remains fixed in space while the seat 20 may be movable along a pair of shafts 22 on a pair of linear bearings 24. According to another aspect of the present invention, the system 10 may include a custom-built leg press constructed without weights and intended for motorized actuation only (FIGS. 6-7).

In all figures herein, the user is presented as a cartoon character and is not meant to impart anatomical or postural information other than approximate and relative knee/leg position at the beginning of the SC/VSC and LC/VLC phases. Except where noted, the system 10 is described below as utilizing a fixed footplate 16 and movable seat 20. However, in the system 10 according to the present invention, it is only required that the seat 20 and the footplate 16 move relative to each other in a linear or semi-linear fashion, such that the system 10 could alternatively operate with the seat 20 fixed and a movable footplate 16, or both the seat 20 and footplate 16 could be movable.

Figure 6:
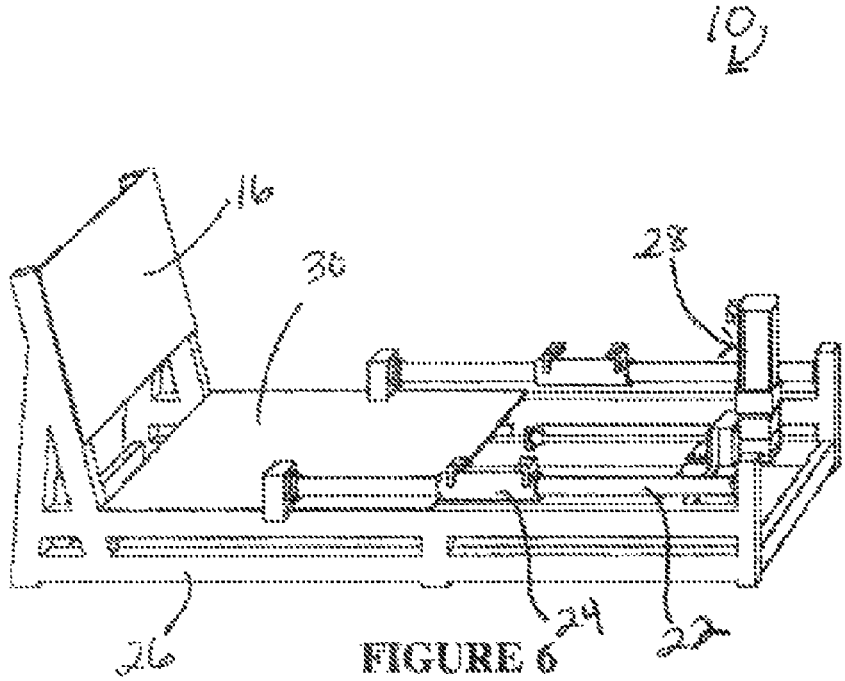
FIG. 6 is a perspective view of a partially assembled system according to one aspect of the present invention.
Figure 7:
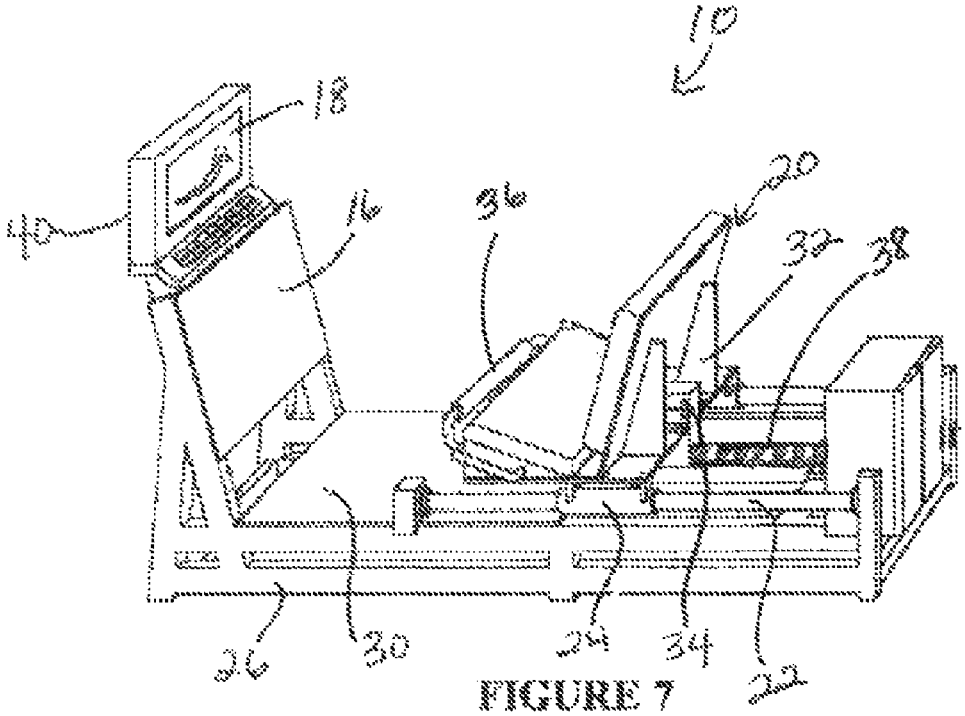
FIG. 7 is a perspective view of an assembled system according to one aspect of the present invention.

With reference to FIGS. 6-7, the system 10 according to the present invention includes a frame 26 to which the footplate 16 may be attached and to which the shafts 22 with bearings 24 are mounted. A drive mechanism 28 which may include the motor 14, gear box, brake, ball screw, and ball nut may be mounted to the frame 26, and may be used to drive the user seat 20 toward and away from the footplate 16. A floor-plate 30 may also be mounted to the frame 26, and the seat 20 may include a seat frame 32 coupled to the bearings 24. A force transducer assembly 34 may be coupled to the drive mechanism 28 and the seat frame 32. Alternatively, a force sensing system may be associated or built into the footplate 16. The force sensing system may measure multi-axis forces similar to a force plate, where this implementation is described below with respect to FIGS. 15 and 19. The user seat 20, which may be provided with a knee lock sensor 36, may be mounted to the seat frame 32. A ball screw bellows 38 may be installed on the drive mechanism 28, and a computer 40 with its display 18 may be mounted directly to the frame 26.

The choice of the motor 14 and the drive mechanism 28 may depend on the muscle group and exercise. Leg press applications will require a higher capacity system than for curls. Options for the motor 14 and drive 28 may include, but are not limited to, a servo motor, stepper motor, AC or DC motor, ball screw, ACME screw, linear slide, gear reducer, clutch, velocity limiting governor, belts and pulleys. A brushless servomotor (e.g., Kollmorgen; AKM53K Series) with an integral 1024 lines per inch commutating encoder may be employed. When combined with an amplifier 56 (e.g., Copley Controls Xenus Servo Amplifier; see FIG. 9), it can operate on standard US single-phase 120 VAC power for portability.

The power drive mechanism 28 may employ a 2:1 reduction gear head (e.g., Micron; Nema True RT Angle Gear Reducer, NTR34-002) and a 24 inch, two revolutions/inch ball screw-actuated positioning system (e.g., LinTech; 170 Series Positioning System) to transfer the rotational movement of the servomotor 14 into linear displacement of the user seat 20 and the weight stack 12 (if attached).

As best shown in FIG. 5*b*, a custom-built mechanical linkage 42 provides the ability to mechanically connect the drive mechanism 28, user seat 20, and weight stack 12 in any of the following configurations: 1) weight stack 12 connected to the seat 20 for traditional SC-LC training, 2) drive mechanism 28 connected to the seat 20 for pure motor-driven VSC-VLC training, and 3) both weight stack 12 and drive mechanism 28 connected to the seat 20 to enable the weight stack 12 to supplement the power of the servomotor 14. A quick disconnect mechanism may be provided to enable a quick transition from motor drive mode to traditional weight stack mode. As best shown in FIG. 5*b*, this mechanism may include a weights-connect pin 44 and a drive-connect pin 46 to provide a means to quickly and easily select between standard SC-LC and motor-driven VSC-VLC training modes of operation, respectively. Since the motor-drive option can be used while the weight stack 12 is engaged, only the drive-connect pin 46 may be required to switch between SC-LC training and VSC-VLC training Furthermore, a user may elect to disconnect the weight stack 12 during VSC-VLC training if they prefer.

The seat 20 and footplate 16 are designed to distribute the foot and pelvic reaction forces over as large an area as possible. The frame 26 may be designed with enough structural rigidity to have compliance between the seat frame 32 and footplate 16 for a 13,350 N (3,000 lb) load of less than 2 cm. To characterize and correct for the remaining compliance, a sensor may be employed to measure the compliance in real time and this measurement may then be used to correct for "errors" in user knee angle calculations that may result from compliance.

The system 10 according to the present invention may be utilized for training both healthy young and old subjects with anthropometries from the 5th to the 95th percentile of female and male populations of all races over a knee flexion ROM from approximately 90 to 0 degrees flexion. VSC-VLC training enables the user to perform significantly more work per training session than SC-LC with a comparable number of repetitions before reaching fatigue failure (see FIGS. 2 and 3). The system and method according to the present invention are suitable for either time-compacted, high-intensity training or endurance style training at low intensity. Furthermore, the system and method teach force steadiness and control.

Figure 8:
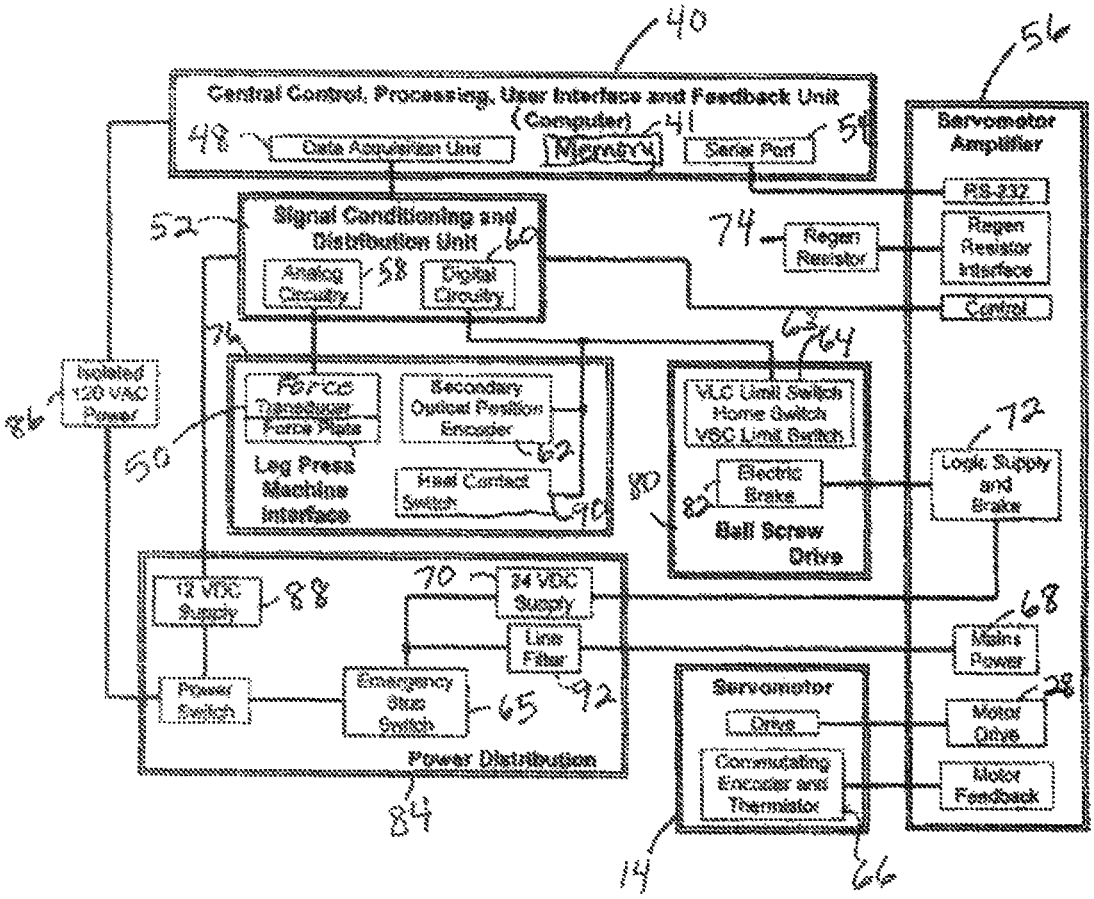
FIG. 8 is a block diagram showing a control system according to an aspect of the present invention.
Figure 9:
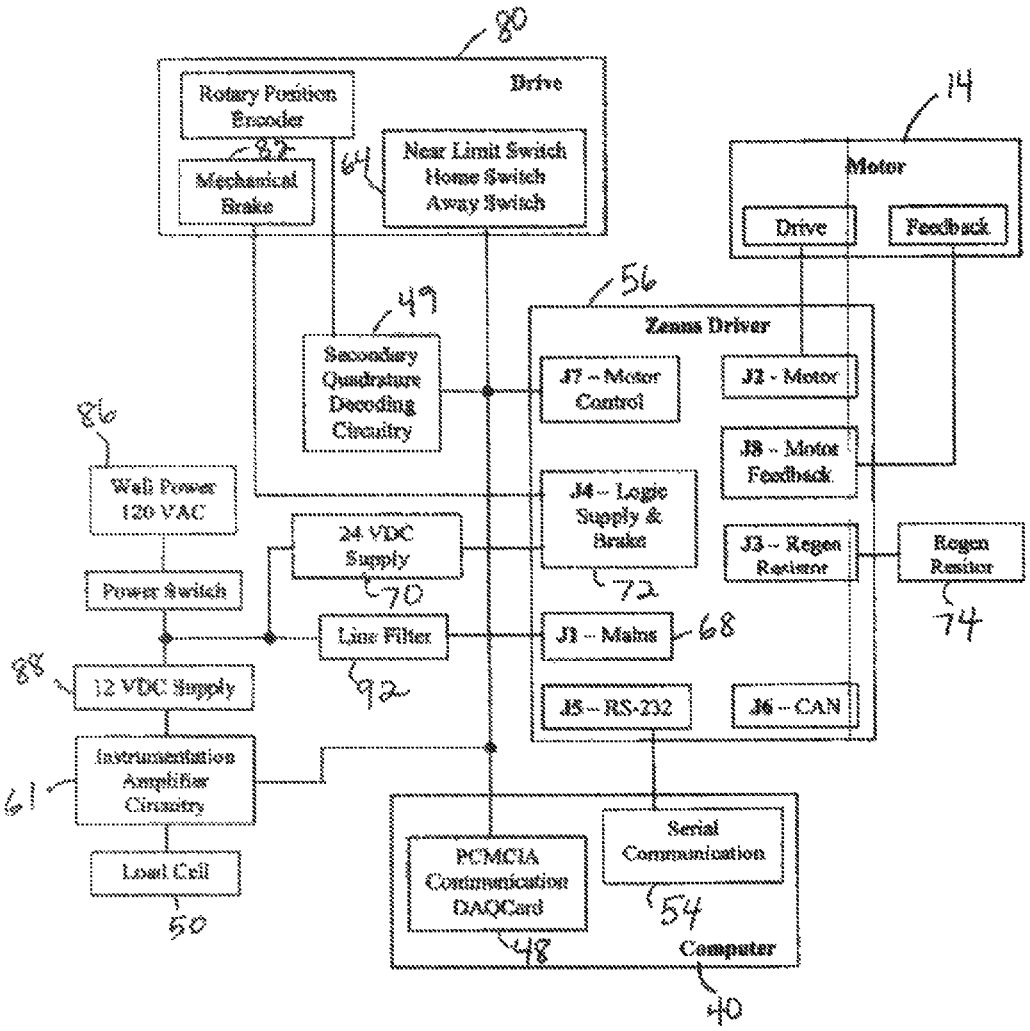
FIG. 9 is a block diagram of an electronic wiring flowchart in accordance with one aspect of the present invention.

Turning now to FIGS. 8-9, block diagrams of a control system according to an aspect of the present invention are illustrated. The control system may include a central controller, such as a computer 40, which may function as a central control, data processing, user interface and feedback unit. The central controller 40 may host motion control software, wherein the code described herein was developed in the National Instruments LabVIEW 7.1 environment. Tasks handled by the central controller 40 may include closed-loop motor control for isovelocity and variable velocity control, calculation and enforcement of ROM limits for individual users, creation and execution of user customized training protocols, display and processing of real-time data and archived data, including the display of force production and target training ranges for the user as well as the number of successful/failed repetitions, ROM, and maximums and minimums of training repetition VSC velocity, VLC velocity, VSC force, VLC force, VSC power, VLC power, VSC work, VLC work, as well as maximums, minimums, means, and standard deviations of session VSC force, VLC force, VSC power, VLC power, VSC work, VLC work, time between reps, and other parameters.

Using memory 41, the central controller 40 may allow for the archival of captured data, such as in time-stamped, Microsoft Excel compatible data files, and data recall from previous training sessions. The data processing, archival, and retrieval capabilities of the system and method according to the present invention allow for real-time performance updates, automatic retrieval and updating of the user profile, current session summary data, and historical data and trend analysis. A structured data entry system with built-in range checks on individual items and double keying to ensure accuracy may be used as data is entered. Data may be cleaned and edited after being transported into a statistical software package. In addition, protocols have been developed to handle missing or out-of-range values, documentation, file backup and archiving, and confidentiality procedures.

A Data Acquisition Unit 48 may include data acquisition circuitry such as a PCMCIA data acquisition card (e.g., National Instruments, DAQCard-6024E) which provides the interface between the computer 40 and the system-distributed circuitry. With its digital-to-analog and analog-to-digital converters, the card enables software control of the force signal baseline and digital acquisition of the preconditioned analog output of a force transducer 50. An internal counter (not shown) may track system seat 20 position by tracking the output of a quadrature decoder 49 contained in the signal conditioning circuitry 52. The card may also serve as a digital input/output interface for polling home switches 63, limit switches 64, and emergency stop switches 65.

The computer's serial port 54 may be used to issue motion commands to the motor 14 via a servomotor amplifier 56. Motion control may alternatively be accomplished with analog, pulse-width-modulation, or other control signals issued by the controller 40 through a data acquisition card or similar to the servomotor amplifier 56. These messages may be used to instruct the motor 14 to move to designated positions, modify velocity and acceleration profiles, monitor status and initiate or halt movement.

A Signal Conditioning and Distribution Unit 52 may include analog 58 and digital 60 circuitry which may be housed in two separate shielded enclosures. The analog circuitry 58 may provide regulated excitation to the force transducer 50 and may amplify its output with an instrumentation amplifier 61. The transducer signal may also be low-pass filtered prior to being digitally sampled to prevent aliasing. Further signal conditioning may be handled digitally via computer software. Analog motor control commands issued by the computer 40 via the Data Acquisition Unit 48 may also be passed through the analog circuitry 58 to the control inputs of the servomotor amplifier 56. The digital circuitry 60 may provide 5 VDC power and data conditioning for a secondary optical position encoder 62. The digital circuitry 60 may also collect and distribute the states of home 63, VLC and VSC limit 64, and emergency stop switches 65.

A servomotor amplifier 56 (e.g., Copley Controls, XSL-230-40-HS) may be utilized to provide 100% digital control of the servomotor 14 and support commutating encoder 66 position feedback. The mains high-power input 68 may accept single-phase 120 VAC which is electrically isolated from a +24 VDC logic supply 70 that powers the internal logic, brake and control circuits 72. A regen-resistor 74 (e.g., Copley XSL-RA-02) may be used to protect the system by safely shunting current during rapid decelerations under load.

A Leg Press Machine Interface 76 may include a force transducer/force plate 50. In particular, the system may incorporate a tension/compression load cell (e.g., Omegadyne, Inc. LC203-2K) to provide force feedback to the central controller 40. The minor effects due to gravity and the combined inertial mass of the user and system seat 20 may be corrected via software. All data may be measured via a calibrated force plate 50 that measures both normal and shear loads at the feet of the user.

A Secondary Optical Position Encoder 62 such as a high resolution "yo-yo" style rotary optical encoder (e.g., SpaceAge Control, Inc.; 162-2945HASB) may interface with the user seat 20 to provide direct position information for all seat movements. Encoder 62 may supply position feedback when the motor drive mechanism 28 is disengaged from the weight stack 12 and may serve as a redundant measure of position to the servomotor's commutating encoder 66 when the motor drive 28 is engaged. Differentiation of digital position data provides a reliable measure of velocity.

The Ball Screw Drive 80 may include a home switch 63 and VSC and VLC limit switches 64. These switches 63, 64 may indicate when the system has attained the home and end travel positions, respectively. The switches 63, 64 may also prevent the servomotor 14 from driving beyond predefined travel limits According to one aspect of the present invention, the home position may be defined as the point where the weights 12 are at rest in their lowest vertical position and the user seat 20 is resting nearest to the footplate 16. According to this definition, the home position is the "zero" position and is used to reset the position encoder 66 for the servomotor 14 and secondary position encoders 62. However, it should be understood that the home position will vary depending upon the system design. For example, there is not necessarily a home position for the system described below with reference to FIG. 19, wherein a tracking physical knee restraint is utilized, and the home position may be at the "other" end for the system described below with reference to FIG. 15 wherein floating limit switch blocks are employed.

The VLC limit position may be defined as the point where the weights 12 are at their highest allowed vertical position and/or the user's seat 20 is farthest from the footplate 16. The VSC limit position may be a predefined point where the cable that drives the weights 12 is slack and the user's seat 20 is closer to the footplate 16 than in the home position by a predefined distance. Both the VLC and VSC limit switches 64 are not triggered in "normal" operation. They also serve as backup safety measures that disable the servomotor 14 to prevent overdrive of the ball screw driven seat frame 32.

A power-off electric brake 82 may be installed on the ball screw drive 80 for emergency safety purposes. Should power be cut to the servomotor 14 or servomotor amplifier 56, the brake 82 may engage and arrest the movement of the user seat 20 and the weight stack 12, if it is attached. The brake 82 may also be triggered via a command signal to the amplifier 56.

In a power distribution unit 84, an isolation transformer 86 (e.g., medical grade) may provide 120 VAC power to both the computer 40 and training system 10. A 12 VDC supply 88 may be used to power the Signal Conditioning Circuitry 52 and ultimately the force transducer 50, secondary optical position encoder 62 and heel contact switch 90. AC power may be passed through an emergency stop switch 65 to the mains 68 of the servomotor amplifier 56 through a line filter 92 and 24 VDC power supply 70 that provides power to the internal logic, brake and control circuits 72 of the servomotor amplifier 56. The 24 VDC supply 70 ultimately powers the release of the brake 82. If this supply 70 is cut, the brake 82 will engage.

An emergency stop switch 65 may be installed in a prominent position for the user or trainer to quickly stop the system actuation in the event of an emergency. Power to the motor 14 may be cut and the brake 82 may be immediately engaged upon activation of the switch 65.

With reference to the features described above, the system 10 according to the present invention includes multiple integrated safety mechanisms.

The built-in safety brake 82 may instantly arrest movement of the seat 20, motor 14, and weights 12 upon loss of power, emergency stop switch 65 activation, or software trigger. In the event of a power failure, the brake 82 can instantaneously arrest a falling weight stack 12. The brake 82 may also be used to arrest the movement of the footplate 16 or seat 20 during motor-driven VSC-VLC operation to prevent high "break-away" speeds if power fails during a high force push by the user. According to one aspect of the present invention, the brake 82 may only be released when power is applied and a control release command from the central computer 40 is issued.

A power-up interlock may be installed between the computer 40 and servomotor amplifier 56 to ensure proper power-up sequence of the computer 40, amplifier 56, servomotor 14, and brake 82. The system 10 may be configured to ensure that power is severed to the servomotor 14 and brake 82 in the event of a loss of communication between the computer 40 and the amplifier 56. If the servo amplifier 56 detects a fault condition, it may cut power to the servomotor 14, engage the electric brake 82, and notify the computer 14 which, in turn, notifies the user.

The system 10 may be configured to require agreement between the primary servo position encoder 66 and secondary seat position encoder 62 within a linear tolerance of, for example, less than 5 mm (0.2 inches). If a disagreement occurs, the system 10 may cut power to the servomotor 14, activate the brake 82, and notify the user.

Redundant and independent safety end limit switches 78 (see FIG. 19) and power interlock circuitry may be provided to prevent the motor 14 from exceeding the allowable ROM by cutting mains power to the servomotor 14 and amplifier 56 as well as engage the brake 82 in the event that either switch is activated. The end limit switches 78 may cut power via a different mechanism than the VLC and VSC limit switches 64 which operate through the servo-amplifier 56. This is a fail-safe feature which may only trigger in the event that a primary limit switch 64 or the servomotor amplifier 56 fails.

The VSC and VLC limit switches 64, if tripped, are designed to stop motor 14 movement in the direction of the movement of the activated limit switch 64. This may be handled through the amplifier 56. AC power may be not severed in this instance. If one of these limit switches 64 fails and the motor 14 continues to drive, a second level, end limit-switch 78 may be activated. This end limit switch 78 will cut AC power to the motor 14 and engage the electric brake 82. In this scenario, the central controller 40 will remain powered on and will be notified of the failure, and the system may then need to be reset.

The target force may be limited to a value based on the user's personal ISOP, described in greater detail below. In addition, users may ramp up to the target force levels slowly over the course of a training program. Interlocks on the servomotor-controlled system 10 may ensure that the velocity of movement under any load cannot exceed the machine setting, even if the user fails to develop the target force, or indeed, any force. In addition, removal of user applied force at any time during a training repetition will not result in falling weights 12. The servomotor 14 may continue to move the user seat 20 and weights 12 along a predetermined velocity trajectory until the end of the current stroke. Commencement of a stroke in either direction may not occur until the user indicates his/her readiness to proceed by applying a force that exceeds a preset activation threshold. Of course, it is understood that the operation of the system 10 is not limited to these scenarios, and that different logic and schemes may be employed in accordance with the present invention.

The software may post visual and audible warnings and reduce drive train 28 velocity in response to excessive force generation in the VLC phase. This safety feature will result in a reduction of the user's VLC force production when the target training force is exceeded by an excessive amount. Independent software monitoring may be included to ensure maximum velocity limits are not exceeded. Software may also be designed to check for rapid changes in torque. If the rate of change exceeds a preset threshold, the system may cut power to the servomotor 14, engage the electric brake 82, and notify the user.

Figure 10:
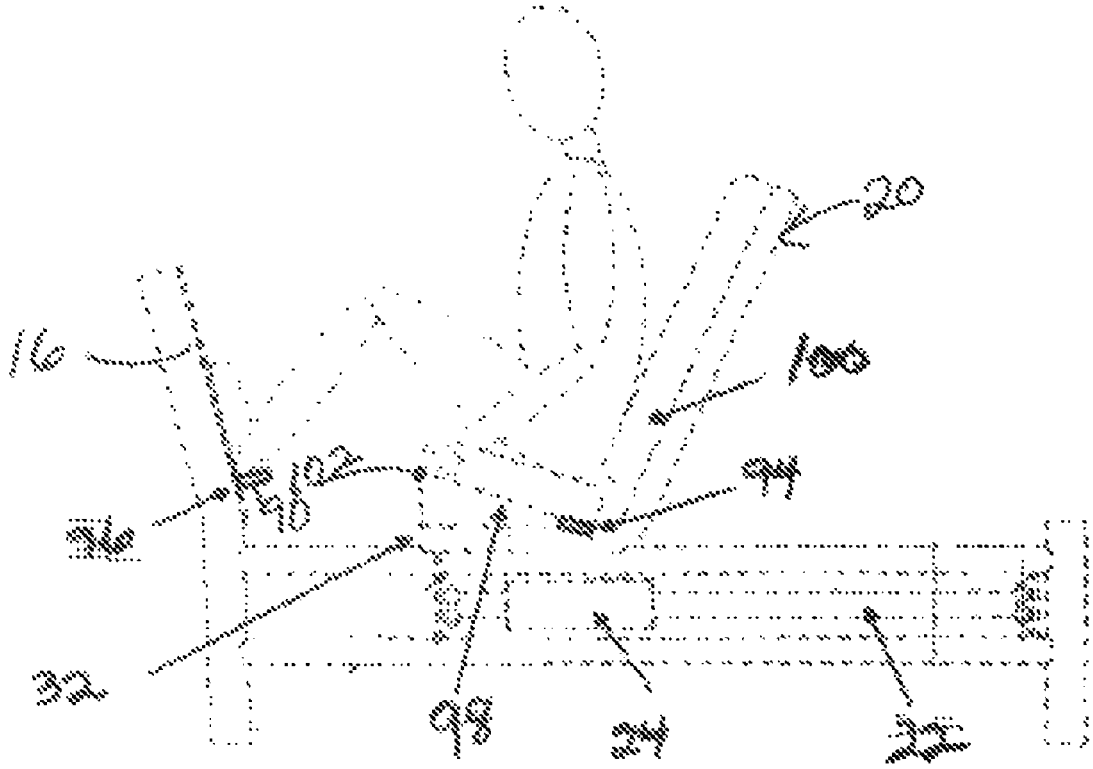
FIG. 10 is a schematic illustration of a user properly seated according to the present invention with knees flexed and heels contacting the heel rest on the footplate, where locations of heel and seat sensors are indicated.

A pressure-activated heel contact switch or switches 90 and at least one seat contact switch 94 may be employed to ensure that the user is in proper contact with the footplate 16 and is properly seated and positioned prior to exercise. FIG. 10 illustrates a user properly seated with knees flexed and heels contacting a heel rest 96 on the footplate, wherein possible locations of the heel contact switches 90 and seat contact switch 94 are indicated. The heel contact switches 90 ensure that the users' heels are in physical contact with the heel rest 96 mounted on the footplate 16 during all exercise. When two heel contact switches 90 are provided, an override may be provided to users having only one leg or desiring one-legged operation. The heel switches 90 may enable ankle movement such that a moderate degree of plantarflexion may be performed while the switches 90 remain activated.

The seat switch 94 may be employed to ensure that the user remains seated during exercise. According to one aspect of the present invention, the seat contact switch 94 may allow for some vertical movement of the seat bottom 98 and superior-inferior movement of the user's trunk while the switch 94 remains engaged. If the superior movement of the trunk exceeds a specified tolerance, the seat switch 94 will disengage. The seat bottom 98 may be inclined to assist the user in maintaining a properly seated position facilitating contact with the seat back 100 and a posterior portion of the seat bottom 98. In addition, the seat bottom 98 may include a hinge 102 about which the seat bottom 98 may rotate, and may include a spring 104 biasing the seat bottom 98 upward. With this configuration, proper seating of the user may be facilitated. Although not shown, a contact switch may also be included in the seat back to ensure that the user is in contact therewith.

The central controller 40 may monitor the heel and seat switches 90, 94 prior to and during exercise. If any of these switches 90, 94 become deactivated during exercise, the servomotor 14 may be disabled unless special controlled conditions are met that supersede the switch logic in the system's software/hardware control algorithms.

Hand switches (not shown) may also be employed to indicate that the user is ready and that his/her hands are not in contact with the seat bottom 98 in an attempt to defeat the purpose of the seat switch 94. The hand switches may be mounted on handles (not shown) at the side of the seat 20. The states of the hand switch may also be monitored by the central controller 40 and integrated with the control logic and software algorithms.

Figure 11A:
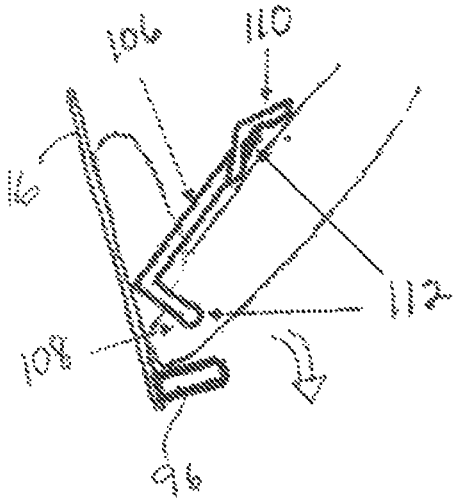
FIGS. 11*a* and 11*b* are schematic illustrations of the lower leg angle measurement system according to the present invention.
Figure 11B:
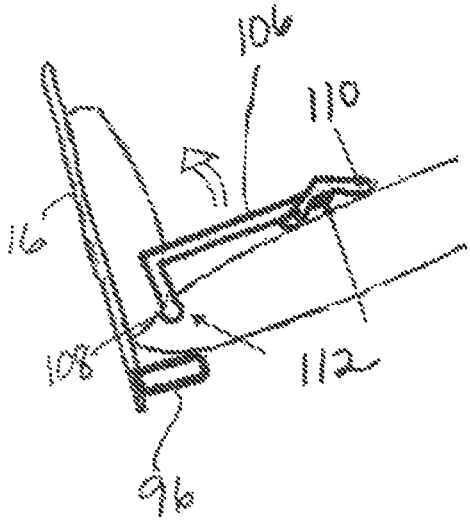

A knee lock prevention mechanism may be utilized for extended knee end limits to prevent a user's knees from locking in full extension. The knee lock prevention mechanism may be configured to prevent the user's knees from flexing less than 15 degrees during the VLC phase of training This eliminates the risk of the knees locking in full extension during the VLC phase. In one method depicted in FIGS. 11*a* and 11*b*, measures of the lower leg angle relative to the footplate 16 can be made when the user is properly seated during the VSC phase (FIG. 11*a*) and VLC phase (FIG. 11*b*). This lower leg angle measurement system may include a rotating lever 106 (e.g., L-shaped) attached to the footplate 16 via a hinge 108 with an axis of rotation near the center of rotation of the user's ankle. Note that the axes of rotation of the user's ankle joint and the rotating lever 106 are not required to be in exact alignment for accurate leg angle measurement.

A swiveling pad 110 may be attached to an end of the rotating lever 106 opposite to the hinge 108. The swiveling pad 110 rests on the anterior side of the user's lower leg, typically on the anterior surface of the tibia or tibialis anterior muscle, and may be allowed to rotate relative to the lever 106 if the center of rotation of the lever 106 is not aligned with the ankle to maintain proper contact with the lower leg. A face of the swivel pad 110, which may be concave, may provide for two points of contact with each leg. The points of contact define a plane with a slope that is parallel to the orientation of the lower leg. This system can be comprised of a single swiveling pad 110, or could have two independent swiveling pads 110—one for each leg. Rotary position measurement sensors 112 (e.g., potentiometers, rotary encoders, etc) may be attached at the rotation points of both the rotating lever 106 and the swiveling pad 110. The combination of these sensor signals provide the system with the angle of the lower leg relative to horizontal or an imaginary line passing through the ankle and hip joints. As an alternative, a single tilt sensor mounted on the swiveling pad 110 could also be used to measure the lower leg angle. A spring- or gravity-driven torque may be applied to the rotating lever 106 to ensure that the swiveling pad 110 engages the anterior surface of the lower leg throughout the exercise.

With continued reference to FIG. 11, knee flexion may be calculated based on measured leg angle relative to the heel rest 96 and seat bottom 98, and the assumption that the hip-to-knee and knee-to-ankle segment lengths are equal or that the ratio of one to the other is a fixed value taken from published anthropometric human body segment length data. It is recognized that there will be variability in the accuracy of the system's measure of lower leg angle due to the natural and variable curvature of the anterior surface of the lower leg and the fact that this curvature will vary among users. Furthermore, the relative anatomical location of the points at which the swiveling pad 110 makes contact with the lower leg will also vary among users with different heights and leg lengths. Contact for shorter persons is expected to be closer to the knee, whereas contact for taller persons is expected to be closer to the ankle. The system software can make minor corrections to the measured angle based on user height and stored information on average curvature of the anterior surface of the lower leg. Furthermore, the ROM of the system may be conservatively calculated allowing for a significant degree of tolerance for error in the measurement of the leg angle without enabling the user to hyperextend or lock his/her knees during exercise.

The lower leg angle measurement system described herein can be used as the primary feedback signal for controlling motor 14 movement during exercise, or serve as a backup signal for safety purposes notifying the system controller 40 and the user if and when predefined travel safety limits have been exceeded. The controller 40 may also calculate and predict leg angle based on motor position and entered body segment sizes. If the predicted and measured values differ by an amount that exceeds a predefined safety threshold, the system can sound an alarm and halt motor movement until the discrepancy is resolved. Monitoring the continuously changing leg angle signal and comparing it with motor position can also enable the controller 40 to determine the "health" of the sensors, and make a reasonably reliable decision as to whether the sensor is operational or not.

FIGS. 12*a*-12*c* are schematic illustrations of a cable suspended T-bar system according to the present invention for tracking movement of a user's knees. FIG. 12*a* shows a cross-sectional front view of the knees in relation to the T-bar 114 and cable 116. The T-Bar 114 may be placed by the user under each knee (typically in the popliteal region) with the attachment for the cable 116 positioned between the knees. In FIGS. 12*b* (SC/VSC phase) and 12*c* (LC/VLC phase), the solid block arrows show the linear movement of the seat 20 in each contraction, and the open arrows indicate the corresponding rotations and extensions/retractions of the cable 116 in response to the given exercise movements.

The T-Bar 114 may track the movement of the user's knees by moving with the posterior side of the knees during exercise—moving both vertically and horizontally. This may be accomplished by a form of cable retraction that applies a specified tension along the cable 116 imparting a small upward force to the T-bar 114. The upward force has a mostly vertical component but will possess a horizontal component as well with a force vector aligned with the cable 116. The cable retraction force can be applied via any means appropriate. For example, weights hanging from a pulley or pulley system or a rotationally spring-driven pulley 118 may be employed. The cable 116 could also be replaced with a rope, string, belt, or others. Movement of the cable 116, possibly measured via a rotational sensor (e.g., potentiometer, rotary encoder, etc) tracking rotation of the cable pulley 118, may be monitored to track movement of the user's knees/legs. This feedback can be compared with seat movement to ensure the T-Bar 114 is properly engaged.

The cable retraction system may be allowed to "dispense" cable 116 to a preset fixed length before reaching a physical "hard-limit". The physical orientation of the cable 116 and its physical hard-limit may be designed such that the user will be unable to extend (straighten) his/her knees beyond a predetermined knee flexion angle. This design ensures that users cannot lock or hyper-extend their knees during exercise when properly seated. The motor-driven system may be deactivated if the user attempts to defeat this safety mechanism by lifting his/her heels off of the heel rest 96 of the footplate 16 or by lifting his/her trunk off of the system seat 20. A safety tolerance may be employed to accommodate a wide variety of human anthropometries. A small variability in absolute knee-extension restriction angles is expected from person to person, wherein this variability may be minimized by optimized positioning of the overhead cable mount. The hard limit may be realized by restricting the positioning of the user's ankle, knee and hip joints via the heel switches 90, T-bar 114, and seat switch 94. The knee joints are never allowed to be physically in line with an artificial line drawn through the ankle and hip joints. Consequently, the knees are always at least partially flexed during training, thus, avoiding injury due to knee hyper-extension or knee-lock.

With reference to FIG. 13, a knee position mechanism such as spring-driven thigh levers 120 may serve as a thigh angle measurement system for tracking the angle and proximity of the back of the thigh to the front edge 122 of the seat bottom 98 during training This system may be embodied as, but is not limited to, a crossbar 124 parallel to the front edge 122 of the seat bottom 98 attached to a mechanical lever 120 or multiple mechanical levers that possess a center-of-rotation located under and to the rear of the seat bottom 98. The center-of-rotation can also be behind the seat bottom 98 or ideally along the axis of the center of rotation of the hip joints. The levers 120 rotate such that they push the crossbar 124 toward the posterior side of the user's thigh. This rotation may be driven by torsion springs 126 (FIG. 13*c*) or the equivalent. The underside of the seat bottom 98 limits the rotation (e.g., clockwise) of the levers 120 (see FIG. 13*a*) such that the crossbar 124 rises above the planar surface of the top of the seat bottom 98.

When a user straightens his or her legs during the VSC phase of a leg press training stroke, the posterior sides of the user's thighs make contact with the crossbar 124, forcing the lever(s) 120 to rotate downward (e.g., counterclockwise; see FIG. 13*b*). As the user flexes his/her knees during the return or VLC phase, the lever(s) 120 rotate upward (e.g. clockwise) via spring torque applied to the lever 120. A rotational sensor 128 (e.g., potentiometer, rotary encoder, etc) attached to the rotating shaft 130 on which the levers 120 pivot may measure the rotation of the levers 120 and, thus, the movement of the crossbar 124 and the user's legs. Ultimately, this signal provides information on the flexion angle of the knees. Two levers 120 can be used (one for each leg), or a single lever 120 may be used since the knee that is most extended will activate the lever, thus handling a worse-case scenario if an individual's legs are of different length. The resulting electrical signal may be monitored by the system 10, and movement of the seat 20 as driven by the motor 14 will be halted if the crossbar/lever(s) 120, 124 move downward past a predetermined threshold of safety. The system may or may not track the movement through the entire training stroke, but should actively measure movement during the final phase (i.e., 15 degrees) of an extension. The rotating thigh lever sensor system may or may not have a hard stop (e.g. counterclockwise) positioned to limit the extension of the user's knees and legs.

In another embodiment, a contact pressure switching mechanism integrated into the front edge 122 of the seat bottom 98. The switch system may be activated upon pressure/force (approximately normal to the seat bottom 98) applied to the front edge 120 of the seat bottom 98 that exceeds a preset threshold.

Figure 14A:
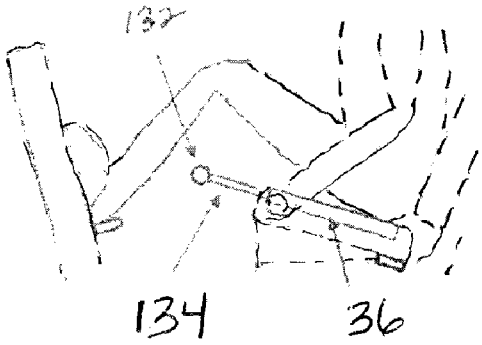
FIGS. 14*a* and 14*b* are schematic illustrations of a physical restraint to limit knee extension according to the present invention during shortening and lengthening contractions, respectively.
Figure 14B:
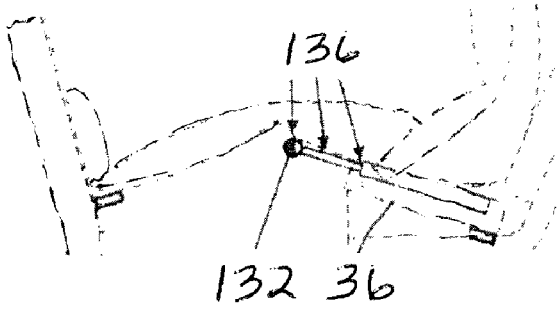

For user safety, it is of particular importance during the return or VLC phase of leg press training exercise to prevent the knees from locking as the motor 14 drives the seat 20 in a manner to shorten the distance between the seat 20 and footplate 16. FIG. 14 shows a schematic illustration of an adjustable knee restraint mechanism 36 that serves as a physical hard-stop designed to limit knee extension such that the user's knees can never lock or hyperextend during exercise. The knee restraint 36 may include a padded crossbar 132 that may be positioned via a telescoping support 134 as shown, a sliding or swiveling system that locks in place, or a mechanism that achieves the equivalent.

The knee restraint 36 can be outfitted with contact and position sensors 136 enabling it to serve as more than just a physical hard stop. The integrated sensors 136 may be configured to notify the controller 40 and user of the telescoped position of the padded crossbar 132 and indicate when the user's thighs make contact with the restraint 36. The central controller 40 may be able to inform (or require its positioning within a certain tolerance) the user as to where the padded crossbar 132 should be positioned for optimal performance based on the user's height or leg/inseam length if the central controller 40 has been provided with that information.

ROM limits customized to each user may be included to prevent knee hyperextension or knee lock. The maximum allowable limits on the ROM of exercise will vary and be dependent on the user's physical size, motor capability and training/therapy needs. The maximum end limit of knee extension may be conservatively limited for safety to prevent users from hyperextending/locking their knees during exercise.

The start and end limits may be determined by conservative geometric calculations based on entered user height, human anthropometric data, and average shoe physical dimensions. Software algorithms can calculate footplate-to-ankle, ankle-to-knee, knee-to-hip, and hip-to-posterior side of lower trunk segment lengths using published anthropometric body segment lengths as a function of body height. Conservative measures may be used erring on the side of a "shorter" training stroke or ROM. Software drive control of the system motor 14 may be limited to these conservative calculations. A typical ROM expressed in knee flexion angle might range from 90 degrees to 30 degrees.

The start and end limits may alternatively be determined using conservative geometric calculations based on an entered user leg length or inseam. Similar to above, software algorithms can calculate footplate-to-ankle, ankle-to-knee, knee-to-hip, and hip-to-posterior side of lower trunk segment lengths using published anthropometric body segment lengths as a function of leg length or inseam.

Another method for determining a user's ROM is by "teaching" the system via a single half repetition. While seated properly, the user may choose a starting position with his/her knees in a flexed position, typically near 90 degrees of knee flexion. The user then performs a closed-chain leg press (multi jointknee and hip extension along with ankle plantar flexion) with the feet moving away from the trunk, thereby extending the legs. The motor 14 enables the movement as long as the user remains properly seated and continues to develop leg extension force that exceeds a preset low force threshold. By monitoring the user's force output and travel distance, the system can calculate and record an appropriate and safe ROM for training.

The ROM values can be stored and retrieved for subsequent use. Users may select different ROMs from those calculated as long as they are not prevented from remaining properly seated or violate any predefined sensor safety algorithms or thresholds during exercise.

As described above, an initial set-up process may be utilized in which the user's leg length is measured manually and entered into the computer 40, and system software computes the proper end of travel position based on this information. The user may then be placed in the desired start position in order to ensure the proper ROM. The configuration process may only need to occur during the initial visit or if there is a change in the user's ability to perform the exercise (e.g., injury, surgery, restricted ROM, etc.).

Figure 15:
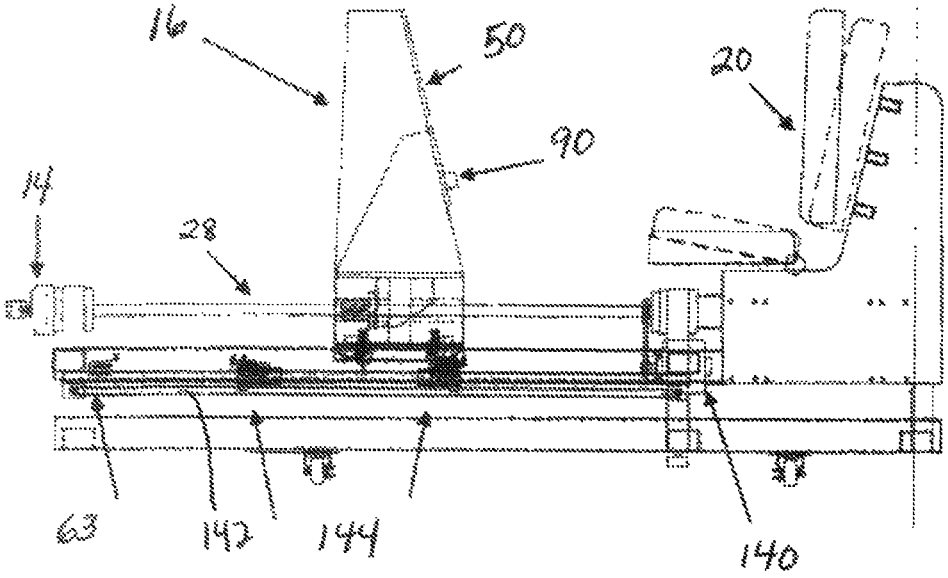
FIG. 15 is a schematic illustration of a system for ROM determination and enforcement according to an aspect of the present invention.
Figure 16:
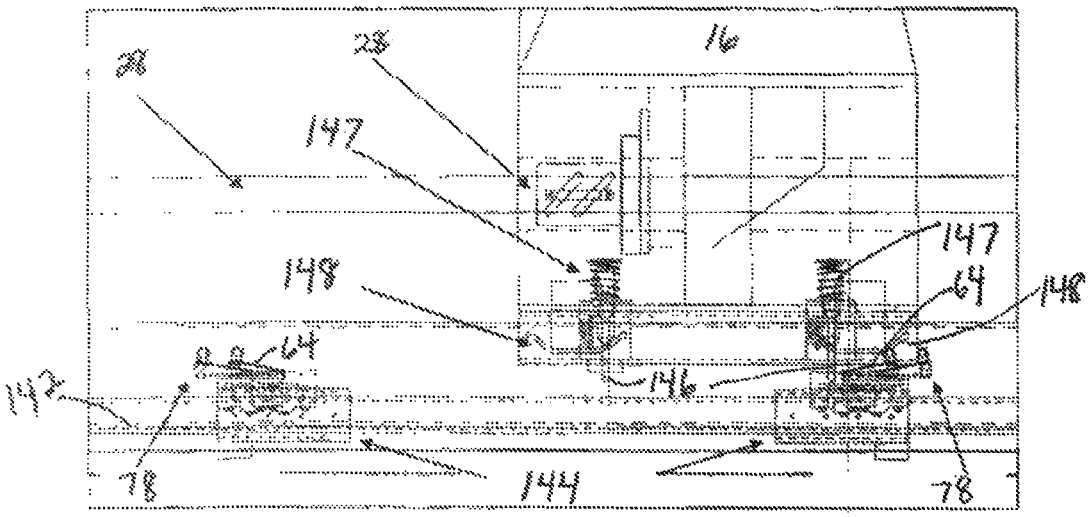
FIG. 16 is an enlarged view of the system of FIG. 15 depicting the limit switches and solenoid-operated fingers at the base of the footplate.

In accordance with the present invention, an automatic leg length measurement is described below which may simplify the user setup process. FIG. 15 shows one possible configuration of the system 10. In the description below, the system 10 is configured with a fixed seat 20 and movable footplate 16, although it is understood that a fixed footplate 16 and movable seat 20 could alternatively be used, or even a footplate 16 and seat 20 that each are movable with respect to one another. A primary electric motor 14 drives the footplate 16 during exercise via a drive mechanism 28. The footplate 16 may be mounted on bearings 24 which ride on at shafts 22, typically at least two, to provide additional stability and support. A computer 40 controls the motor 14 to move the footplate 16 in a linear reciprocating manner between the user's start position and end position. A force transducer 50 on the footplate 16 not only measures the user's effort, but enables the user or trainer to "trigger" the next repetition through the application of force as described further below.

A low-cost, low-power secondary motor 140 may be mounted at the opposite end of the drive mechanism 28 from the primary motor 14 and may be operated only under direct user control. Alternatively, the primary motor 14 could perform the function of the secondary motor 140 as well if it is configured to a secure low-power mode during the set-up process and then switched to the high power mode during testing and training activities.

A two-position switch (not shown) may control power to the two motors 14, 140 such that their operation may be mutually exclusive. The user may select a "Setup" position of the switch to enable the small secondary motor 140 and thus enter the setup process, or select a "Run" position of the switch to begin training with the primary motor 14. Once "Setup" has been selected, the user has control over the secondary motor 140 via a three-position switch (not shown) that causes the footplate 16 to move toward the user, away from the user, or remain stationary. Power-off, absolute limit switches 78 may be mounted at the extreme ends of the footplate 16 travel range to prevent over-travel. For safety reasons, this motor 140 may intentionally be weak enough for the user's legs to easily overpower it in a straight-legged position without injury.

Beneath the shafts 22 on which the footplate 16 slides may be a tube 142 on which two sleeves ride. Each sleeve, or ROM limit switch block 144, may contain two limit switches 64, 78 mounted inline, but at a horizontal offset from each other. The inner switch 64 may be routinely activated when the footplate 16 reaches the desired end-of-travel position at each end of the ROM. The system software may perform a check at both ends of every repetition to verify that the motor's position sensor and limit switch activations are in agreement. This is a safety precaution to ensure that the ROM does not drift. Disagreement by more than a predetermined threshold may cause the system to be disabled. The outer switch 78 may not be activated during normal operation, and may only come into play if an error occurs such that the footplate 16 travels too far. If this happens, the switch may cut power to the drive motor 14 to disable the system as a safety precaution. This action may take place independently of the system software.

At the base of the footplate 16, two solenoid-operated fingers 146 may be provided that protrude downward when activated or retract upward when deactivated via the solenoid springs 147. When activated, these fingers 146 may engage the ROM limit switch blocks 144 and enable them to move with the footplate 16. When retracted, the switch blocks 144 may be released from the footplate 16 and positioned firmly on the tube 142 to mark the ends of travel for the ROM. The solenoid may be normally retracted, meaning that the switch blocks 144 may be moved only if power is applied to the solenoid to extend the finger 146. Two switch deflectors 148, which may be ramp-shaped, may be located at the base of the footplate 16. These deflectors 148 are designed to depress the limit switches 64 when the moving footplate 16 reaches the end of its ROM and encounters the limit switch 64.

The initial setup method for configuring the system for a new user may proceed as follows. The system initializes with the footplate 16 stationary in the "home position", the position furthest from the seat 20, with the limit switch blocks 144 engaged by the fingers 146 at the base of the footplate 16. The user sits in the seat 20 which activates the seat switch 94, informing the computer that the user is seated. The user chooses "Setup" on the mutually exclusive power/control switch to enable the small secondary motor 140 and disable the primary drive motor 14. The user selects the "Forward"

position of the secondary motor drive switch to begin moving the footplate 16 towards the seat 20. Once the footplate 16 is close enough, the user may place his/her feet against the footplate 16, resting them on the heel rest 96. At this point the user's legs are straight. With legs straight, the user instructs the motor 140 to move the footplate 16 slightly toward him to generate a small amount of force on the footplate force transducer 50. The computer 40 notes the increase in force, the activation of the heel switch 90, and the activation of the seat switch 94. If all are satisfactory and a predetermined force threshold is exceeded, the software uses this position to accurately calculate the user's leg length as well as the desired limits of the ROM.

The user now allows his legs to bend and continues moving the footplate 16 toward him. As the footplate 16 reaches the desired extended position of the ROM (either a default value, such as 150 degrees of knee flexion, or some value specified by the user) the computer 40 (or alternatively, the user) activates the first solenoid to retract one finger 146 and drop a first switch block 144 firmly into place. Note that manual override of the computed endpoints of travel allow the user to operate the system 10 in a restricted ROM mode if desired, but for safety reasons the ROM cannot be increased beyond the computed value. The user continues moving the footplate 16 toward him until the computer 40 (or alternatively, the user) activates the second solenoid to retract the second finger 146 and drop the second switch block 144 into place at the beginning position of the ROM. This position can be a default value, such as 90 degrees, or some other value specified by the user. These positions may be stored in the computer memory 41 for recall during future training sessions by this user. The footplate 16 then returns to the home (furthest) position, and the user switches the system to "Run" mode where it may be controlled by the drive motor 14. The drive motor 14, as controlled by the computer 40, will move the footplate 16 in a reciprocating pattern between the limit switch blocks 144 to execute strength training repetitions.

Figure 17:
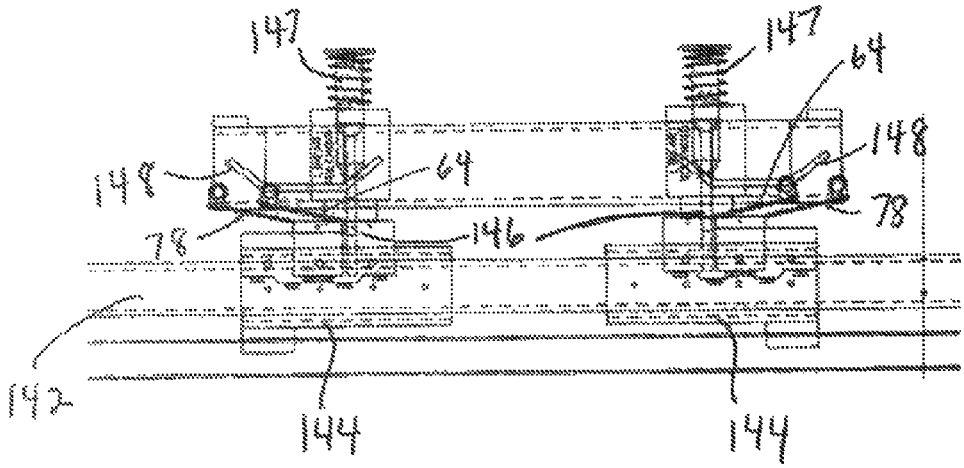
FIG. 17 illustrates the limit switch blocks engaged by solenoids/fingers at the base of the footplate, wherein the limit switch blocks have not yet been dropped into place and will move with the footplate.
Figure 18:
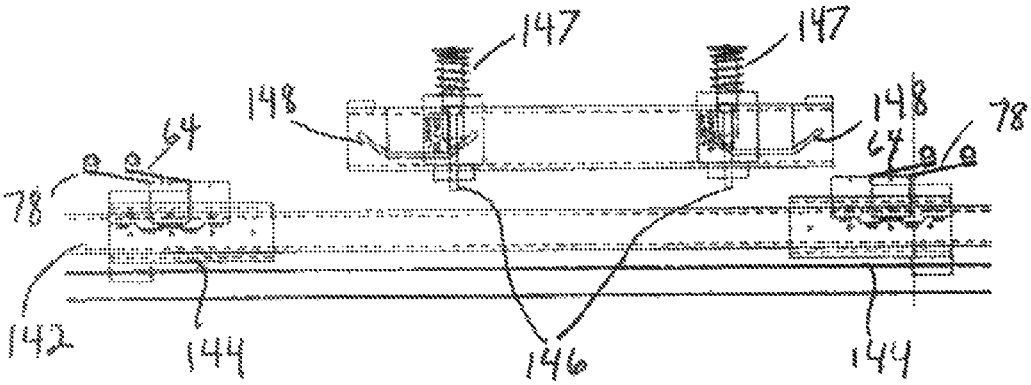
FIG. 18 illustrates the limit switch blocks "dropped" into positions that mark the start and end of the user's ROM.

Once the system has been configured for a particular user, it can be setup automatically for that user for subsequent training sessions, wherein one possible method is as follows. The user may enter his/her identifying information either through name, user ID, password, insertion of a flash drive or other identifying key, wireless identification such as RFID, or other method. The system recalls the desired locations of the limit switch blocks 144. The system ensures that the seat 20 is unoccupied (by noting that the seat switch 94 has not been activated) and then under primary motor 14 control, drives the footplate 16 toward the seat 20. The limit switches 144 are "dropped" at the desired locations and then the footplate 16 may be returned to the end of ROM position where it is ready to begin training FIGS. 17 and 18 illustrate the switch blocks 144 in the engaged and disengaged positions, respectively. The user may now sit down and instructs the system 10 to begin the training session. It is understood that numerous variations on these methods are possible and fully contemplated in accordance with the present invention.

In further accordance with the present invention, a combination tracking physical knee restraint and ROM determination may be accomplished which may further simplify the user setup process while enhancing user safety. The feature involves the deployment of a knee position mechanism such as a tracking knee restraint mechanism 150 to prevent the user's knees from fully extending and potentially leading to "knee-lock". The tracking knee restraint 150 may be used in conjunction with primary 152 and secondary 154 position sensors to provide separate and redundant measures of the distance between the footplate 16 and the seat 20.

Figure 19:
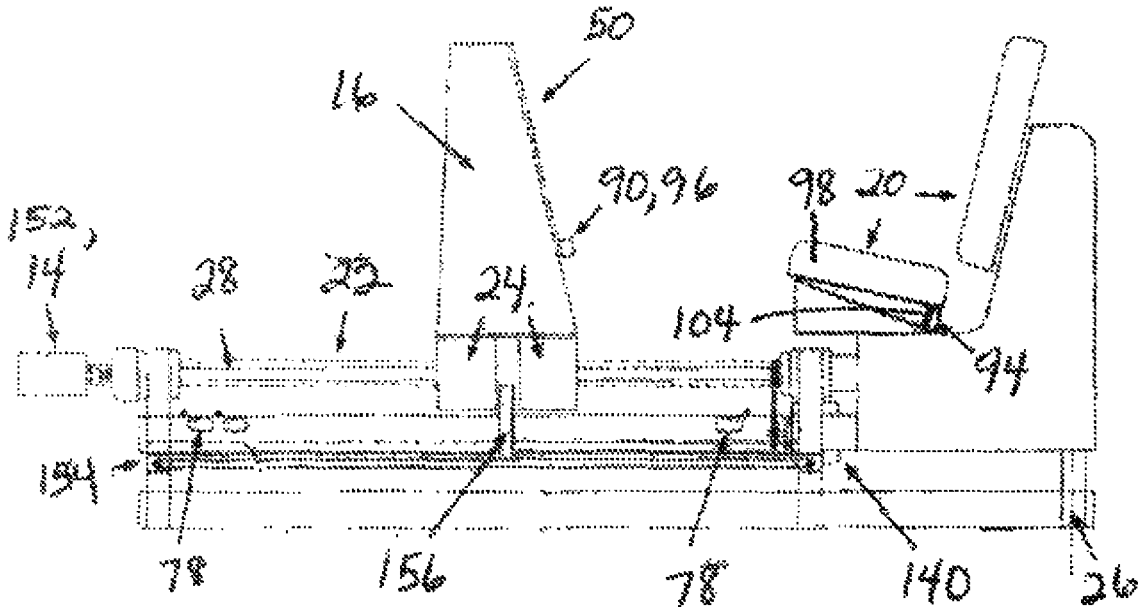
FIG. 19 is a side elevational view of a system which incorporates a tracking knee restraint mechanism according to an aspect of the present invention.

FIG. 19 shows one possible configuration of the system 10 in which the tracking knee restraint mechanism 150 may be utilized. Primary and secondary position sensors 152, 154 may be used to identify the position of the footplate 16 relative to the user's seat 20. These position sensors 152, 154 may be, for example, rotary optical encoders, yo-yo style optical encoders, potentiometers, magnetic pickups, or others. The position sensors 152, 154 may be used in conjunction with an array of fixed switches placed at known physical locations along the length of the absolute ROM of the footplate 16. Also, a pair of end limit switches 78 may be used to prevent either the primary 14 or secondary 140 motors from attempting to drive beyond the physical limits of the drive system 28. The primary position sensor 152 may be integrated with the primary motor 14. The secondary position sensor 154 may be mounted to the frame 26 with a linkage 156 (possibly via belts, pulleys, gears, shaft coupling, magnetic linkage, optical linkage, etc) to the footplate 16 to measure its position relative to the frame 26. FIG. 19 shows one possible configuration for the secondary position sensor 154.

The position sensors 152, 154 provide feedback for the absolute position of the footplate 16 as well as the end limit positions that mark the boundaries of the custom ROM of a user. The primary position sensor 152 may be used for control, motor feedback, and user feedback purposes. The secondary position sensor 154 may be used for safety purposes and may be part of a watchdog circuit that may be electrically isolated from the primary sensor 152 and drive circuitry. It may also be powered via its own isolated supply. The watchdog circuit may compare the outputs of the primary and secondary position sensors 152, 154 in real-time. If a discrepancy between the two position readings exceeds a preset tolerance threshold, the motor drive 28 may be halted until the discrepancy is resolved. The watchdog circuit may also ensure that the primary training motor 14 does not drive the footplate 16 beyond the custom ROM limits of the user.

Figure 20:
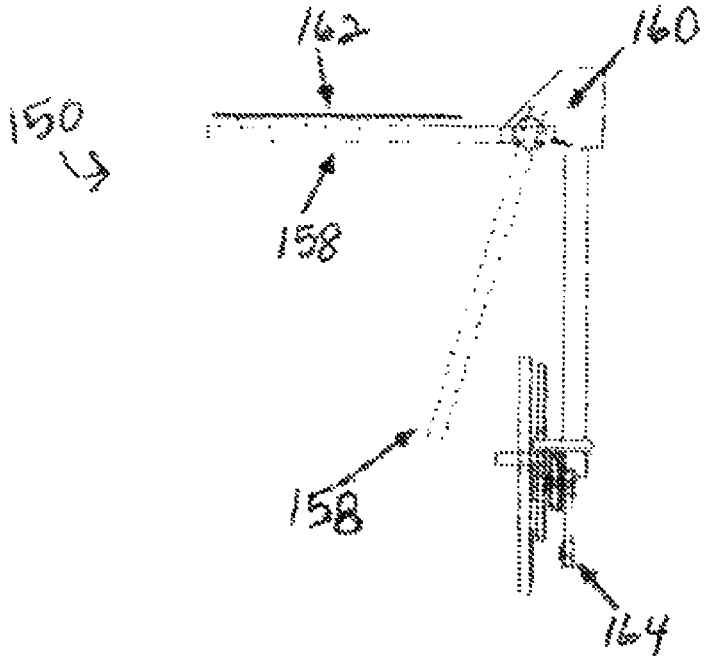
FIG. 20 is an end elevational view of the tracking knee restraint system.
Figure 21:
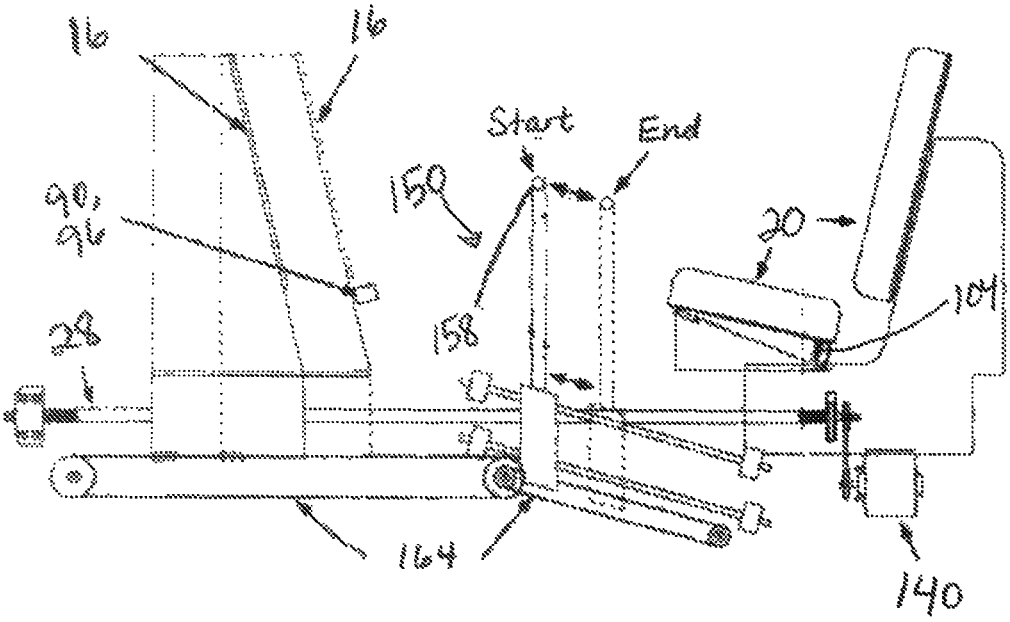
FIG. 21 is a side elevational view of the tracking knee restraint system, footplate, seat, secondary motor and main drive shaft, wherein the footplate and knee restraint are shown in extended (solid lines) and contracted (dashed lines) positions for a tall person.

One possible configuration for the tracking knee restraint 150 according to the present invention is depicted in FIGS. 20 and 21. The knee restraint 150 may be embodied as a horizontal bar 158 that may be positioned under the knees of the user. To facilitate access in and out of the system, the horizontal bar 158 can be moved out of the way of the user as he/she attempts to sit down on or stand up from the system seat 20. The horizontal bar 158 may then be moved into the training position by swinging it upward on a hinge 160 (FIG. 20), or other means, such as by sliding it horizontally or vertically on a telescoping slide, and snapping it securely in place. Once in position, a power switch (not shown) may be engaged which will enable power to the primary training motor 14 when the users switches to the Run mode. No power may be applied to the primary motor 14 when this power switch is not engaged. Consequently, if for some reason the horizontal bar 158 will not securely engage or the user physically overpowers the secure engagement of the horizontal bar 158, power will be cut to the primary motor 14.

Figure 22A:
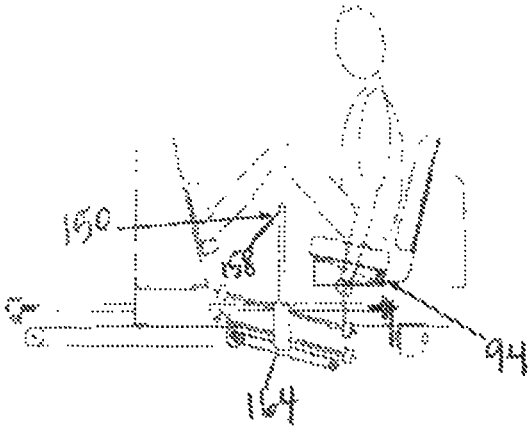
FIG. 22 is a schematic illustration showing the two training end limits defining the boundary conditions of the custom ROM for a relatively tall person at (a) the end limit of knee flexion and (b) the end limit of knee extension.
Figure 22B:
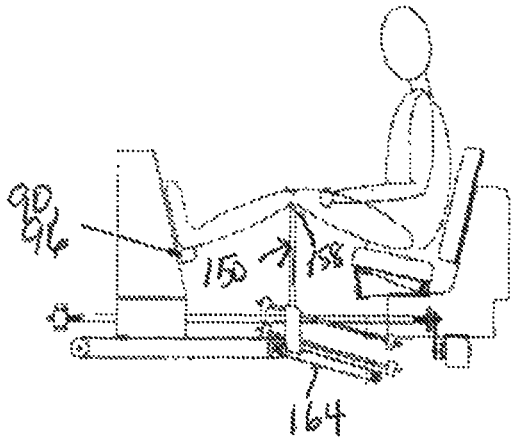

On the top surface of the horizontal bar 158, there may be a sensor (FIG. 20) or contact switch 162 that may notify the system when the posterior sides of the user's knees make contact with it (FIG. 22*b*). Contact switch 162 may also act as a limit switch that, when depressed, disables the drive of both the setup and training motors 14, 140 in the direction that would further extend the user's legs. This switch 162 may be designed to require a minimum threshold of force before switch contact is made to allow, for example, loose clothing to make contact without tripping the switch 162.

FIG. 21 shows a side view of one possible configuration of the tracking knee restraint mechanism 150 and how it may be mechanically linked to the footplate 16 via a drive system 164 (e.g., belt and pulley, gears, or other mechanism). The drive system 164 may be designed to move the knee restraint 150 at roughly half the speed of the footplate 16 in order to track the horizontal movement of the user's knees. The movement of the restraint 150 may also include a small vertical component caused by moving along an incline as depicted in FIG. 21. As the footplate 16 moves outward, the knee restraint 150 will move out and up. The inclined movement enables better tracking of the posterior (underside) side of the user's knees for individuals of all heights since the posterior sides of the knees of tall people are typically higher than those of short people when seated with their knees flexed/bent. FIGS. 22*a* and 22*b* show the positions of the tracking knee restraint 150 and the user's knees at the two end limits of the user's ROM, wherein the restraint 150 tracks the horizontal position of the knees.

The tracking knee restraint system 150 according to the present invention may serve several safety functions. The act of its deployment (FIG. 20) closes the contacts to a switch 162 that may be in series with a circuit that enables high power to the primary training motor 14. Consequently, when the knee restraint 150 is retracted and not deployed, the higher power training motor 14 will not run. It should be noted that other switches, including a power switch, are in series with this switch 162, such that deployment of the knee restraint 150 alone will not provide power to the training motor 14. When deployed, the tracking knee restraint system 150 is a physical restraint that prevents the user's knees from extending to a straight "locked" position (FIG. 22*b*). The knee restraint 150 may include a built-in switch 162 across its top surface (FIG. 20) that acts as a limit-switch that, when depressed, disables the drive of both the setup and training motors 14, 140 in the direction that would further extend the user's legs/knees. The built-in switch 162 also serves to notify the system of the ultimate end limit of the knee extension (FIG. 22*b*) of the user's training ROM.

The initial setup method for configuring the system for a new user may proceed as follows, although it is understood that a variety of different schemes may be employed. First, the user sits in the seat 20 which activates the seat switch 94, informing the computer 40 that the user is seated. The user chooses "Setup" on the mutually exclusive power/control switch to enable the small secondary motor 140 and disable the primary drive motor 14. The user chooses between "Forward" and "Reverse" positions of the secondary motor drive switch to begin moving the footplate 16 towards or away, respectively, from the seat 20. The user positions the footplate 16 where he/she can comfortable place his/her feet against the footplate 16, resting them on the heel rest 96. The seat and heel switches 90, 94 may be required to be engaged for the setup to be valid and accepted by the system 10.

The user may be instructed to adjust the position of the footplate 16 to the "starting" position of his/her desired custom ROM. The starting position may be defined as the position where the user's knees are in the most flexed position of the custom training ROM (typically near 90 degrees of knee flexion) (FIG. 22*a*). The user informs the system when the desired starting position has been reached. At this point, both the primary and secondary position sensors 152, 154 (FIG. 19) are reset or "zeroed". The system will recognize this zero position as the end limit of knee flexion of the user's active training ROM. The zero position will serve as one of two end limits or boundaries that define the training ROM.

The user may deploy the tracking knee restraint mechanism 150 by snapping it into position below his/her knees. It is possible that this deployment may be used above to notify the system 10 that the desired starting position has been reached. The user may then instruct the motor 140 to drive the footplate 16 away from the seat 20 to seek the desired extended position. As the footplate 16 moves outward, the user's knees will move downward and also outward horizontally at approximately half the speed of the footplate 16. The system knee restraint 150, which may be mechanically linked to the footplate drive mechanism via belts and pulleys 164, will also move outward at approximately half the speed of the footplate 16 to track the horizontal movement of the user's knees.

The user may instruct the motor 140 to continue to drive the footplate 16 away until the posterior side of his/her knees makes contact with the built-in switch 162 located across the top of the horizontal bar 158 (FIG. 22*b*). The outward movement of the setup motor 140 may be disabled as the switch 162 is triggered, and the system records this position. The movement of the knee restraint 150 may have a slight vertical incline or slope causing it to move slightly upward as the footplate 16 is driven outward. This incline may be designed to provide all sized users (short to tall) with approximately the same angular end limit of knee extension, since the posterior side of the knees of tall users is typically higher than short user's throughout the training ROM. Alternatively, the user may reach his/her desired extended position before the posterior side of his/her knee makes contact with the knee restraint mechanism 150 and notify the system.

The system records the position reached as the end limit of knee extension of the user's active training ROM. This position will serve as the second of the two end limits or boundaries that define the training ROM. The system may automatically "adjust" the position triggered above to effectively shorten the training ROM such that the user's knees will not make contact with the knee restraint switch 162 during training. Both end limit boundary positions may be stored in the computer memory 41 for recall during future training sessions by this user. The user switches the system to "Run" mode where it may be controlled by the drive motor 14. The act of switching to "Run" may be used as the method of notification above. The drive motor 14, as controlled by the computer 40 and user, will move the footplate 16 in a reciprocating pattern between the training end limits to execute strength training repetitions.

If during training the user's knees come into contact with the switch 162, such as due to system compliance or if the user shifts slightly in the seat 20, the system may stop the outward movement of the footplate 16. This may signify that the end of the VSC phase of the training stroke has been reached, and the system may note the new end position and transition to the beginning of the VLC phase. The end limit of knee extension may be adjusted for this new position. This adjustment may be programmed to happen seamlessly "on-the-fly" without the need for user input.

Once a user has been configured, the system can be setup automatically for subsequent training sessions. One possible method is as follows. First, the user enters his/her identifying information either through name, user ID, password, insertion of a flash drive or other identifying key, wireless identification such as RFID, or other method, and the system recalls the desired locations of the end limit. The user sits down, positions his/her feet on the footplate 16 resting on the heel rest 96 and instructs the system to begin the training session.

In the initial setup procedure, instead of using the redundant position sensor scheme to define the "zero" position, a switch block with limit switches could be positioned there through a method similar to that described above for the automatic leg length measurement feature.

The end limit of knee extension recorded may also be adjusted in real-time during training to compensate for estimated system mechanical compliance during training. As the force applied by the user increases, the framing of the system may flex and the seat back cushion may compress, thereby effectively increasing the distance between the seat back and footplate. The system can be programmed to shorten the training ROM by moving the end limit of knee extension closer to the zero position. The magnitude of the adjustment would be proportional to the force applied.

Figure 23A:
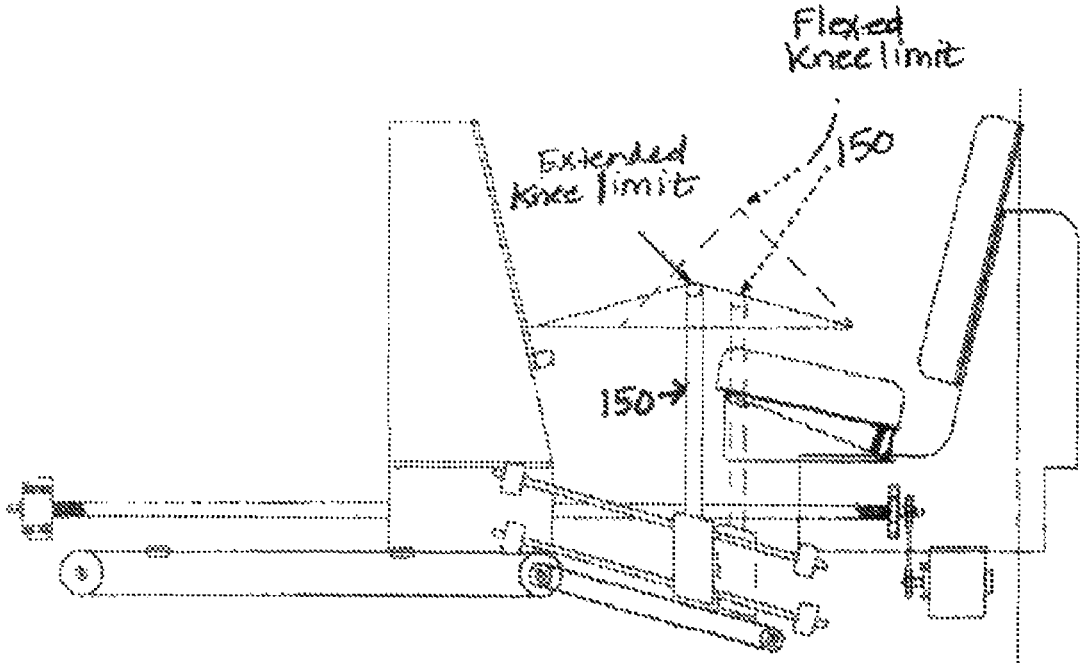
FIGS. 23*a* and 23*b* are schematic illustrations of the tracking knee restraint and leg segment end limit positions of the custom ROM for a short person and a tall person, respectively, wherein the hip-to-knee and knee-to-ankle leg segments are represented by simple lines, and the knee restraint and leg segment lines are drawn as solid lines for the extended position and dashed lines for the flexed position.
Figure 23B:
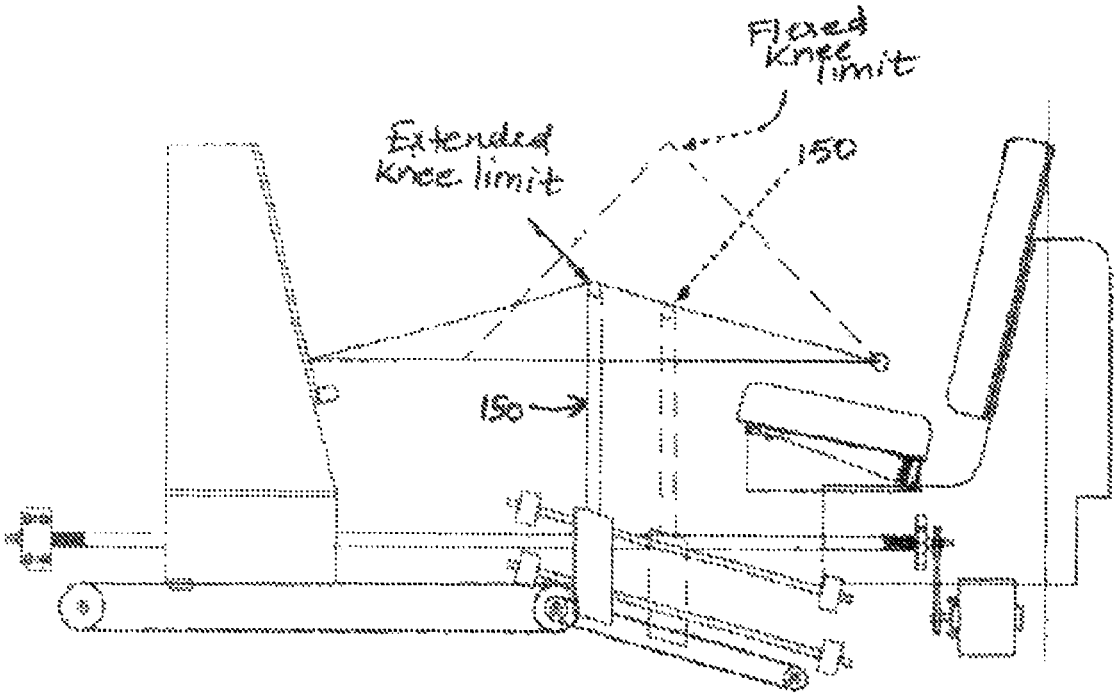

FIGS. 23*a* and 23*b* illustrate the horizontal tracking and vertical movement of the horizontal knee restraint relative to the user's knees for short and tall users, respectively, depicting the position of the knees and the restraint at the extended leg limit and at the flexed leg limit.

As indicated above with reference to FIGS. 2 and 3, the isometric profile (ISOP) according to the present invention is a user-specific force-angle curve showing maximum isometric leg extension strength at multiple discrete angular positions of the knee across the ROM. The ISOP may be generated for each user as described below. A computer program executable by the controller 40 may be used to generate a target force band, which may be based on the ISOP scaled by a specified percentage and surrounded by an error band to provide the user with a custom force-position target range. Advantageously, the target force band may be scaled differently for VLC training than it is for VSC training. Other methods of generating the target force band will be described further below.

During ISOP testing, users may be asked to perform one or more maximum voluntary isometric contractions at various angles of knee flexion (e.g., 90, 80, 70, 60, 50, 40 and 30 degrees). Each contraction may be held for 2-3 seconds and may be performed in a pseudo-randomized order with rest (e.g., 30 sec.) between each test. ISOP software may distribute measurements across the ROM in equal increments based on calculated knee angle instead of seat position, and may randomize the order of ISOP force-angle measurements for ISOP strength testing. A timer may be included to provide visual and audible cues when rest periods between measures expire.

Alternatively, traditional weight lifting guidelines specify lifting a weight that is a given percentage a person's one-rep maximum (1-RM). This same procedure can be used for setting the target band on the system according to the present invention. Knowing in advance the characteristic shape of an individual's force-position ISOP curve from a large population of users, a user's ISOP curve can be created by using the maximum isometric force produced by the user at a single position within his or her ROM. The single force value may be used to scale the characteristic curve shape to a level that is appropriate for the user. Target training bands may then be created for both the VSC training and VLC training modes by applying tolerance bands and further scaling the curve.

As still another alternative, the user can perform a single constant velocity maximum effort rep in either the VLC training direction, the VSC training direction, or both. This data may be recorded and padded with an error band to create the force-position target range.

Manual override can be used to scale the given target range up or down. Unlike a weight machine, the target force curve can be varied easily from rep to rep to create very flexible training schemes. A library of preprogrammed, scalable target training profiles may be provided for specific purposes (e.g., for users with patellofemoral pain or for those with limited ROM following surgery, for those who wish to achieve maximum strength gains, etc.).

Position settings may be entered and stored in computer-based user-specific profiles. The profiled position settings may be recalled as reference for subsequent training and testing sessions. ISOP determination may be performed at any time to reset ISOP-based training loads. Since the magnitude of the ISOP and both the VSC and VLC target training loads are expected to increase as training progresses, retesting ISOP measures enables regular updates to the VSC-VLC training profiles. When necessary, in the remaining training sessions before the next ISOP capture, the scaling for both VSC and VLC phases may be adjusted based on the results of the previous training session, such as in increments of 5%.

Users may be immediately notified by the system software via visual and audible alarms when a failure is detected in either the VSC or VLC phase. A repetition may be deemed a failure when either: (1) the force generation normal to the footplate 16 versus knee angle falls below the lower boundary of the training target band for 25% or more of the ROM, or (2) the area under the entire force-angle curve is less than the area under the lower boundary of the target band. Of course, it is understood that numerous methods or calculations may be used to determine the success of failure of a repetition, and the system and method according to the present invention are not limited to these examples.

The following description and figures relate to an example of the operation of the system 10 according to the present invention. The figures depict a series of exemplary screenshots of a control panel which may be shown on the display 18 demonstrating the sequence of events of a typical training repetition with the motor-driven computer-controlled resistance training system 10 described herein. It is understood that these screenshots and training values are merely exemplary, and that the system and method according to the present invention are not limited to these specific conditions. Furthermore, although the following examples are described with reference to a movable seat 20 and fixed footplate 16, it is understood that the system 10 may alternatively operate with a fixed seat 20 and movable footplate 16 or another configuration where the seat 20 and footplate 16 are each movable with respect to one another.

Figure 24:
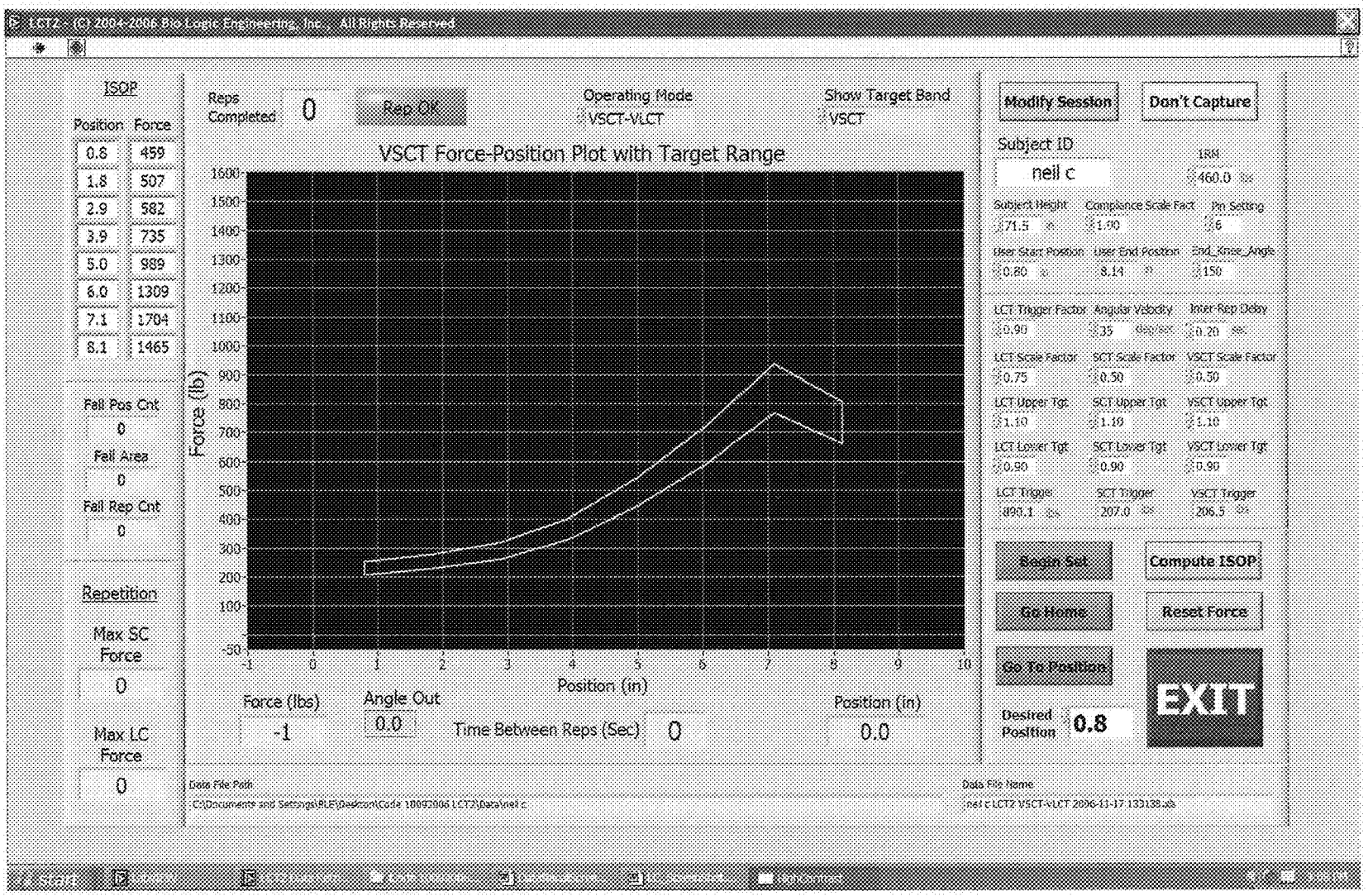
FIG. 24 is a screenshot of a control panel for resistance training with the system according to the present invention showing the VSC target band customized to a particular user.

FIG. 24 is a screenshot of a control panel for resistance training with the system 10 according to the present invention showing the VSC target band customized to a particular user. For this exemplary training session, the VSC target band is scaled to the 50%±10% of the custom ISOP values shown in the upper left corner of the control panel. The target force scaling factor and banding factors are illustrated on the right side of the control panel. The upper and lower boundaries of the band can be adjusted via these banding factors. The ISOP may be recalled from a data file generated from a past session in which the user opted to compute a custom ISOP via the "Compute ISOP" button on the right side of the control panel. The ISOP values represent the user's maximum force generating capacity at discrete points (e.g., 8 points) across the ROM (the horizontal length of the VSC target band). The values are represented with units of inches for position and pounds for force.

The graphical display in FIG. 24 shows a ±10% force target band across the ROM of the VSC phase of the training stroke. The VSC phase occurs as the knee and hip are extending. During this period, the active hip and knee extension muscle groups are mostly shortening. Some co-contractions of the antagonist muscles are likely to occur, which may result in shortening, isometric, or lengthening contractions of the antagonist muscles depending on the position and activation of the leg muscles.

The "Don't Capture" button in the upper right corner of the control panel gives the user the option to store or not store the training session data in a data file in memory 41. The system may default to storing all data in a predefined structure for easy future retrieval. All force-position data captured during SC-LC or VSC-VLC training along with all of the session setup and user parameters may be stored in the file path and name given at the bottom of the control panel. The data, when stored, may be separated into SC/VSC-phase and LC/VLC-phase packets. Each packet of each consecutive repetition may be appended to the same file for the entire training session. The "header" to this file may contain all of the user and setup information.

Figure 25:
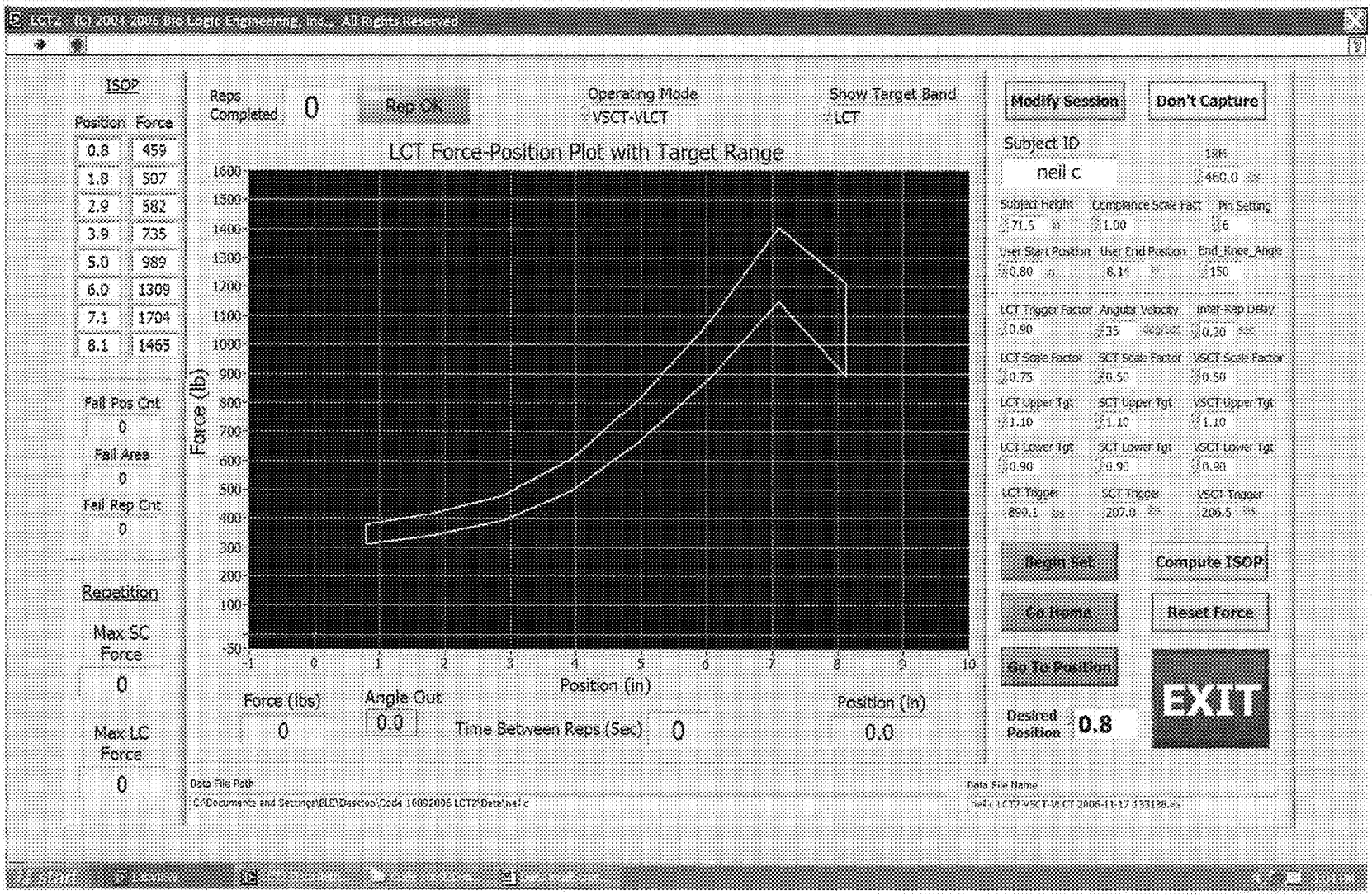
FIG. 25 is a screenshot of a control panel for resistance training with the system and method according to the present invention showing the VLC target band customized to a particular user.

FIG. 25 is a screenshot of a control panel for resistance training with the system and method according to the present invention showing the VLC target band customized to a particular user. For this exemplary training session, the VLC target band is scaled to the 75%±10% of the custom ISOP values shown in the upper left corner of the control panel. The target force scaling factor and banding factors are illustrated on the right side of the control panel. The upper and lower boundaries of the band can be adjusted via these banding factors.

The graphical display in FIG. 25 shows a ±10% force target band across the ROM of the VLC phase of the training stroke. The VLC phase occurs as the knee and hip are actively contracting but are being forced to lengthen by the motorized actuation of the system seat 20 as it is driven toward the footplate 16 (or the opposite). During this period, the active hip and knee extension muscle groups are mostly lengthening. Some co-contractions of the antagonist muscles are likely to occur, which may result in shortening, isometric, or lengthening contractions of the antagonist muscles depending on the position and activation of the leg muscles.

The following sequence represents one possible control scenario, although numerous alternatives are possible. All examples provided were performed using a constant angular knee velocity mode (35 deg/sec) and they approximate a single repetition.

Figure 26:
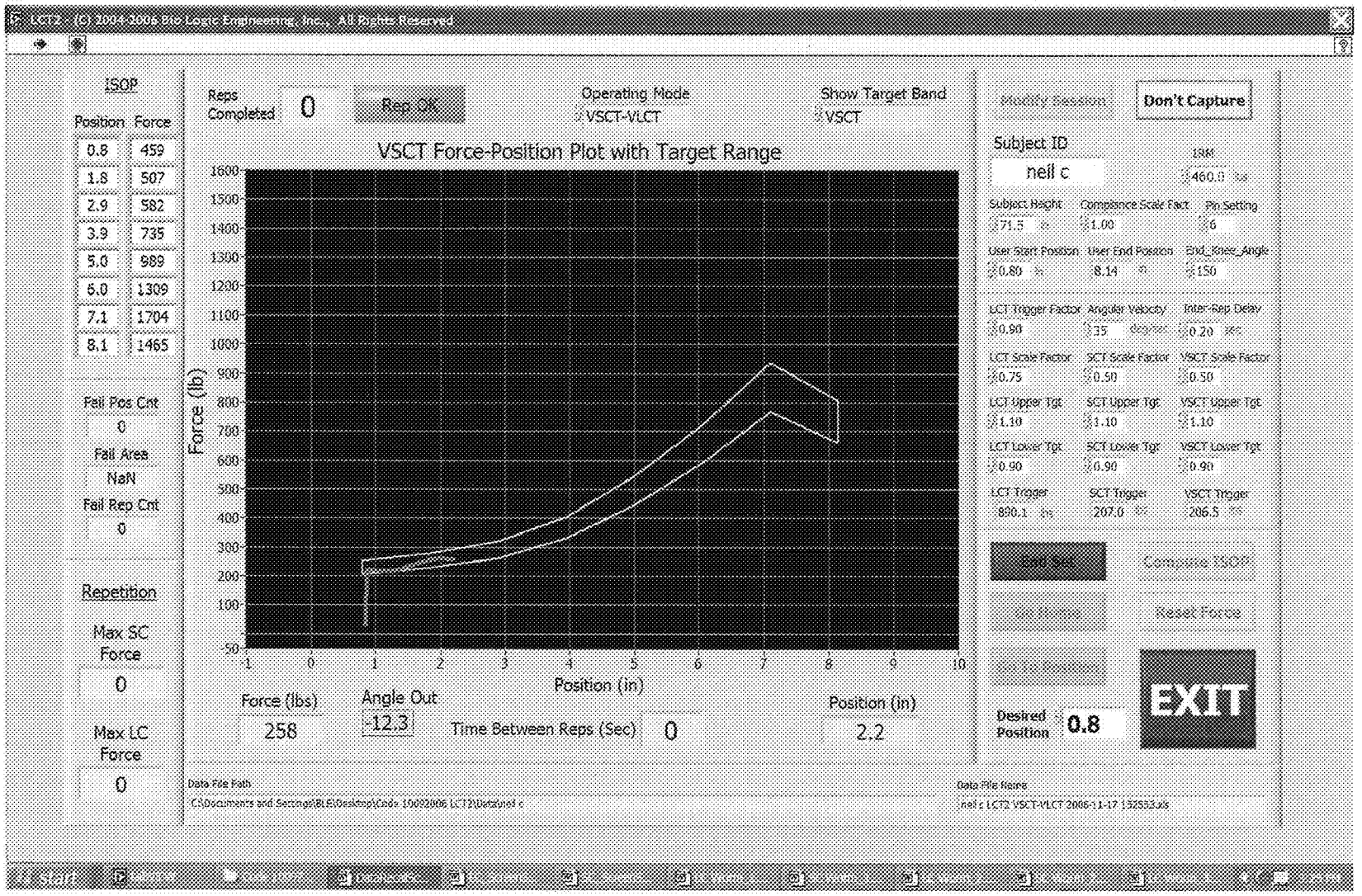
FIG. 26 is a screenshot illustrating the start of repetition one during the VSC phase.

FIG. 26 is a screenshot illustrating the start of the first repetition during the VSC phase. The control logic for the system in this embodiment may work as follows. After the "Begin Set" button (see FIGS. 24 and 25) is selected, the motor 14 drives the user seat 20 to the "User Start Position" which, in this case, is 0.80 inches. For this user with the seat adjust "Pin Setting" of 6, the user start knee angle is roughly 90 degrees. The system remains at 0.8 inches, keeping the user's legs in an isometric state, until the user applies a force equal or greater than the "SC Trigger" force (right side of control panel) of 206.5 pounds, which corresponds to the lower left corner of the target force band. Once the trigger force is reached, the motor 14 drives the seat 20 toward the "User End Position" at a rate of 35 deg/sec in knee flexion angular velocity (the linear velocity may be continuously updated to maintain the selected angular velocity). According to the present invention, a user force-position indicator, which is referred to herein as a "worm", is shown which indicates the starting position and a force-position history during the repetition. The current position and force are shown at the bottom of the control panel and are graphically depicted as the leading edge of the worm.

Figure 27:
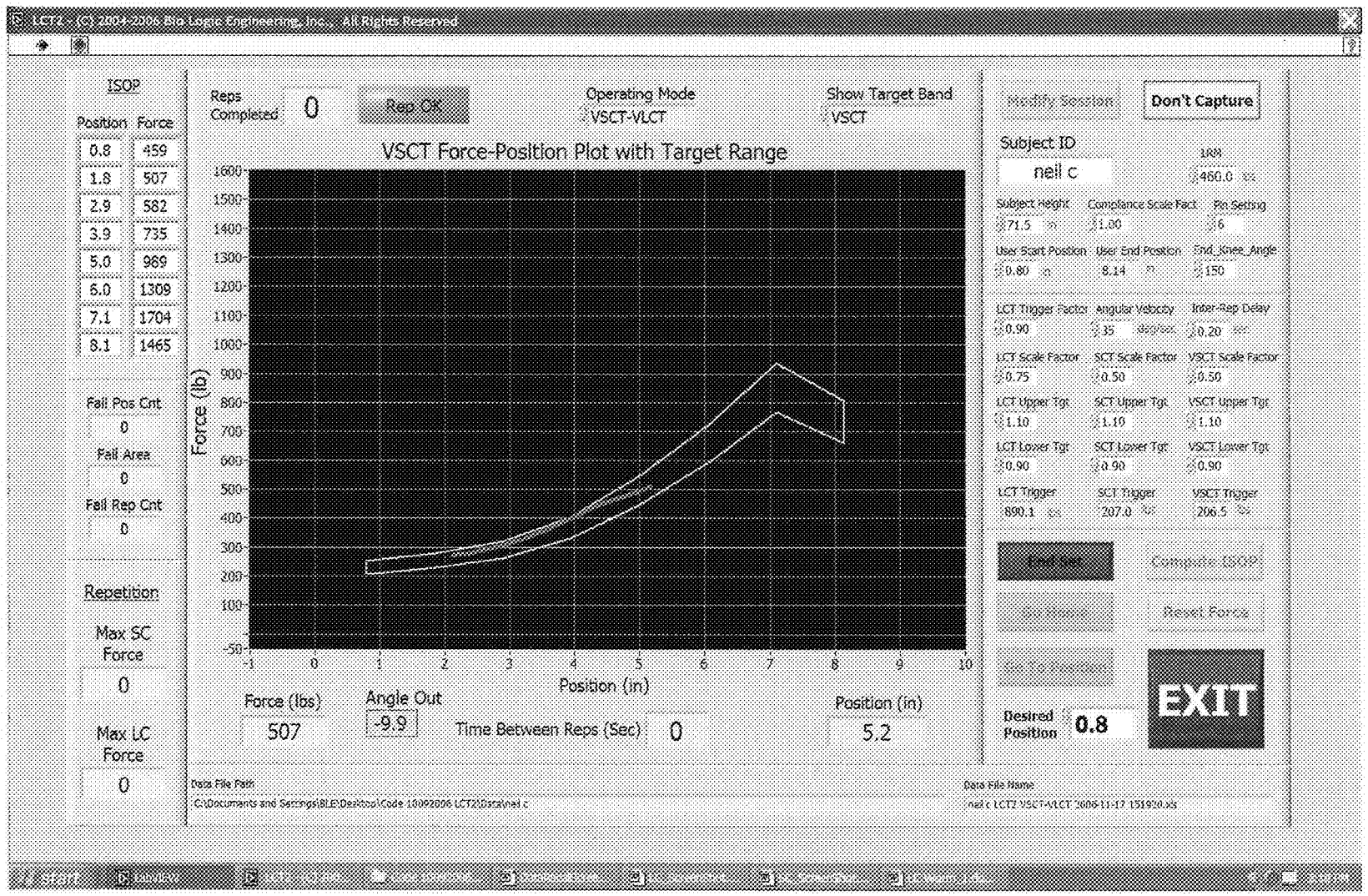
FIG. 27 illustrates a continuation of the VSC phase of the exercise stroke started in FIG. 26.
Figure 28:
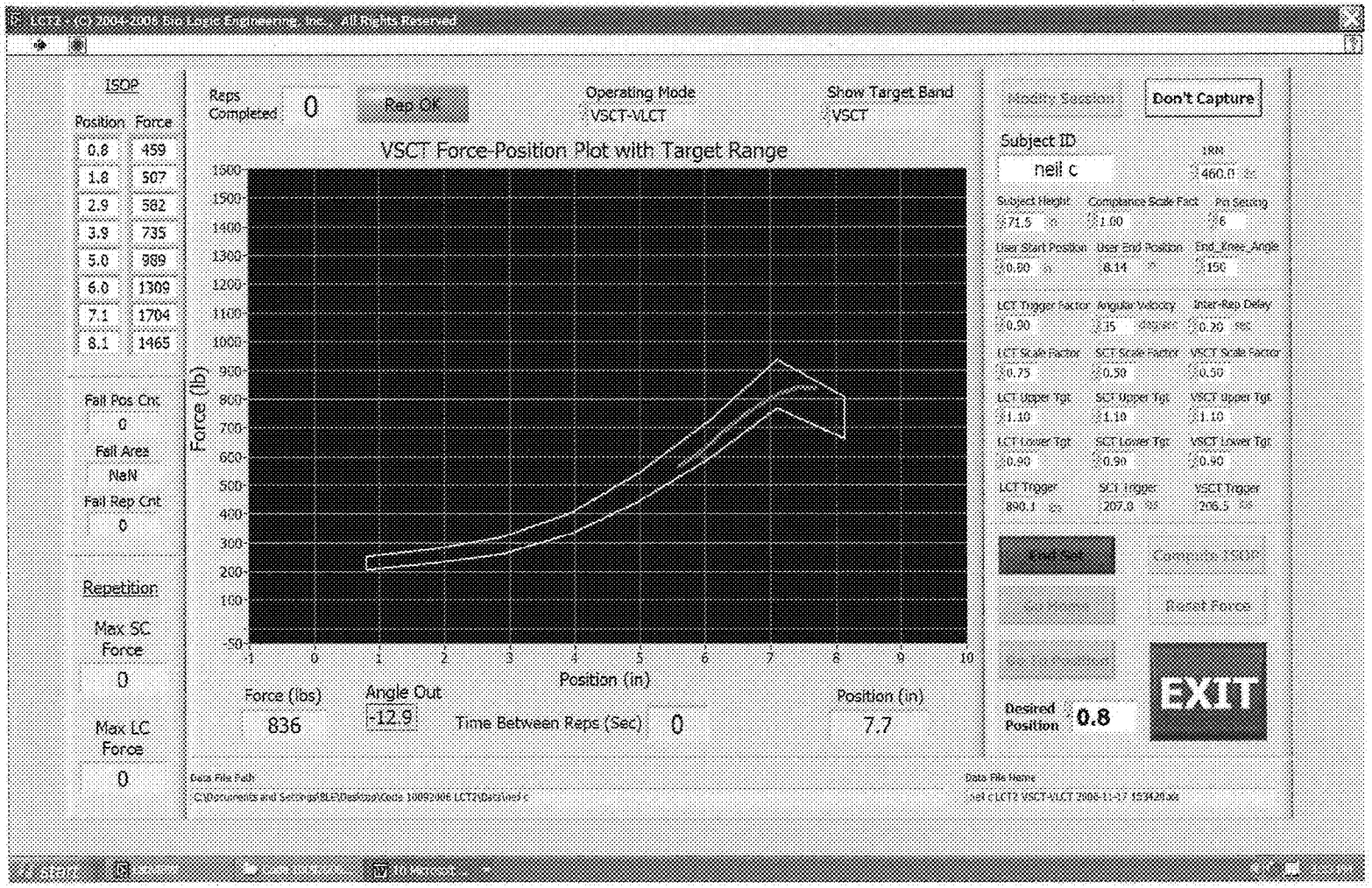
FIG. 28 illustrates a screenshot of the user continuing to track the target within the band and nearing the end of the VSC phase.

FIG. 27 illustrates a continuation of the VSC phase of the exercise stroke started in FIG. 26. The user continues to modulate his effort level to keep the worm within the target boundaries as the motor 14 drives outward. The force feedback worm stretches to show a brief history of the user's force-position performance. The leading edge of the worm provides the current force and position, which in this instance are 507 lbs. and 5.2 inches, respectively. FIG. 28 illustrates a screenshot of the user continuing to track within the target band and nearing the end of the VSC phase. At the end of the VSC phase of the repetition, the motor 14 will stop moving and the system 10 will then display the VLC phase target force band.

Figure 29:
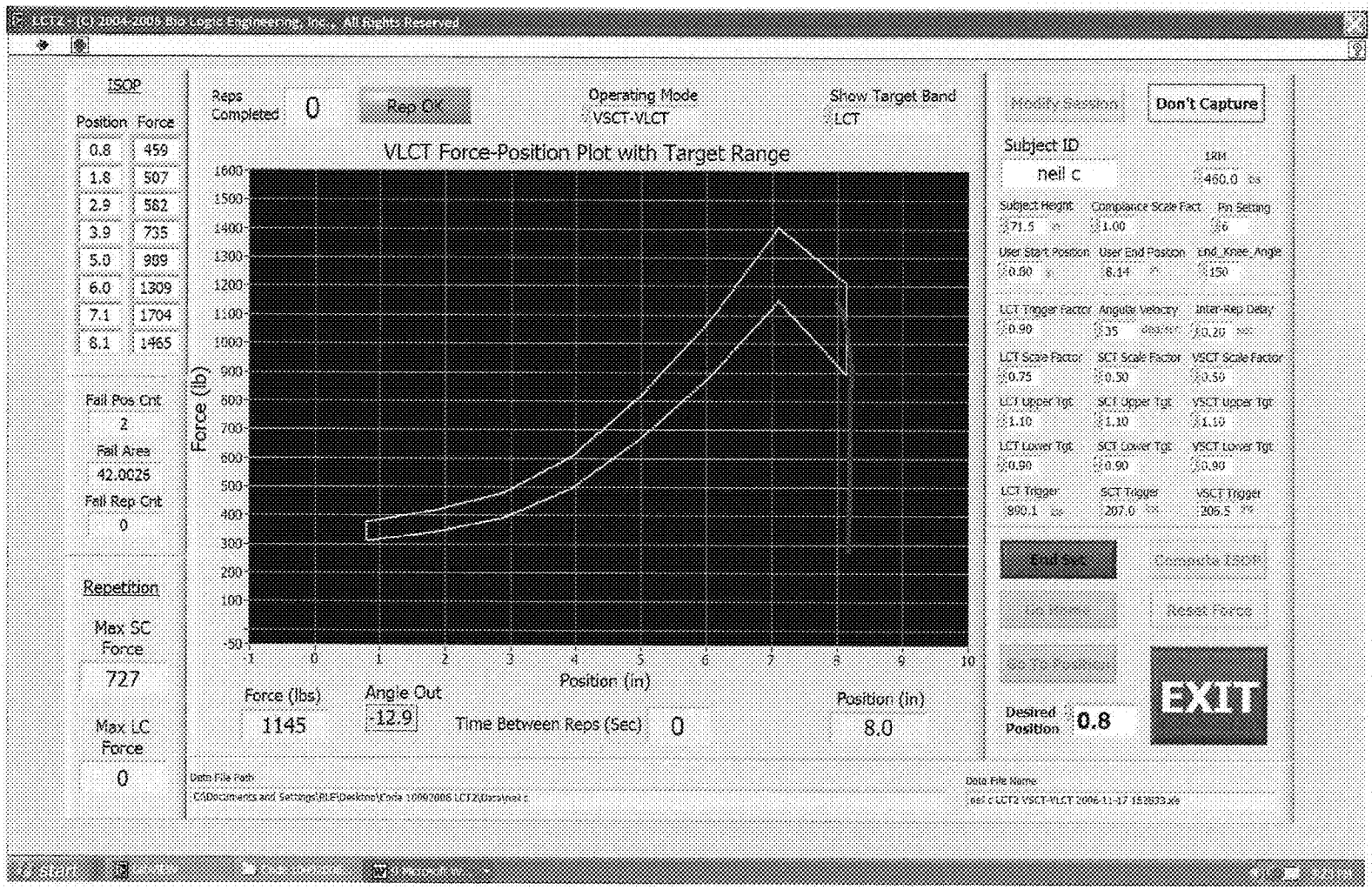
FIG. 29 is a screenshot showing initiation of the VLC phase of the training stroke with an elevated VLC target band.

FIG. 29 is a screenshot showing initiation of the VLC phase of the training stroke with the VLC target band elevated with respect to the VSC target band. In this example, the worm shows that the user lowered his force output to approximately 275 lbs. or less before pressing hard to raise the force level to initiate the return VLC stroke. Similar to the initiation of the VSC stroke, the system remains stationary at the end position of the VSC stroke (8.14 in.), keeping the user's legs in an isometric state, until the user-applied force is equal to or greater than the "LC Trigger" force. This force can be seen on the right side of the control panel (e.g., 890.1 pounds), and corresponds to the lower right corner of the target force band. There may also be a built-in adjustable time delay whereby a predetermined time interval must elapse between the completion of the VSC stroke and the initiation of the VLC stroke. This parameter is called the "Inter-Rep Delay" which, in this example, is set to 0.20 sec. The delay may also be used in the transition from the VLC phase to the VSC phase of the subsequent repetition. Once the trigger force is reached and the delay time has elapsed, the motor 14 may begin driving the seat 20 toward the "User Start Position" and, correspondingly, the worm on the graphical display rises vertically to the trigger force level and begins to move to the left. The worm may be configured to change color from the VSC phase to the VLC phase.

In the screenshot of FIG. 29, the current force is 1145 pounds at a position of 8.0 in., which is approximately equivalent to a 150 degree knee flexion angle. In the lower left corner of the control panel, the maximum force reached in the most recently completed VSC and VLC strokes may be displayed. In this case, the user reached 727 pounds of VSC force during the first repetition. Since the VLC phase is still in progress and this is the first repetition, a 0 pound force is still displayed for the Max LC Force.

Figure 30:
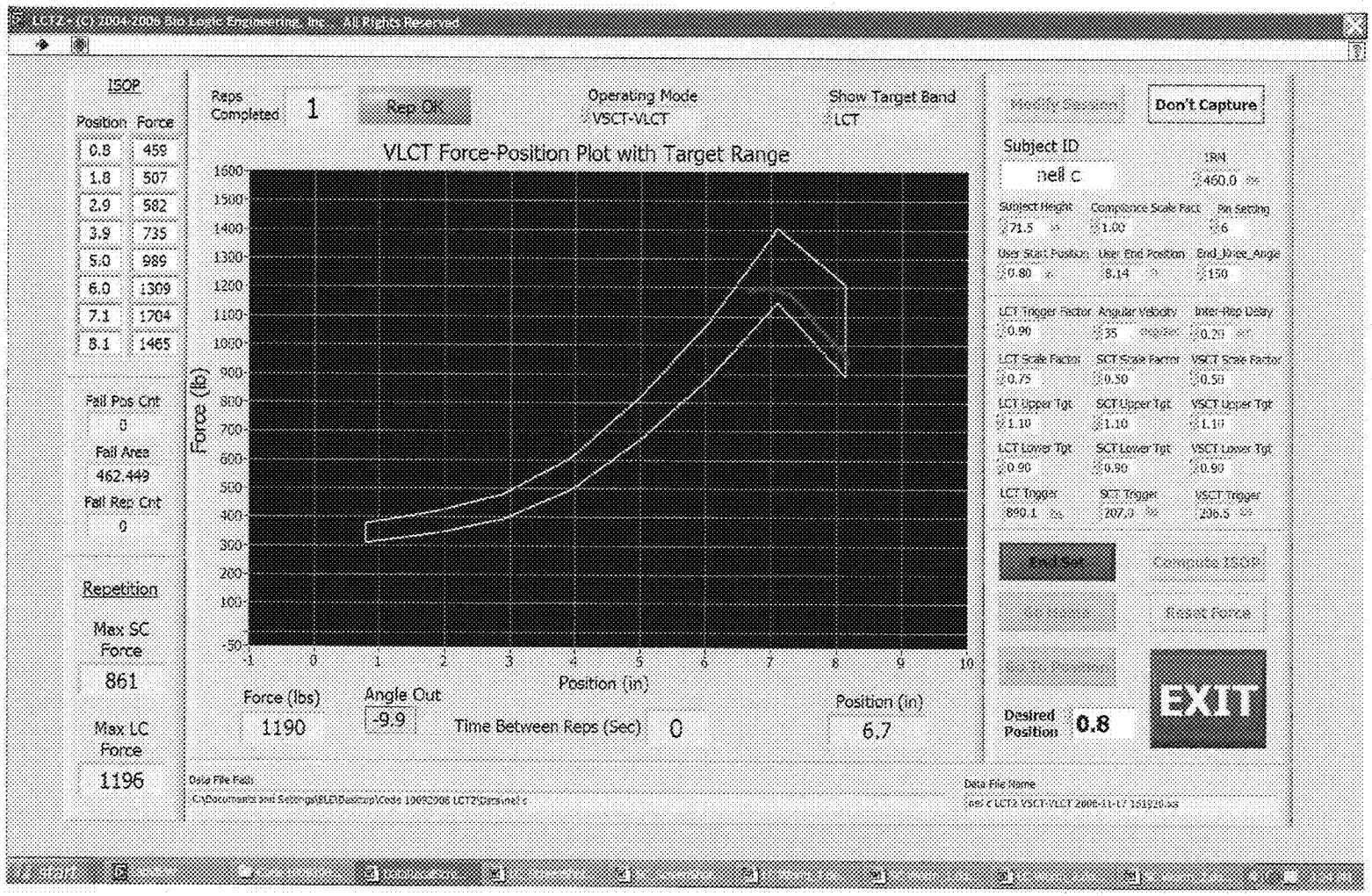
FIG. 30 illustrates the continuation of the VLC phase of the exercise stroke started in FIG. 29.
Figure 31:
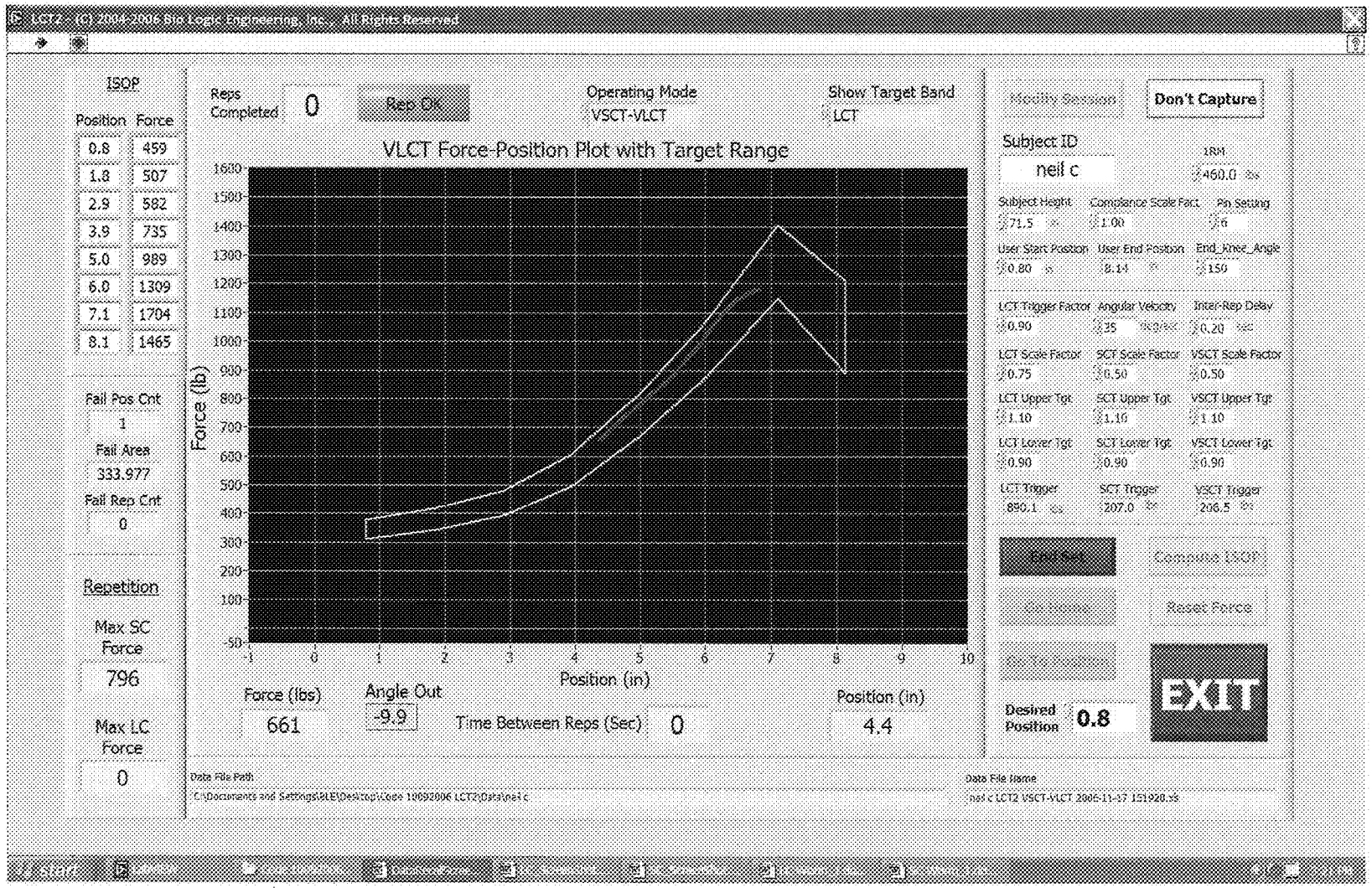
FIG. 31 illustrates a further continuation of the VLC phase from FIG. 30.
Figure 32:
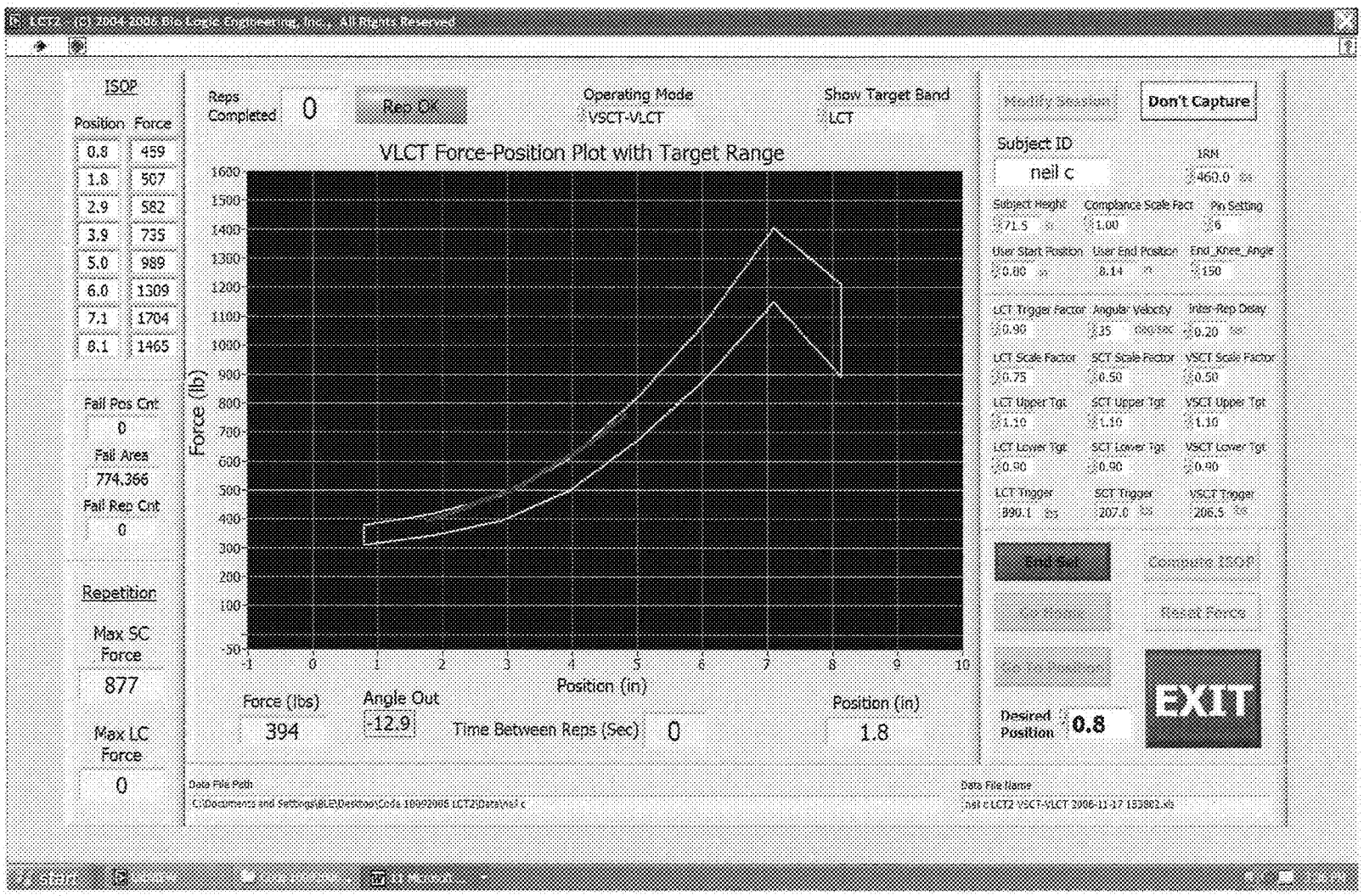
FIG. 32 illustrates a continuation of the VLC phase with the end of the VLC phase approaching.

FIG. 30 illustrates the continuation of the VLC phase of the exercise stroke started in FIG. 29. The user continues to modulate his effort level to keep the worm within the target boundaries as the motor 14 drives inward. FIGS. 31 and 32 illustrate further continuation of the VLC phase from FIG. 30.

Figure 33:
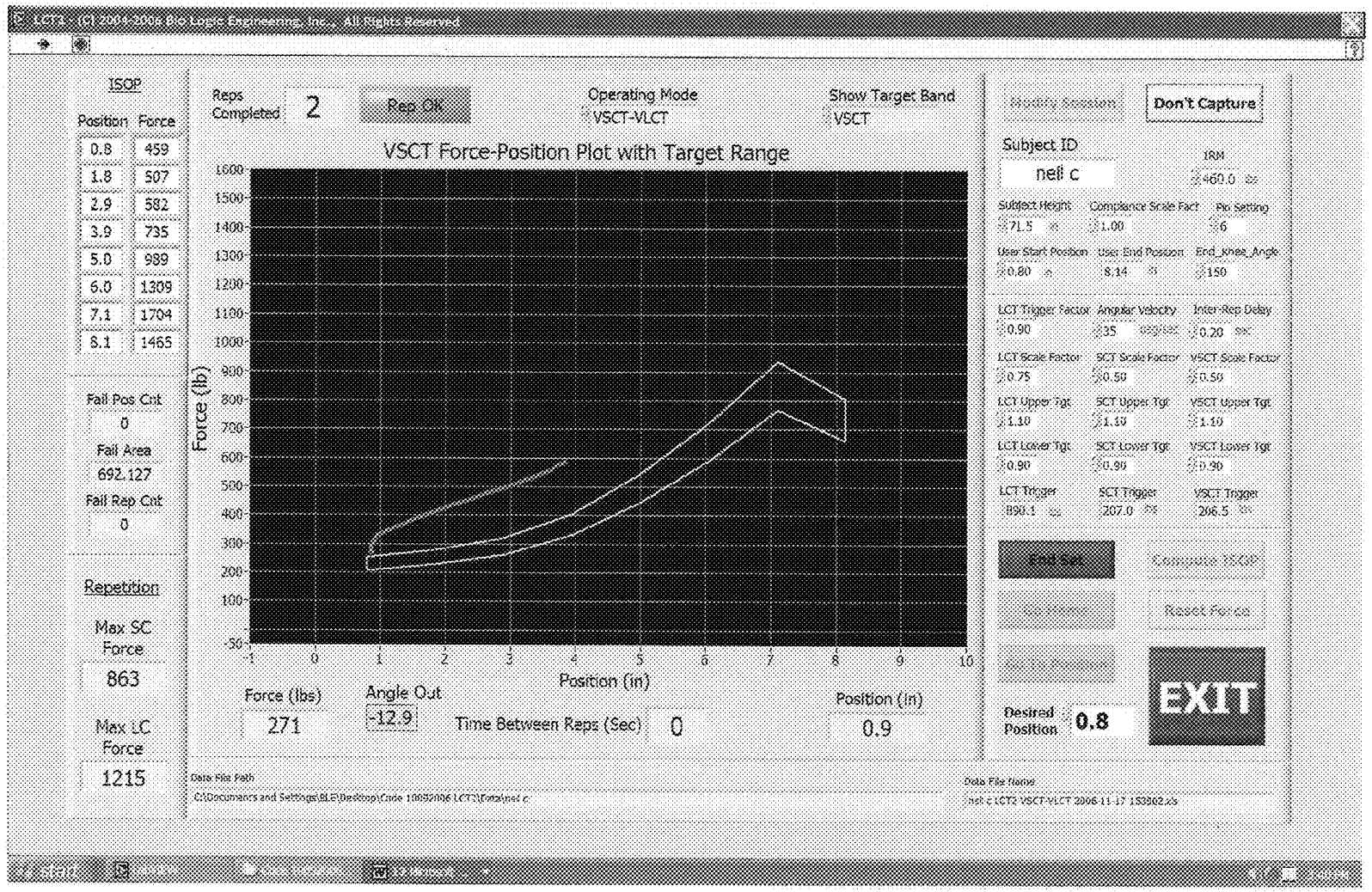
FIG. 33 is a screenshot displaying the transition from the VLC phase of one repetition to the initiation of the VSC phase of the subsequent stroke.

FIG. 33 is a screenshot displaying the transition from the VLC phase of Rep 2 to the initiation of the VSC phase of the subsequent stroke, Rep 3. The VSC target band is now displayed, and the worm shows the performance history during the latter portion of the previous VLC stroke (moving right to left) and the initiation of the VSC stroke. The display in the lower left corner of the control panel shows the max VSC and VLC forces for the second rep (the previously completed rep).

Various logic algorithms may be implemented to control the transition between the VSC and VLC phases in each direction. The above example is simply one possibility. The control logic may optionally employ the Inter-Rep Delay which can be set to most any time duration. The force triggers that begin motor movement are typically set at the lower limit of the target force band, but can be set to any force level that is within the user's force generating capacity at these positions. When the beginning or ending stroke position is reached and the motor 14 is holding the user's legs in an isometric state, it may also be possible to require that the force drops below a certain level and then rise above a set force threshold before initiating movement. This behavior may be referred to as "Bounce" and control buttons, as shown in the lower right quadrant of FIGS. 41-46, may be provided to activate or deactivate this behavior for one or both of the VLC-to-VSC and VSC-to-VLC transitions. This may be of particular significance for the transition from VLC to VSC movements where the end VLC force is typically higher than the VSC trigger force. Other logic algorithms may be implemented to suit the user's needs.

The system 10 according to the present invention may include an isovelocity mode, which provides a constant angular or linear velocity, or a variable velocity mode. In the variable velocity mode, velocity may be programmed to vary within a single rep, vary from rep to rep, vary from set to set, or vary between the VSC phase and the VLC phase. These parameters can be modified by the user. In addition, the system may include a multi-position isometric exercise mode and a constant force mode, wherein velocity is modulated to achieve a constant force.

The system 10 can also be set up to perform "calf-raises" whereby the user trains his/her plantarflexor muscles in either or both VSC and VLC phases. The natural state of use for the machine employs plantarflexor activity, but the focus could be set to the ROM of the plantarflexors.

The user can perform as many reps and sets as he or she desires, and is capable of completing. Special programs may be employed to step the user through different programmed sets with different target bands for each set or repetition. Pyramid schemes can be used. In addition, the time between sets can be programmed with alarms, signaling the user to start the next set.

The system software may reject a rep as a "Failed Rep" if the user's effort does not meet or exceed specified force-position criteria across the ROM. If the effort meets or exceeds the criteria, a "Rep OK" indicator may be activated and the rep counted. If the effort is too low, the "Failed Rep" indicator may be activated and the rep not counted as a successful rep but as a failed rep. One possible method for determining the success of a rep is to require that both the SC and LC phases satisfy the following criteria: (1) the area under the user's force curve exceed the area under the lower boundary of the target band, and (2) the force generated does not fall below the lower boundary of the target band for more than a pre-specified percentage (i.e., 25%) of the ROM. Again, possibilities for determining "success" are numerous.

Any shaped curve may replace the ISOP as long as the target band falls within the user's physical capabilities. Personalized curves based on a user's strength profile, generic curves derived from a population sample, arbitrary curves designed to achieve a desired training effect, sinusoidal, constant force, linear ramp, triangular, and other shapes of curves are all possible. Different target band shapes can be used for the VSC and VLC target bands. A VSC-only scheme may be implemented whereby the VLC return phase requires no force generation to initiate movement. A VLC-only scheme may be implemented whereby the VSC outgoing phase requires no force generation to initiate movement. On the control panel, both target bands may be displayed simultaneously, or a loop target band through the VSC and VLC phases may be displayed and employed. The system may also be used as a passive ROM system—flexing and extending the ankles, knees and hips while the user's leg muscles remain passive.

The following screenshots show three examples of the many possible methods for determining the ISOP for use in the target band generation.

Figure 34:
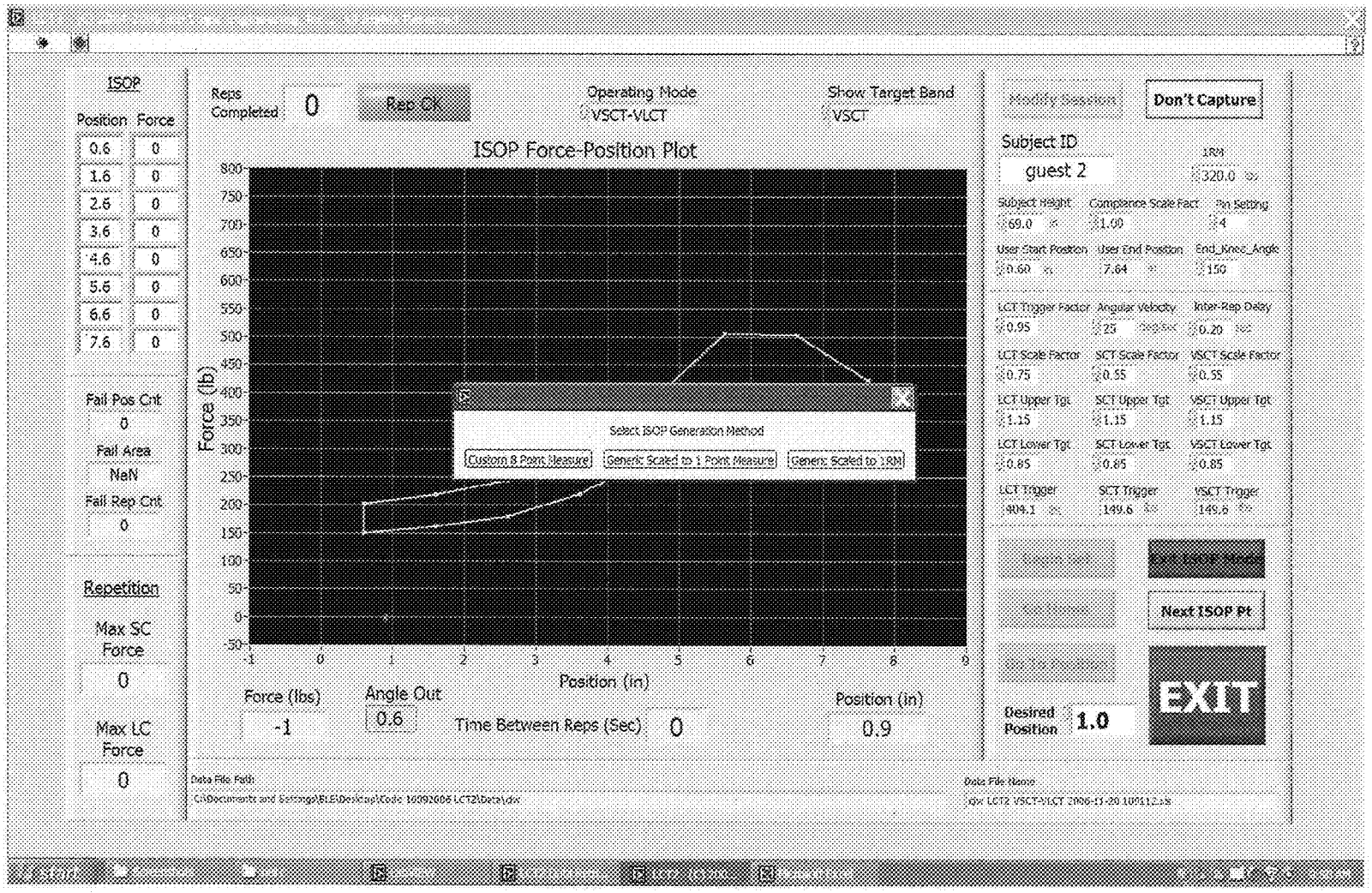
FIG. 34 is a screenshot showing the system control panel after selecting the "Compute ISOP" button.

FIG. 34 is a screenshot showing the control panel after selecting the "Compute ISOP" button. Three options are offered to the user for methods to generate an ISOP. These options are a few of many possibilities, and the present invention is not limited to the methods described herein. The three options described are 1) Custom 8-Point Measure, 2) Generic Scaled to 1 Point Measure, and 3) Generic Scaled to 1RM. Each of these options is discussed below.

Figure 35:
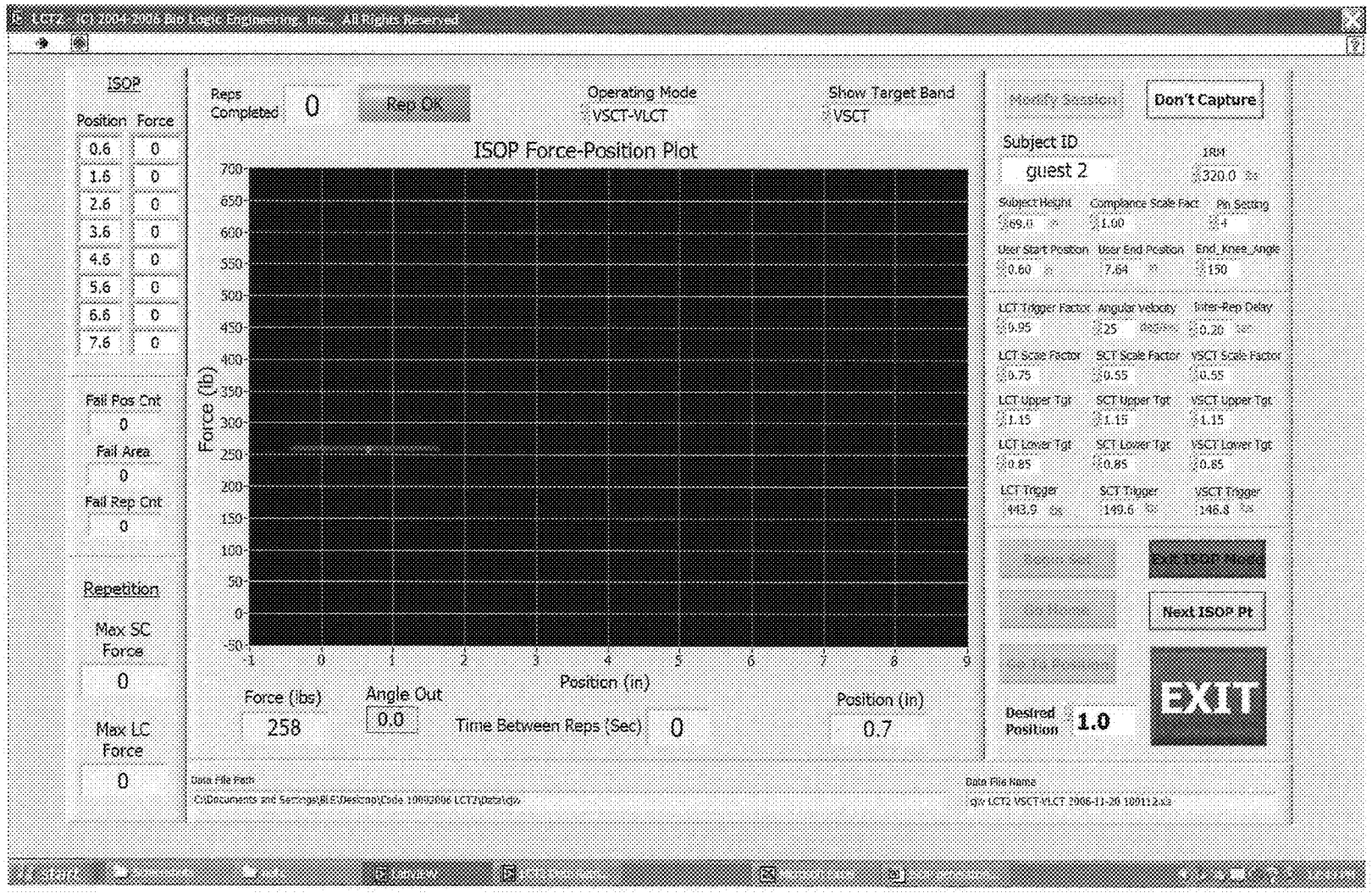
FIG. 35 is a screenshot showing the first of several discrete, distributed isometric profile (ISOP) points to be measured across the ROM.

The custom 8-Point Measure is a method wherein an ISOP curve may be created by measuring a user's isometric strength at eight points across the user's ROM, which may be equally-distributed. FIG. 35 is a screenshot of the control panel showing the force and position information for the first of the eight points. For the first point, the motor 14 drives the user seat 20 to the starting position and holds the user there to perform a maximum isometric contraction. The user presses as hard as he/she can while viewing the real-time force feedback worm which appears as a dot in the screenshot. The system captures and displays the highest force achieved at this position and displays it a horizontal line termed the "high force mark". The user may make as one or more attempts to achieve his/her maximum force and thereby raise the high force mark. When satisfied, the user can select the "Next ISOP Pt" button to move to the next position and repeat the process. The first maximum isometric force point may be captured and stored.

Figure 36:
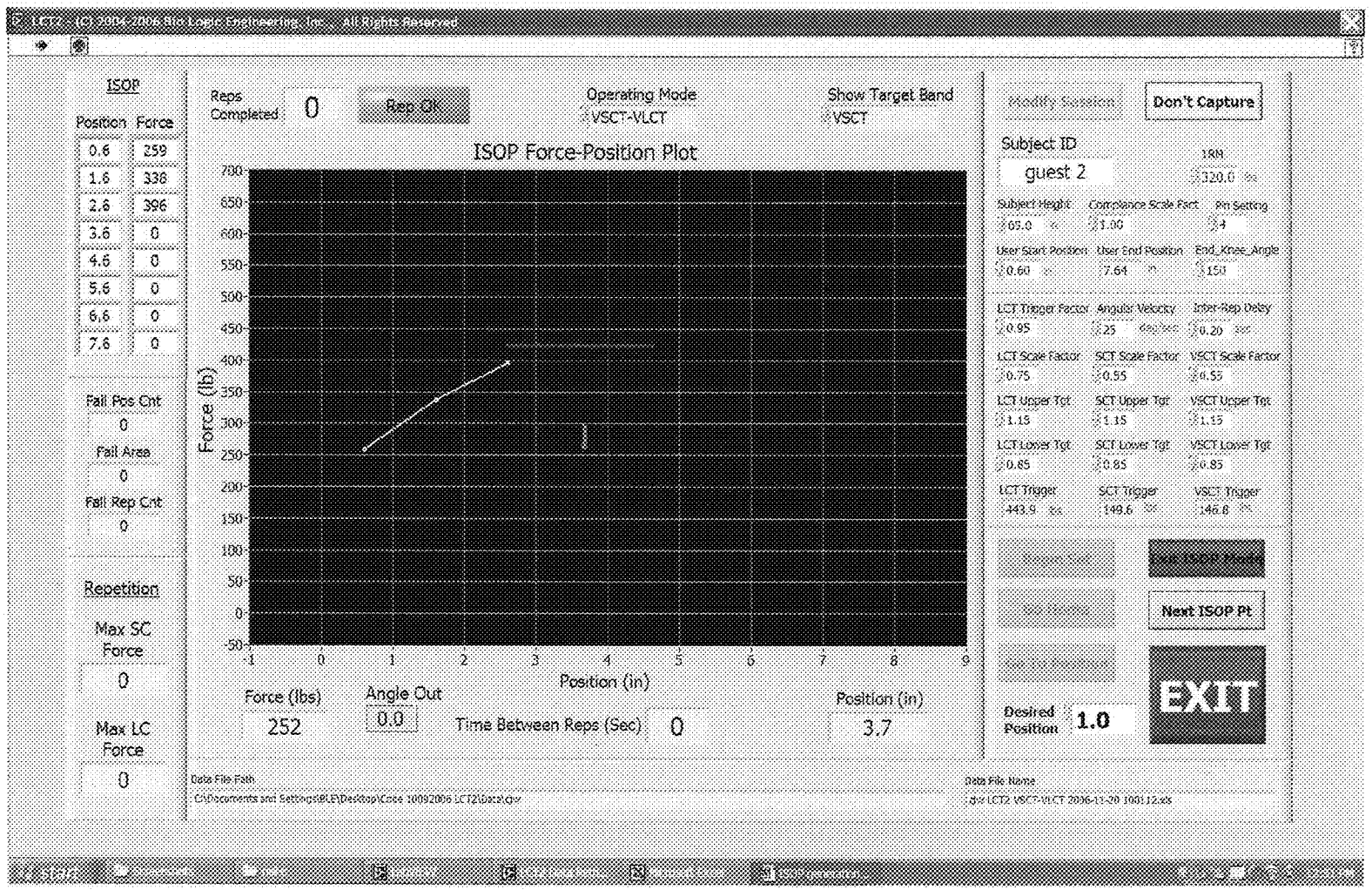
FIG. 36 is a screenshot showing capture of the fourth ISOP point.

FIG. 36 is a screenshot showing capture of the fourth ISOP point. Numerical displays of the first three points are shown in the upper left corner of the control panel. A graphical display of the first three points is shown on the force-position plot. The high force level for the fourth measure is shown as a horizontal line, with the current force feedback provided via the worm.

Figure 37:
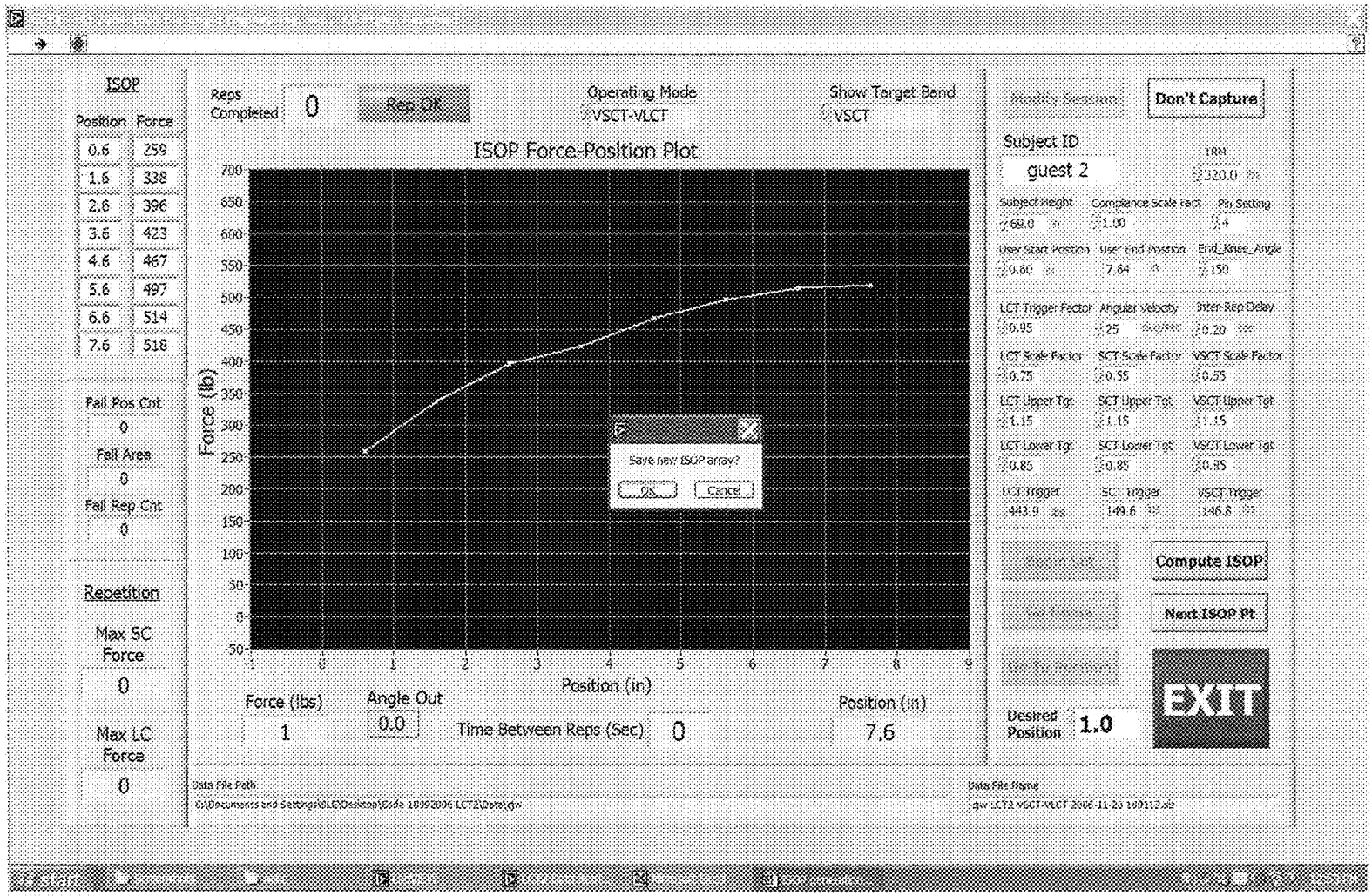
FIG. 37 is a screenshot showing the completed ISOP.

After obtaining the eighth ISOP point, a screen such as the one in FIG. 37 is displayed. The newly measured ISOP is displayed and the user is given the opportunity to select "OK" to save the ISOP in a user-specific, time-stamped custom file for future use, or "Cancel" to revert to the previously saved ISOP.

Figure 38:
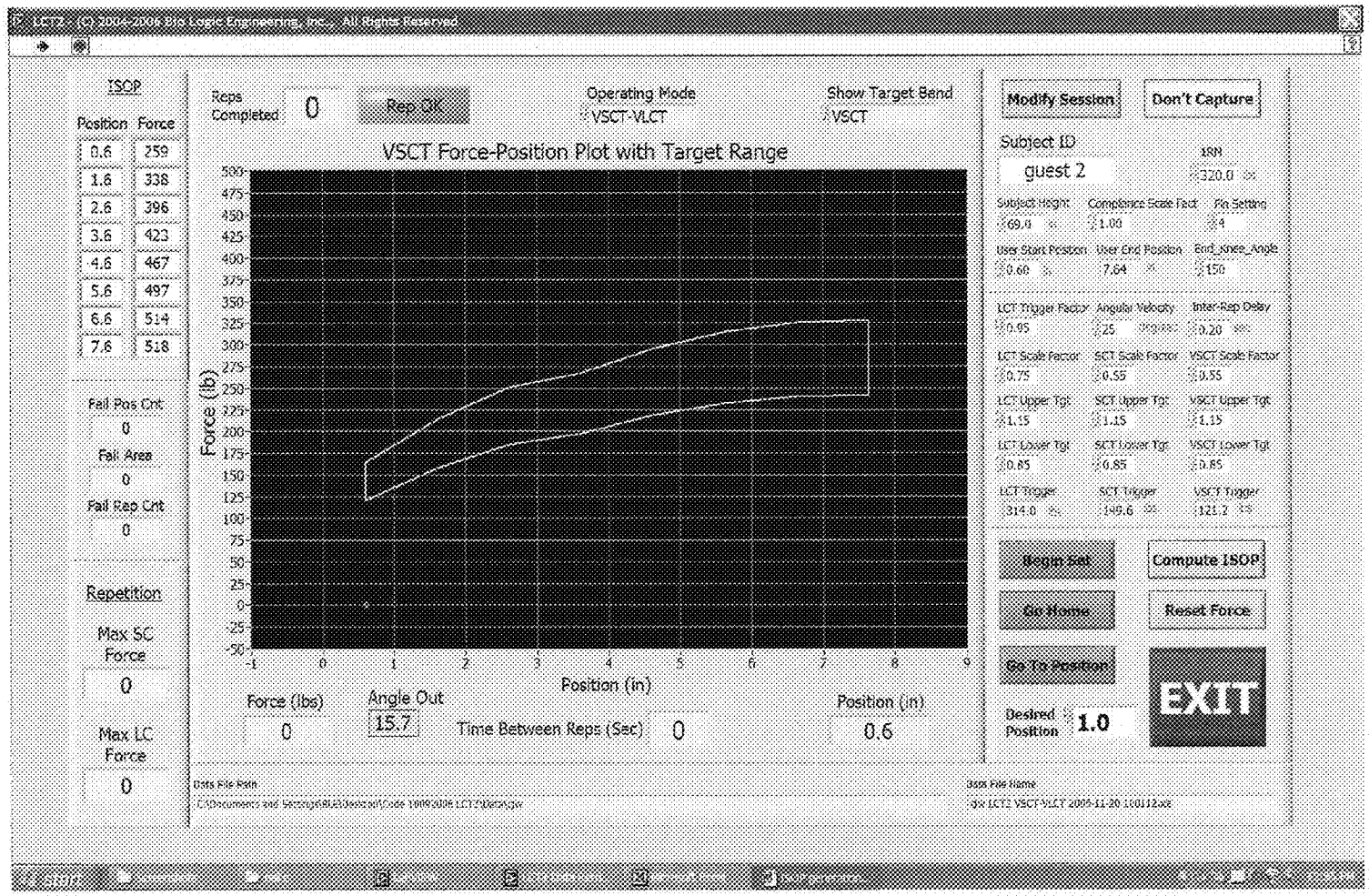
FIG. 38 is a screenshot showing the VSC target band with the center scaled to 75% of the ISOP force of FIG. 37 and ±15% upper and lower boundaries.

FIG. 38 is a screenshot of the VSC target band resulting from the 8-Point ISOP measure. The center is scaled to 75% of the ISOP force and the target band upper and lower boundaries are offset by ±15%.

Figure 39:
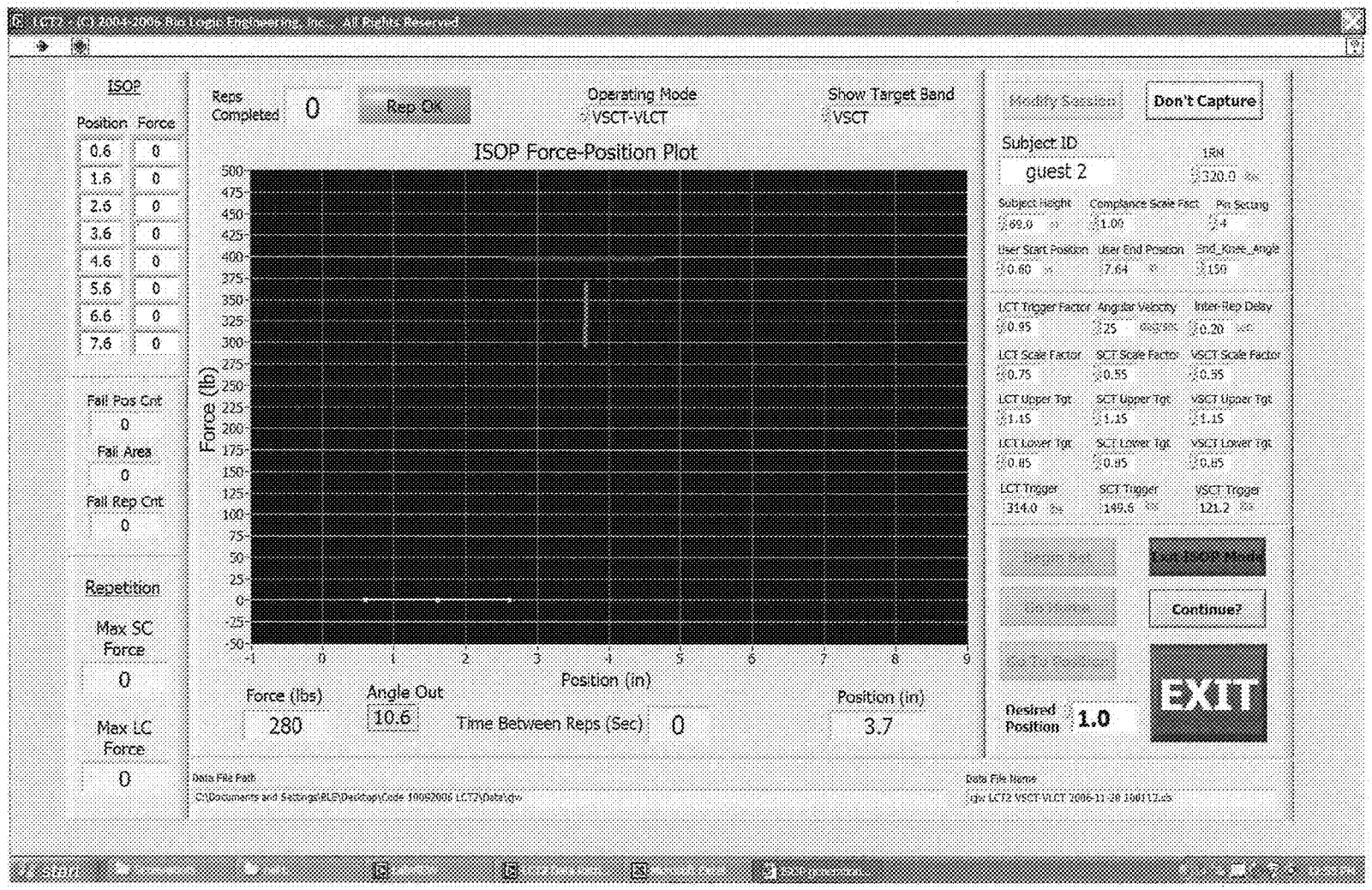
FIG. 39 is a screenshot illustrating a method of scaling a generic shaped curve to a single point measure.

FIG. 39 depicts a method of scaling a "generically" shaped curve obtained, for example, by characterizing the ISOPs of many individuals, to a single point measure. In this case, the measure is obtained near the center of the user's ROM. Selecting the "Generic Scaled to 1 Point Measure" option shown in FIG. 34 causes the motor 14 to drive the user seat 20 to the center of the ROM where the user is to perform a maximum isometric contraction. When satisfied with his/her performance, the user may select "Continue?" to complete the process. If he/she chooses to save the new ISOP, the magnitude and ROM of the generic ISOP shape may be scaled to the one point measure and the user's custom ROM, respectively. The new ISOP may be saved for future use.

Figure 40:
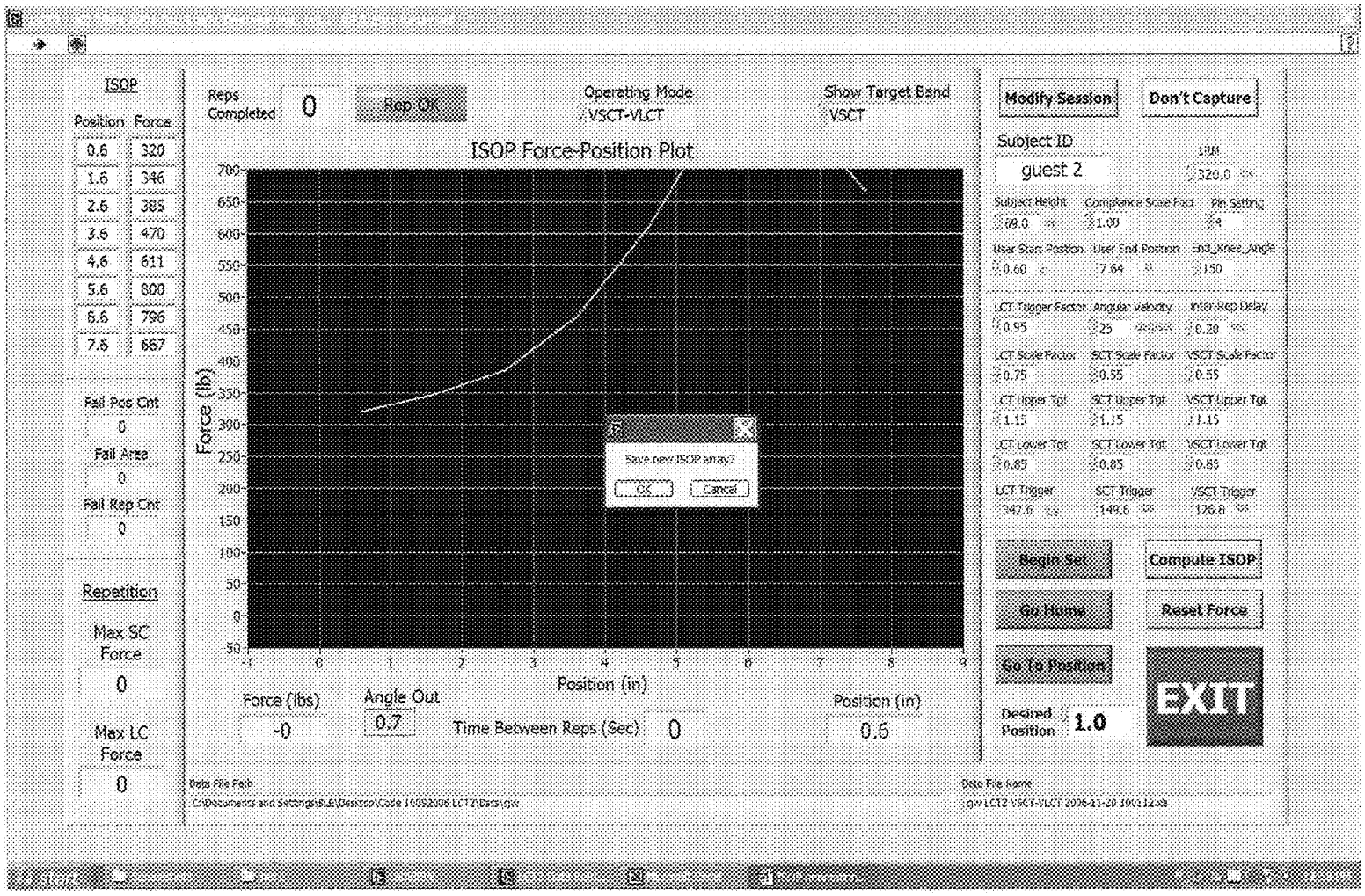
FIG. 40 is a screenshot illustrating a method of scaling a generic shaped curve to a single point entered manually.

FIG. 40 shows a method of scaling a "generically" shaped curve to a single point entered manually via a keyboard numeric entry or by selecting up and down arrows to select a higher or lower value, respectively. In this example, the "generic" curve may be scaled to the user's 1-RM for traditional weights. A dialog box may be displayed for the user to select whether to save or reject the new ISOP curve.

Another method for obtaining the shape of the training target band is for the user to perform a maximum or submaximum dynamic VSC stroke. The force-position data may be stored and a representative curve generated for the corresponding training target band. This process could be applied to the VLC phase as well. These measures may be performed at any pre-selected constant or variable-velocity across the ROM.

The following description and figures relate to one of many possible methods for obtaining the shape of the training band, using the VSC phase as an example. The series of screenshots in FIGS. 41-46 is provided to describe a "Capture SCP" procedure, where SCP stands for "Shortening Contraction Profile". Selection of the "Capture SCP" button (FIG. 41) enables the capture of a user's sub-maximum or maximum VSC force profile across the user's ROM using a unique triggering protocol. Once captured, the system stores the profile for future recall with the option to use an SCP as the basis for the training band. Of course, a user's sub-maximum or maximum VLC force profile could alternatively be utilized.

Figure 41:
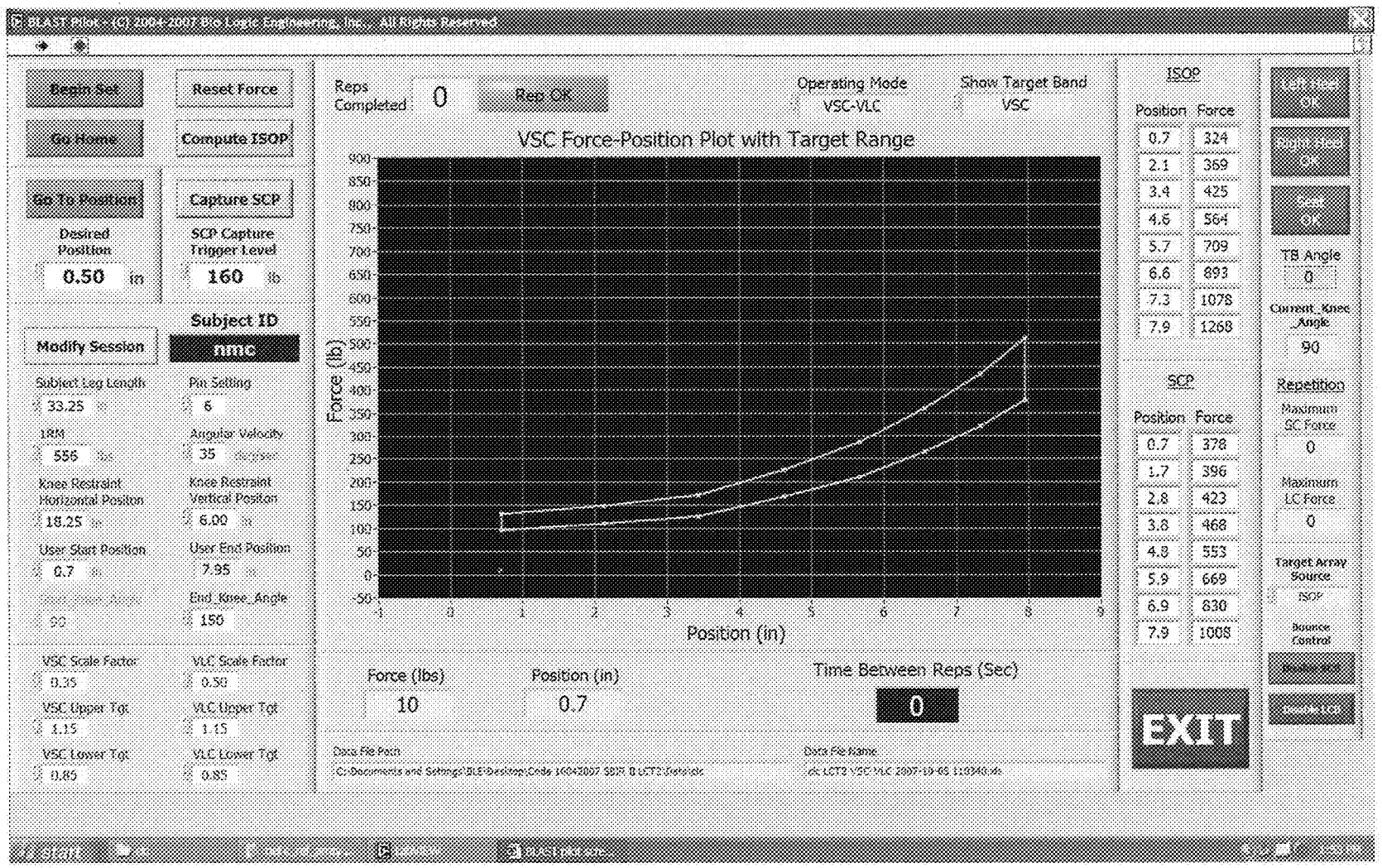
FIG. 41 is a screen shot illustrating a method of capturing a shortening contraction profile (SCP) via the selection of the "Capture SCP" button located in the upper left quadrant of the control panel.
Figure 42:
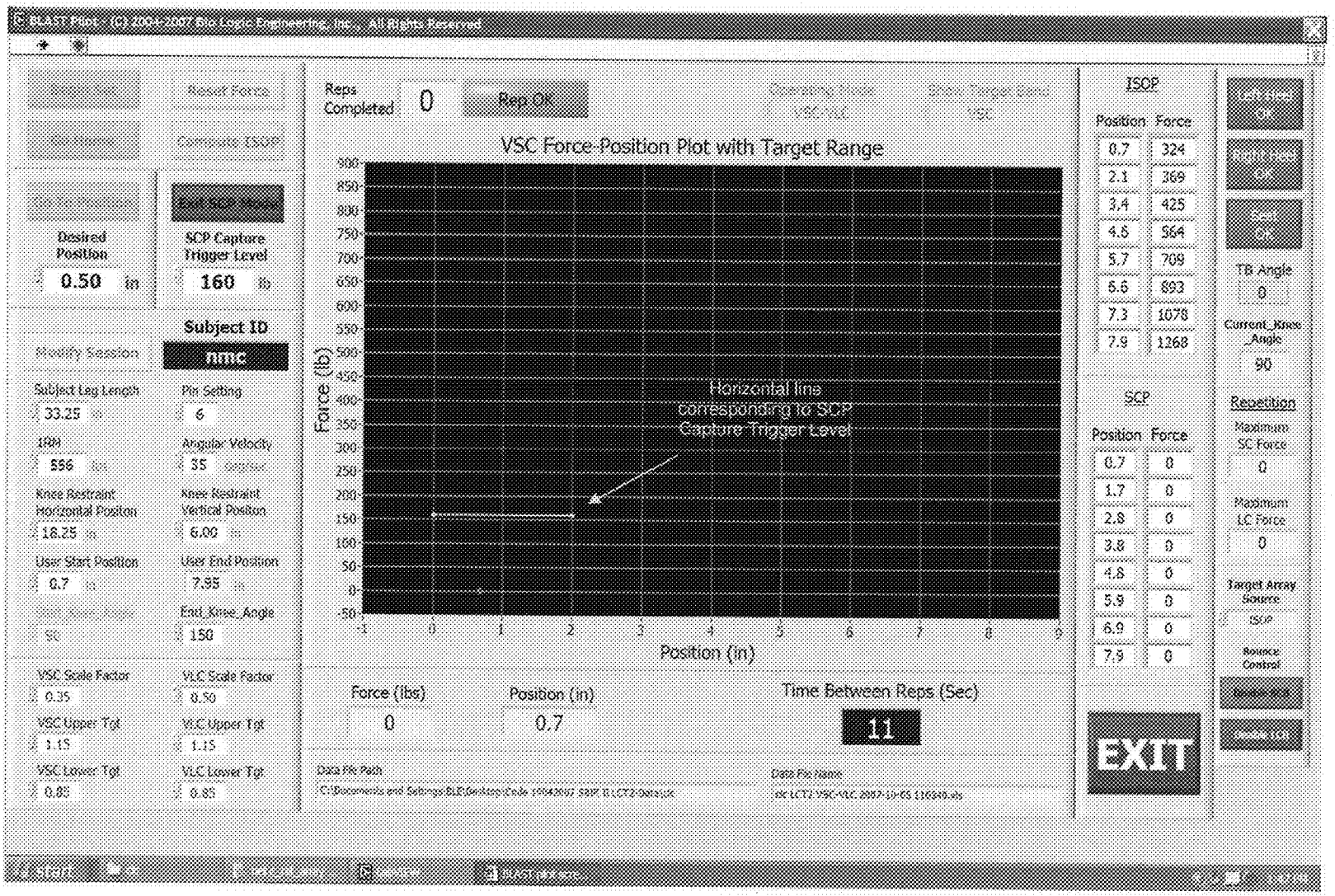
FIG. 42 is a screen shot illustrating a horizontal line drawn on the force-position plot indicating the SCP Capture Trigger Level.
Figure 43:
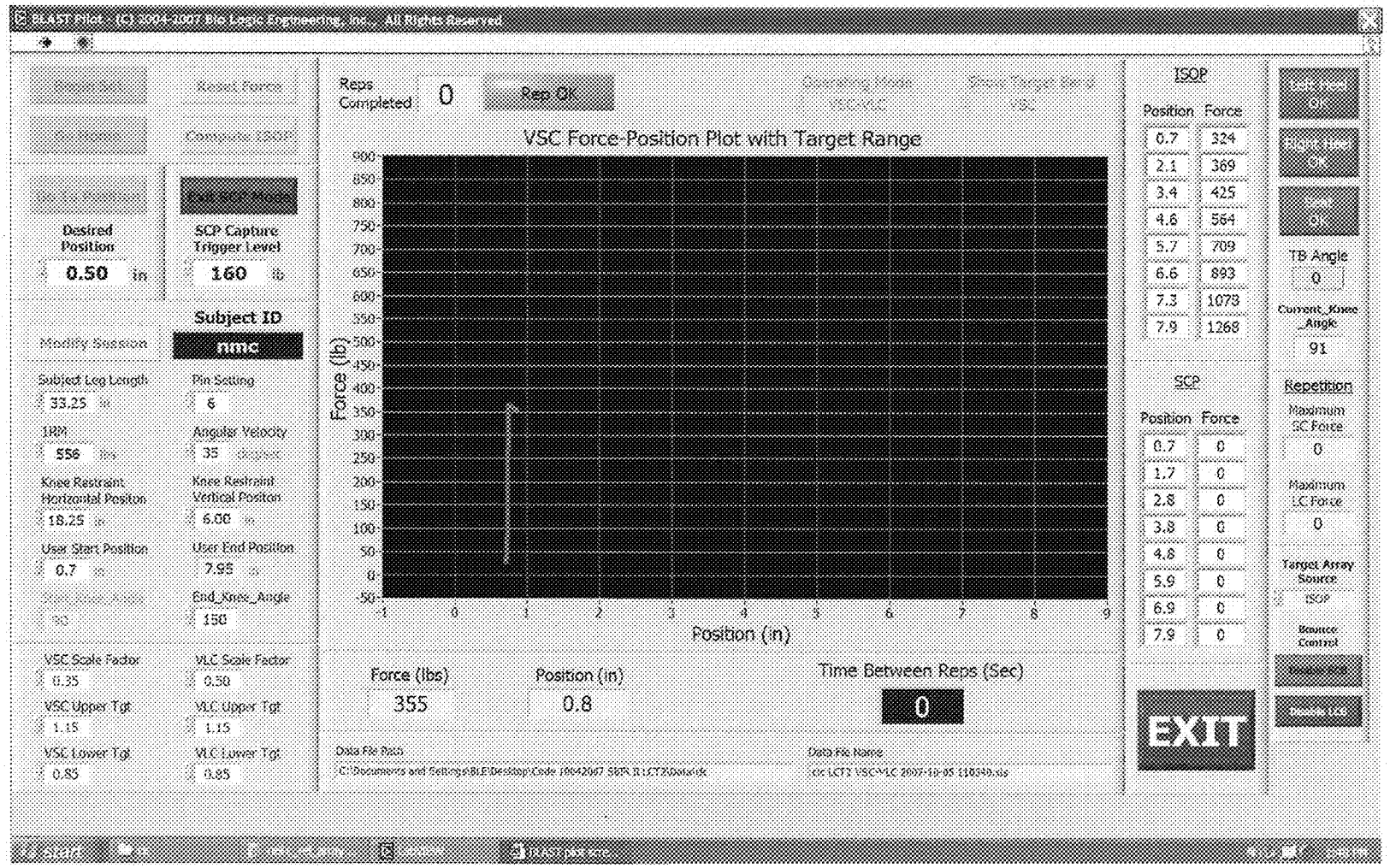
FIG. 43 is a screenshot obtained during SCP capture after the "SCP Capture Trigger Level" has been exceeded and just as the rate of force increase has fallen below a predefined level which, in turn, has triggered the motor to begin movement.
Figure 44:
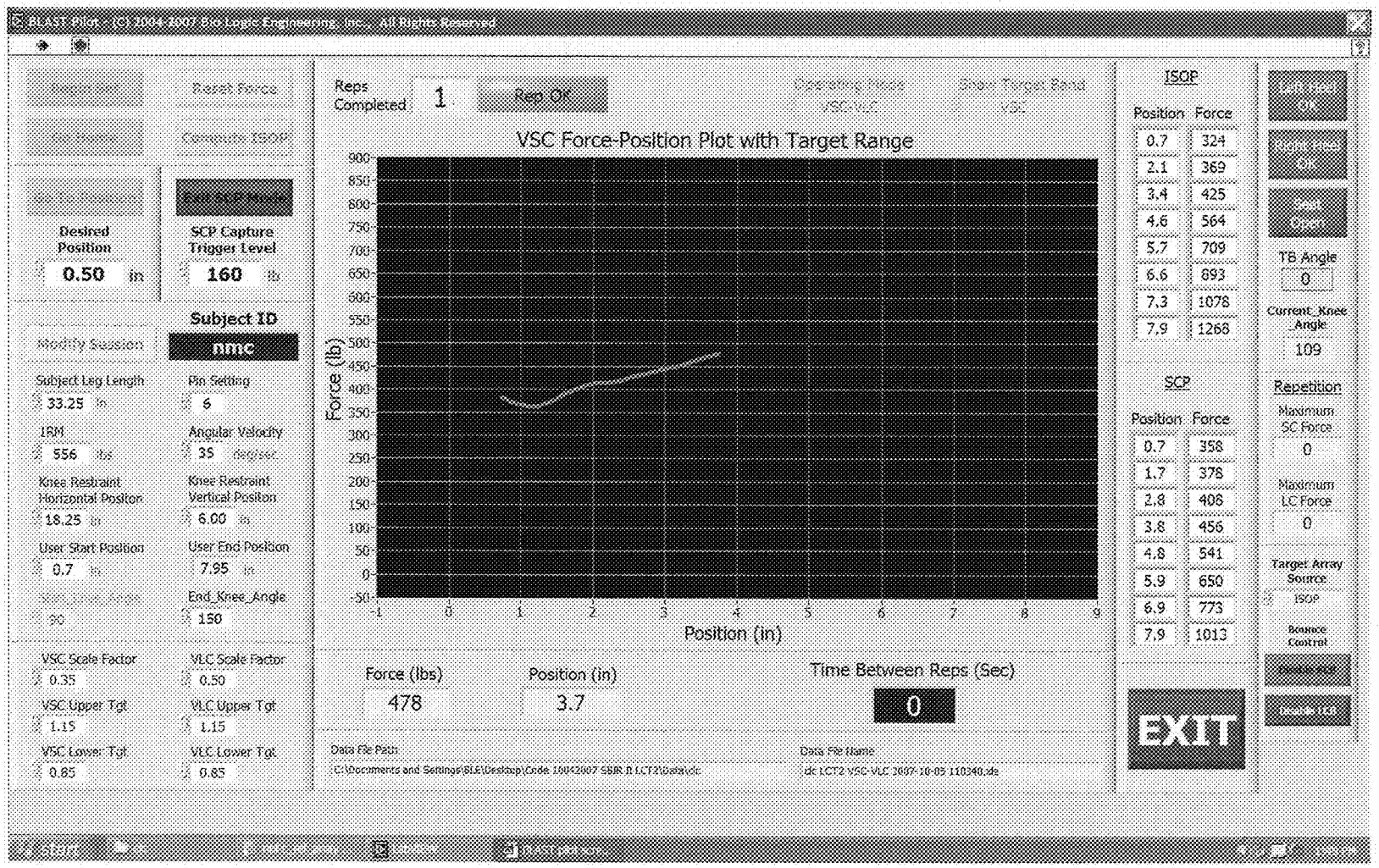
FIG. 44 is a screenshot illustrating the middle of an SCP capture.

After the "Capture SCP" button is selected, the button may change color and read "Exit SCP Mode" which allows the user to escape from the mode if desired (FIG. 41). The motor 14 drives the seat 20 to the "User Start Position", which in this case is 0.7 in. The system remains at 0.7 in., keeping the user's legs in an isometric state until the user triggers the motor 14 to drive the seat 20 toward the "User End Position" at a pre-selected rate of, in this case, 35 deg/sec in knee flexion angular velocity. Triggering motor movement may effectively be a two-stage event. First, the user may signal his/her readiness by generating enough isometric force to exceed the "SCP Capture Level". A horizontal line may be drawn at the SCP Capture Level on the force feedback plot to provide the user with a visual reference for the trigger level (FIG. 42). The trigger level enables the user to adjust his/her position and prepare for the SCP Capture without inadvertently triggering the capture process before he/she is ready. The second stage of the triggering process comes after the SCP Capture Level has been reached. The motor 14 continues to hold the user's legs in an isometric state as the force continues to rise above the force trigger threshold (FIG. 43). The motor 14 will hold position until the rate of increase of the isometric force falls below a predefined and fixed rate. Once the rate of force rise falls below the predefined threshold, the motor 14 drives the seat 20 toward the "User End Position" at the specified knee flexion angular velocity (FIG. 44). In the current example, the "SCP Capture Level" defaults to 160 lbs. The user can adjust this level simply by changing the value entered in the "SCP Capture Level" field.

Figure 45:
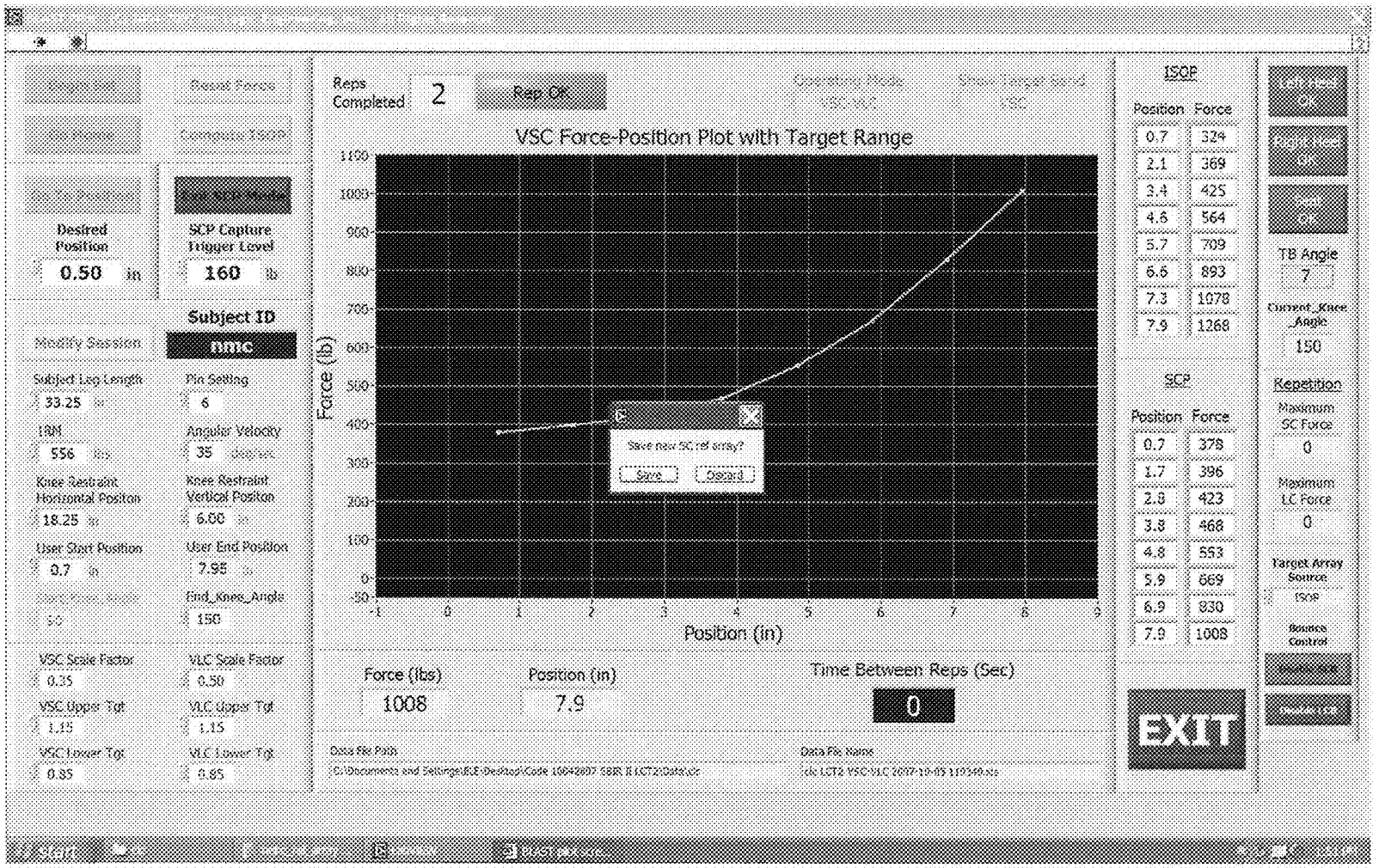
FIG. 45 is a screenshot illustrating a newly acquired SCP both graphically and numerically as an 8 point array (in the lower right quadrant of the control panel) as well as a popup providing the option to save or discard the SCP capture.
Figure 46:
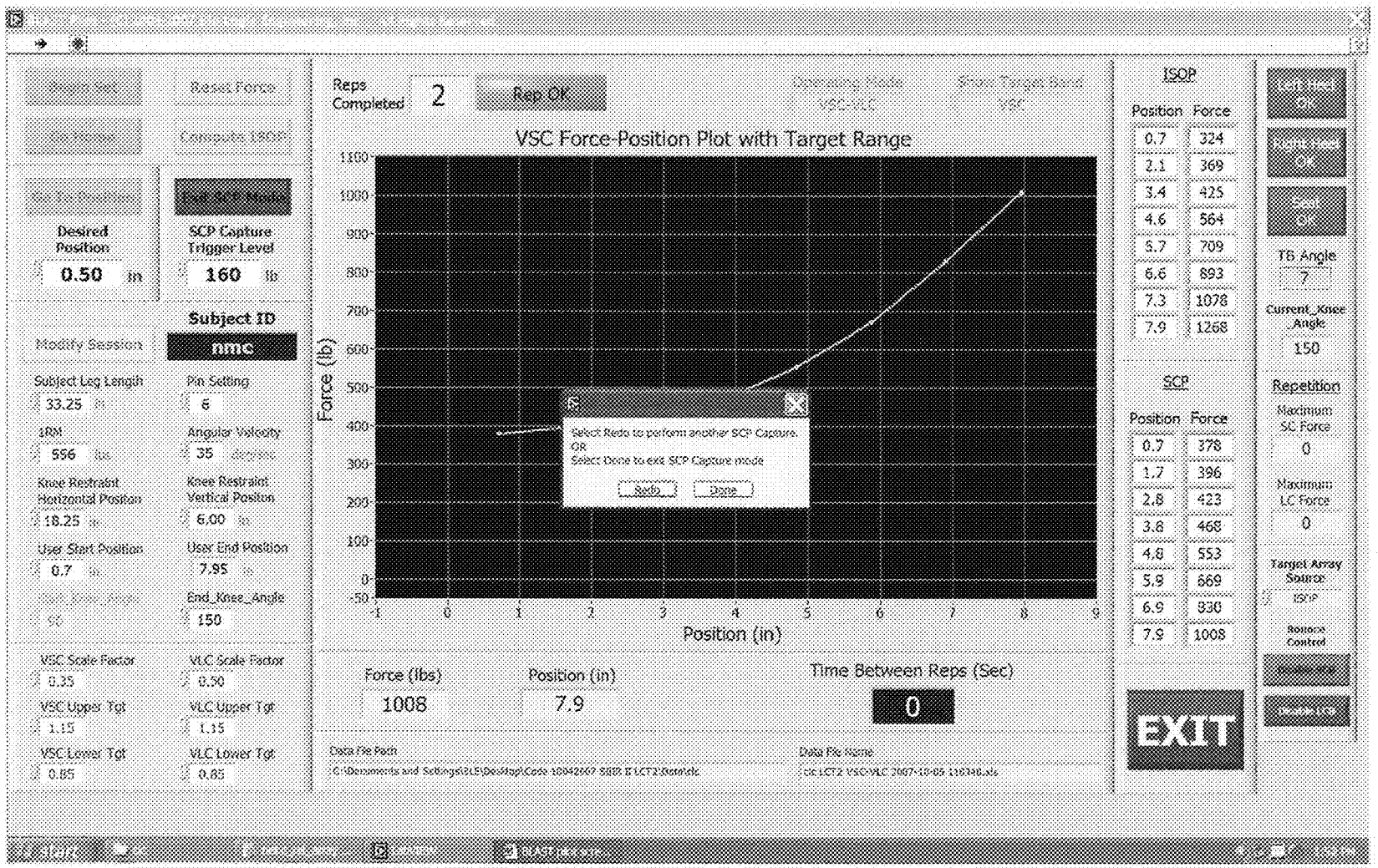
FIG. 46 is a screen shot illustrating a popup providing the option to perform another SCP capture ("Redo") or exit the SCP capture mode ("Done")

After each SCP capture, the user may be given the option to Save or Discard the data (FIG. 45). After selecting Save or Discard, another popup may be posted to providing the options of "Redo" or "Done" (FIG. 46). Selecting "Redo" causes the motor 14 to drive back to the User Start Position to wait for the user to perform another SCP capture. Selecting "Done" causes the program to exit the SCP Capture mode and the motor 14 to return the seat 20 to the Home position.

As shown in FIG. 44, there may be a tendency for the force to drop at the beginning of the movement when the isometric state is released and the system transitions to a VSC state. This is typical of the physiological behavior of muscle. The isometric force is expected to be higher than the VSC force for any given position along the ROM. Secondly, because of the "release" behavior, the force is expected to momentarily drop below the biomechanical VSC capacity before rising again. To compensate for this behavior, a curve-fitting algorithm may be used for the early portions of the curve to produce the "smooth" profile shown in FIGS. 45 and 46. A number of possible fitting algorithms may be implemented. In this particular case, the captured force-position data is first converted to a representative 8-point array pair distributed evenly across the ROM. The distribution may be in equal linear or angular position increments. Then, the force values of the first two points of the array are adjusted. To calculate the new values for the first two points, an imaginary straight line may be drawn through points 3 and the mid-point between points 1 and 2 and may be projected back to point 1. Point 2 maintains its original x-axis position value while its force (y-axis) may be replaced with the force value along the imaginary line that corresponds to its original x-axis position. Point 1 also maintains its original x-axis position value while its force may be replaced with the force value along the imaginary line that corresponds to the x-axis position that is one-third the x-axis distance from point 0 to point 1. This algorithm typically gives the force-position profile a smoother start.

Figure 47:
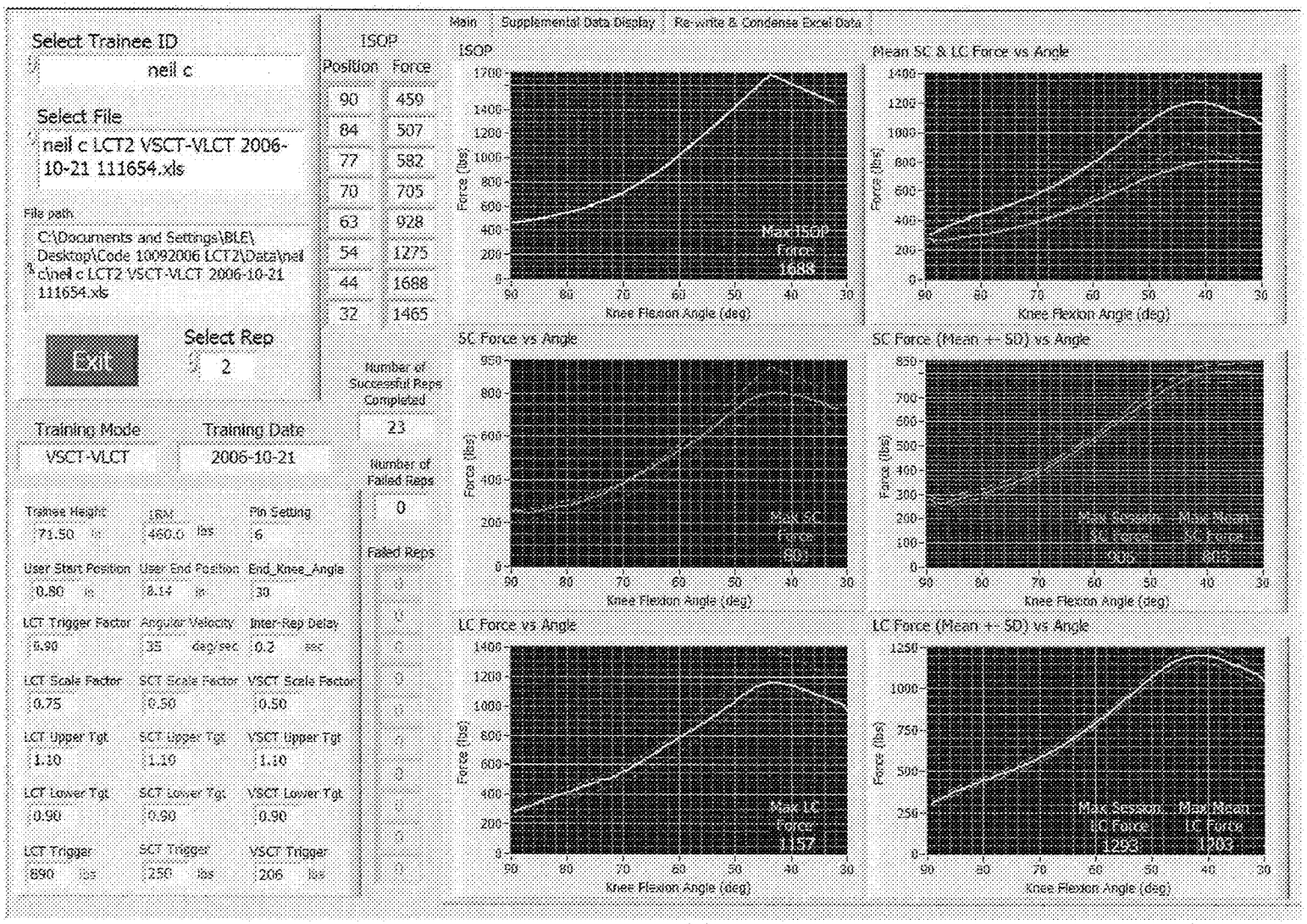
FIGS. 47 and 48 are screenshots of the front panel wherein numeric and graphical displays are shown for a training session.
Figure 48:
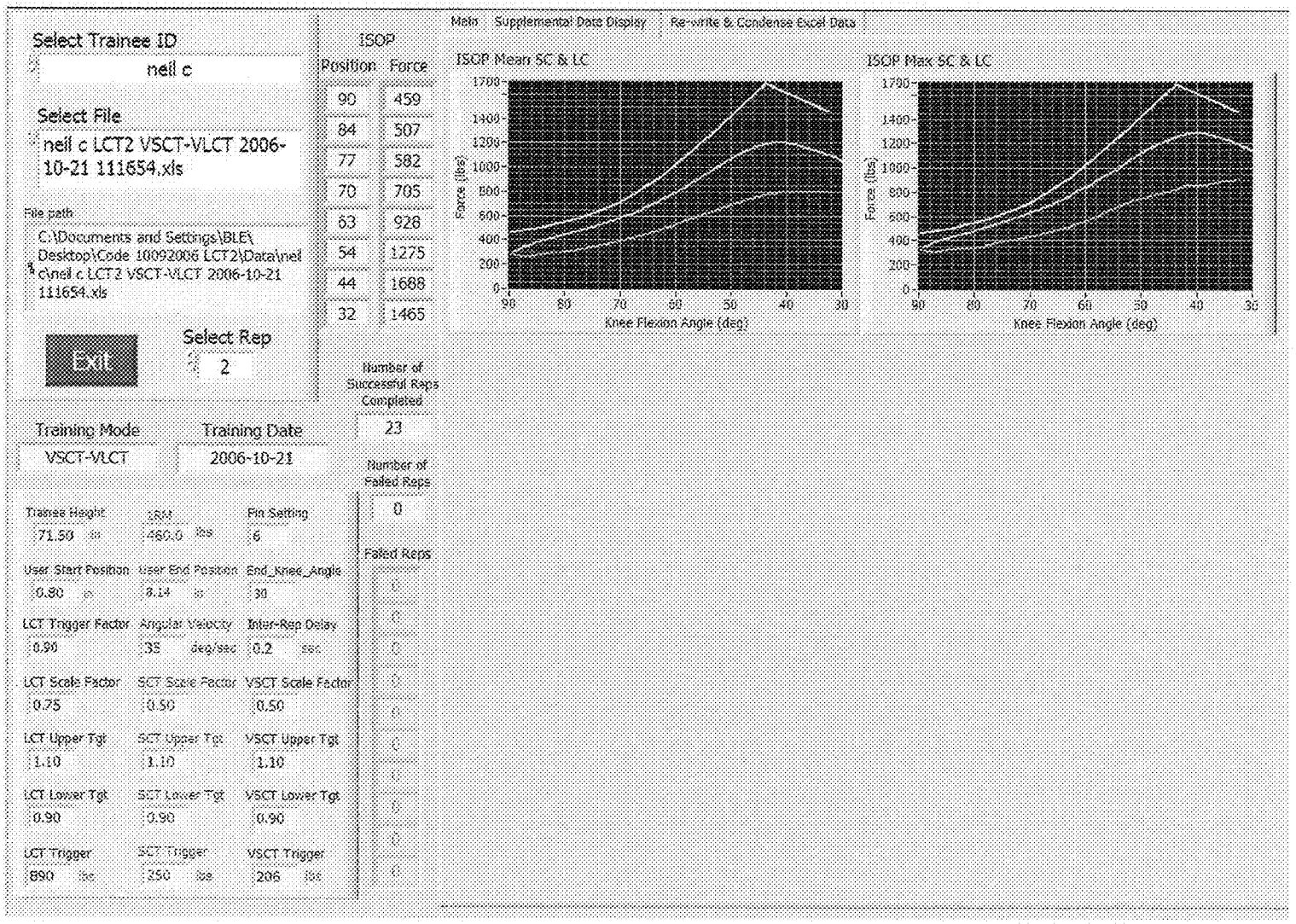

FIGS. 47 and 48 are screenshots of the control panel for a data recall function of the system 10 according to the present invention. Numeric and graphical displays are pictured for a training session with FIG. 47 showing "Main" tab data and FIG. 48 showing "Supplemental Data Display" tab data. FIGS. 47 and 42 illustrate only a subset of the possible data parameters and display methods for summarizing and recalling the results of any single stored training session. The data may be stored in customized user folders in date/time stamped data files. The data may then be retrieved, processed, and numerically and graphically displayed via software such as National Instruments' LabVIEW or other suitable software.

Graphically displayed in FIG. 47, starting from the top left graphical panel going counterclockwise are: 1) The ISOP; 2) The VSC and VLC force-angle curves, which are shown in solid line for the currently selected rep (the user can scroll through each of the repetitions by updating the Selected Rep button), with the dashed lines representing the top and bottom boundaries of the VSC and VLC target bands; 3) The VSC force-angle curves for the entire training session, with the solid line representing the mean and the dashed lines representing ±one standard deviation of the VSC force-angle data, providing an indicator of the variability in performance during the training session; 4) The VLC force-angle curves for the entire training session, with the solid line representing the mean and the dashed lines representing ±one standard deviation of the VLC force-angle data; 5) The mean force angle curve for the VLC phase along with its respective upper and lower training target boundaries; and 6) The mean force angle curve for the VSC phase along with its respective upper and lower training target boundaries.

FIG. 48 depicts a left graphical panel with ISOP, mean session VLC data, and mean session VSC data, and a right graphical panel with ISOP, maximum session VLC data, and maximum session VSC data. Software may also be designed to retrieve, process, and numerically and graphically display a user's data gathered over multiple training sessions, thus illustrating the training progress of an individual over the course of days, weeks, months, years, etc.

In summary, a typical training session may begin by calling up a pre-stored user configuration file on the control panel. This file may contain the ROM data and target force information for the specified user. The user may then select BEGIN SET on the control panel, causing the seat 20 to be driven to the user's 90 degree knee flexion position where it may remain stationary until the user applies a specified isometric force to the footplate 16. Once this force threshold is reached, the servomotor 14 may begin driving the seat 20 in the shortening direction (seat 20 moving away from the footplate 16) along a predetermined velocity trajectory. The user's leg extension muscles perform shortening contractions and exert force on the footplate 16 while attempting to follow a desired force-angle profile displayed on the display 18. This profile may be customized for each user and may be based on a percentage (<100%) of the individual's ISOP which takes into account the change in strength with knee flexion angle. The desired force may be bounded by an error band that creates a target zone that may be displayed concurrently with real-time force feedback on the display 18.

The seat 20 may automatically stop at the end of the programmed movement short of the user reaching full knee extension. The seat 20 may stay at this end position until the user triggers the VLC return stroke by applying a pre-specified isometric load. During the VLC phase, the seat 20 may be driven at a pre-determined velocity under servomotor control in the lengthening direction. The user's leg muscles undergo lengthening contractions while exerting an opposing force on the footplate 16. Throughout the stroke, the user attempts to follow a desired force-angle profile displayed along with real-time force feedback on the display 18. This profile, which may also be derived from the user's ISOP, may greatly exceed the lengthening contraction loads experienced under traditional SC or LC training. The seat 20 stops moving at the end of a stroke once the user has been returned to the 90 degree knee flexion position. This process then either starts over with the next repetition or terminates by selecting END SET on the control panel.

In one of several feasibility studies of the system 10 and method according to the present invention, one male (age 42 years) and one female (age 45 years) successfully completed a 12-week progressive resistance training (PRT) protocol that included a 4-week training ramp-up followed by 8 weeks of PRT of the leg extensor muscles. The subjects trained three times per week, performing three sets of 8 repetitions for each session. The knee velocity used during this training was 25 deg/sec. Subjects followed training target bands that were scaled versions of their ISOP in both the VSC and VLC phases. All subjects were able to voluntarily track within the targeted training force-band trajectories and reported a favorable response to the feel, video feedback and intuitiveness of the system. Leg soreness was measured using a 10 cm visual analog scale (VAS) (0 cm=no leg soreness, 10 cm=maximum possible leg soreness). Subjects reported little or no soreness throughout the 12 weeks (mean VAS score of 0.19; and peak VAS score of 3 cm for one subject early in program).

The ramp-up may be designed to enable users to become accustomed to the training in a slow and safe manner, and the increase in neural adaptation and in skill acquisition during strength and power training slows by week 5, after which muscle hypertrophy becomes the dominant contributor. The 4-week ramp-up serves as a familiarization and pre-conditioning period to minimize the risk of muscle and or tendon discomfort and injury during the early stages of training. A standard procedure was followed to determine the one-repetition maximum (1-RM). The 1-RM testing determines the maximum weight the subject can lift in the standard SC-LC mode through a ROM spanning 90 through 30 degrees of knee flexion. The 1-VRM is the maximum force a participant can voluntarily produce during one repetition of the VSC phase of a servo-driven movement at an angular knee velocity of 30 deg/sec across the ROM (90 to 30 degrees of knee flexion).

Figure 49:
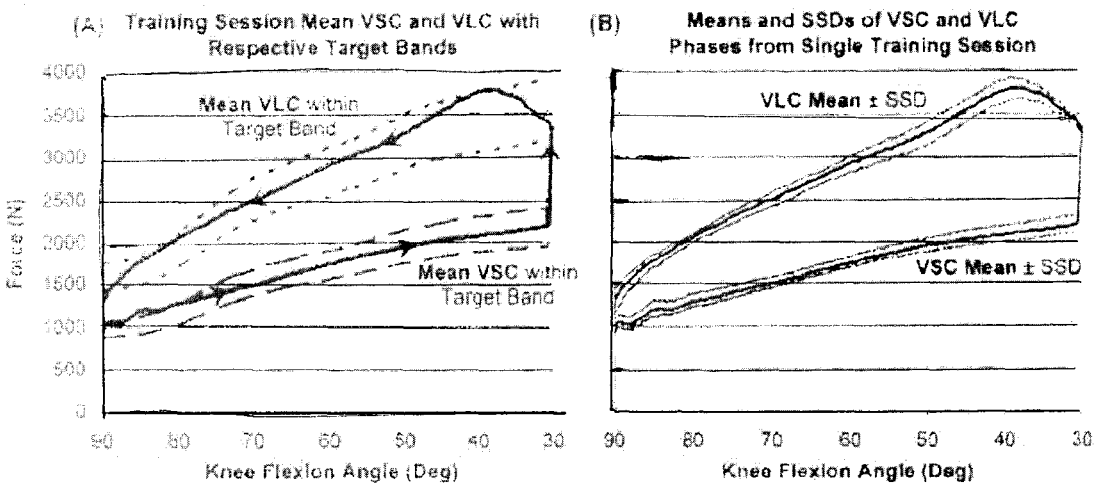
FIG. 49 shows plots of leg press force versus knee flexion angle as measured with the system according to the present invention.

With reference to FIG. 49, VSC-VLC data were obtained from a typical training session of 3 sets of 8 reps at 30 deg/sec with the final set taken to fatigue (3×8 RM), where the bold solid lines in (A) are the mean values of VSC and VLC force versus knee flexion angle data for all 24 reps, arrows indicate direction along the work loop, overlaid on the plot are the upper and lower limits of the VSC and VLC target bands centered at 55% and 90% of the ISOP, respectively, with a ±10% banding, and (B) shows the mean±one sample standard deviation (SSD) of the data, where the mean values are given in solid lines and the ±one SSD values are illustrated with finer dotted lines.

These studies demonstrate that users readily adapt and can successfully follow their custom VSC and VLC training target bands across the ROM. The small variability in force-angle trajectory between training repetitions, as illustrated by the SSD data in (B), shows the ability of subjects to accurately and repeatedly track the target bands throughout an exercise session, demonstrating a level of subject-learned force control and steadiness. Note that the isometric force levels that trigger the initiation of movement in both the VSC and VLC phases are programmable and easily adjusted by the user.

Figure 50:
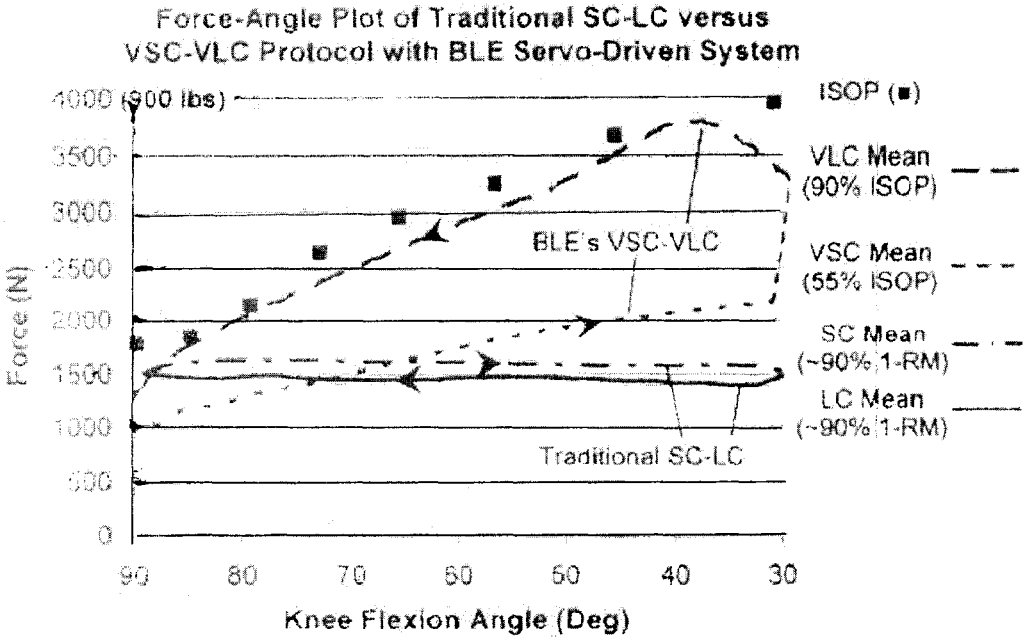
FIG. 50 shows force-angle plots comparing VSC-VLC and SC-LC training loads.

FIG. 50 shows force-angle plots comparing VSC-VLC and SC-LC training loads, both with 3×8 RM protocols, where the VSC-VLC mean force data are the same as shown, and the SC-LC data are the means of the 24 repetitions from a 3×8 RM session using traditional training with the weight stack 12 (servomotor 14 disengaged), where the SC and LC forces vary slightly across the ROM and the mean LC phase force is nearly 10% (134 N) below the mean SC phase force due to dynamic friction and acceleration of the inertial mass, where arrows on plot trajectories show direction along force-angle work loops.

More particularly, FIG. 50 shows actual force-angle relationship data obtained during a motor-driven VSC-VLC training session superimposed on SC-LC training data with a "fatigue-comparable" stacked-weight load. In each of the VSC-VLC and the SC-LC sessions, the subjects performed three sets of 8RM (3×8RM) with two minutes rest between sets. The 3×8RM protocol brought the subjects to fatigue failure, the inability to produce the targeted force levels or lift the weight through the ROM, at the completion of the $24^{th}$ repetition in each session. (The 3×8RM protocol is defined here as the maximum load a trainee can lift through 3 sets of 8 repetitions with two minutes rest between sets). Maximum forces of the training data shown in FIG. 50 are 3959 N for the ISOP; 3803 N versus 1,494 N for the VLC and LC loads, respectively; and 2,188 N versus 1,608 N for the VSC and SC loads, respectively. The data demonstrate both the variable-resistance across the ROM and the enhanced muscle loading capability of the system in both VSC and VLC phases, particularly as the leg is extended.

FIG. 50 also shows a lower training load for VSC than for SC in the 90-65° range of knee flexion. The variable-resistance nature of the system 10 according to the present invention enables the reduction of patellofemoral joint compression during training by prescribing lower resistance targets in the 90-65° knee flexion range while still challenging the leg muscles at more extended angles. The creation or exacerbation of patellofemoral problems may be avoided by lowering or eliminating training loads at extreme knee flexion angles. This can be prescribed in both VSC and VLC phases and may be of particular importance for trainees with a history of patellofemoral pathology.

Figure 51:
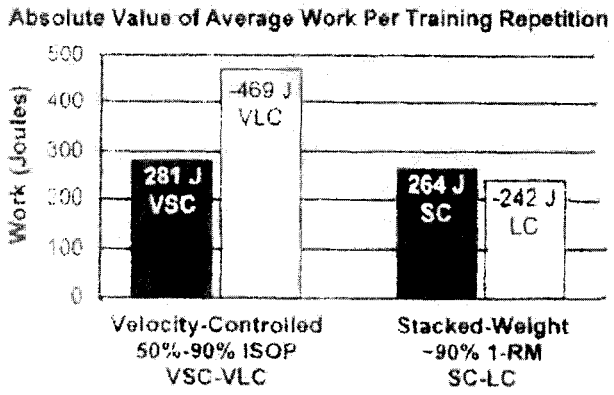
FIG. 51 depicts bar graphs which show the absolute value of average work performed per repetition for VSC-VLC and stacked-weight SC-LC training data.

FIG. 51 depicts bar graphs which show the absolute value of average work performed per repetition for VSC-VLC (3×8 RM load, 50%-90% of ISOP for VSC-VLC phases, respectively) and stacked-weight SC-LC (3×8 RM load, ~90% 1-RM) training data; where numbers superimposed over the bars provide their respective average values, the VSC-VLC and SC-LC data were obtained from separate 3×8 RM training sessions and are derived from the same training sessions as the data presented in FIG. 50, where the data is obtained from a 77 kg male participant 42 years of age.

FIG. 51 gives a comparison between the magnitude of work done by and on the leg muscles during servo-driven VSC-VLC and stacked-weight SC-LC training The magnitude of work completed during both phases of VSC-VLC training repetitions significantly exceeds that done during both phases of SC-LC training repetitions. Interestingly, the work performed on the muscles during the LC phase of the stacked-weight training is less than that done by the muscles during the SC phase due to the dynamic friction and acceleration of the inertial mass.

Figure 52:
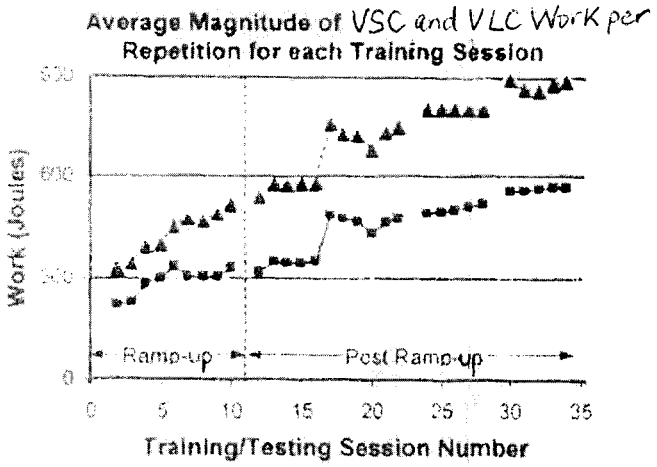
FIG. 52 depicts the absolute value of work per training repetition performed by and on the leg extensor muscles during VSC (squares) and VLC (triangles) phases, respectively.

FIG. 52 depicts the absolute value of work per training repetition performed by and on the leg extensor muscles during VSC (squares) and VLC (triangles) phases, respectively; wherein work is presented as the average work per repetition for each three-set training session across the 12-week protocol, the vertical dashed line marks the end of the ramp-up protocol, gaps in data represent testing days on which no training was performed, and the data is obtained from a 77 kg male participant 42 years of age.

The data in FIG. 52 demonstrate the progressive increase in the magnitude of work done for the VSC and VLC phases per repetition for each training session across the 12-week PRT protocol. By week 12, the work done by the legs during the VSC phase and the work done on the legs during the VLC phase increased by factors of 2.4 and 2.7 times that of the day 1 baseline, respectively. A compelling observation is that the level of muscle soreness reported two days after the first session was a 3 cm on a 10 cm VAS scale while a level of 0 cm was reported following the final training session even though the work done during the lengthening phase of each repetition of the last session was 2.7 times higher. These data suggest that the training may have offered a level of protection from LC-induced injury.

Figure 53:
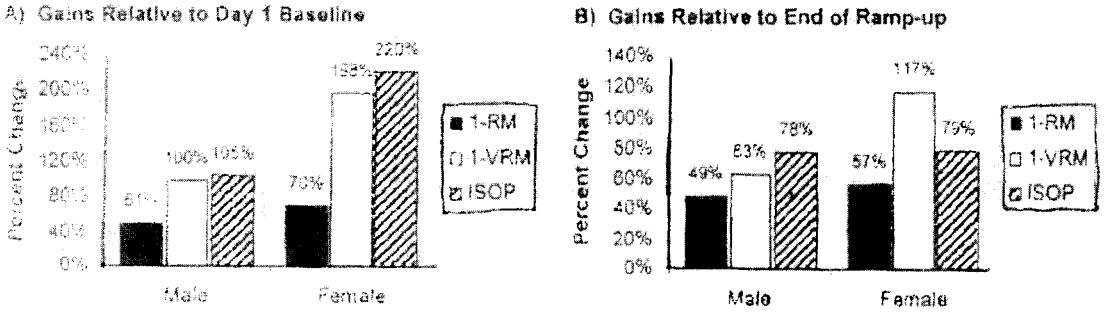
FIG. 53 shows the percent change in 1-RM, 1-VRM, and ISOP as a result of VSC-VLC training protocols performed on the system by one male and one female participant, 42 and 45 years of age, respectively.

FIG. 53 shows the percent change in 1-RM, 1-VRM, and ISOP as a result of VSC-VLC training protocols performed on the system by one male and one female subject, 42 and 45 years of age, respectively; where A shows the gains observed at the end of the 12-week protocol relative to day 1, and B presents the gains observed at the end of a 12-week protocol relative to the end of the 4 week ramp-up period, where both subjects have years of regular training experience with traditional stacked-weight leg press machines.

More particularly, FIG. 53 shows the gains realized after the 12 week-PRT program in 1-RM, 1-VRM, and ISOP relative to pre-ramp-up baseline (A) and to the end of the 4-week ramp-up period (B). (A 1-VRM is defined here as the maximum force a subject can voluntarily produce during one repetition of the VSC-phase of a servo-driven velocity-controlled movement at an angular knee velocity of 30 deg/sec). FIG. 53(B) demonstrates strength gains achieved with the system according to the present invention that occur after and independent of early gains that typically result from motor learning.

The velocity-controlled nature of the VSC and VLC movements enables users to train safely with (1) elevated loads during the VLC phase and (2) variable-resistance across the ROM which is customized to the force-length relationship of the user's leg muscles to achieve more optimal loading throughout the training stroke. According to the present invention, motor-driven velocity control eliminates many of the limitations and drawbacks associated with fixed weight machines. The user is no longer restricted to "lifting" no more than the weight he is capable of lifting at his weakest point along the force-position curve, and can therefore achieve higher force loading of the muscle throughout the ROM. Given the higher force generation capacity of muscle in the VLC phase, the user can now more effectively train in this phase with higher force loading and achieve the associated training benefit. Users can effectively perform "negatives" or lengthening contraction phase training more effectively and by themselves without a training partner. A user who fatigues, experiences pain, or becomes injured during training can simply stop applying the resistive force without concern of injury from a falling weight since motion is completely under motor control. The fact that VLC-only or VLC-emphasized training requires lower energy expenditure than traditional weight training makes the system and method according to the present invention particularly attractive to the elderly, frail, or those with cardiovascular impairments It is understood that the system and method according to the present invention are not limited to the leg press applications described herein, but may also apply to other upper and lower body weight machines. Exercise applications for the system and method according to the present invention may include, but are not limited to, leg press, bench press, shoulder press, fly, rotator cuff movements (i.e., abduction, adduction, flexion, extension, internal rotation, external rotation), or any other weight machine exercise that utilizes a cable and pulley or belt and pulley system. In addition, the present invention may be embodied as an aftermarket motor add-on kit for weight stack machines.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A training system comprising:

a frame;

a user support portion coupled to the frame and arranged to support a user;

a user engagement portion coupled to the frame and arranged to be engaged by at least one body part of the user;

a force sensor in communication with the user engagement portion for sensing a user-applied force;

at least one position sensor operably connected to at least one of the user support portion and the user engagement portion for sensing a relative position therebetween;

a motor coupled to at least one of the user support portion and the user engagement portion for driving a position thereof with respect to the frame over a range of motion at a preprogrammed velocity;

a controller in communication with the motor, the force sensor, and the at least one position sensor; and a knee position mechanism movably coupled to the frame and extending generally vertically upward therefrom between the user support portion and the user engagement portion, the knee position mechanism including a sensor in communication with the controller for tracking a horizontal position of a knee of the user over the range of motion.

2. The system according to claim 1, wherein the controller moves the knee position mechanism at a different velocity than at least one of the user support portion and the user engagement portion.

3. The system according to claim 1, wherein the controller automatically adjusts an elevation of the knee position mechanism with respect to the user support portion to accommodate for users of different heights.

4. The system according to claim 1, wherein the knee position mechanism includes a power switch in communication with the controller for severing power to the motor if the knee position mechanism is not properly deployed.

5. The system according to claim 1, wherein the knee position mechanism includes a contact switch in communication with the controller for sensing contact with the knee and thereby determining a limit of the range of motion.

6. The system according to claim 1, wherein the at least one body part includes at least one foot, the user engagement portion includes a footplate, and the user support portion includes a seat.

7. The system according to claim 1, wherein one of the user support portion and the user engagement portion is movable and a position of the other of the user support portion and the user engagement portion is fixed.

8. The system according to claim 1, further comprising a drive mechanism in communication with the motor and the controller, the drive mechanism operably connected to at least one of the user support portion and the user engagement portion, the drive mechanism including an electric brake for engaging and arresting movement of at least one of the user support portion and the user engagement portion.

9. The system according to claim 1, further comprising end limit switches in communication with the controller for indicating end limits for movement of at least one of the user support portion and the user engagement portion, wherein activation of at least one end limit switch ceases power to the motor.

10. The system according to claim 1, further comprising an emergency stop switch for ceasing power to the motor.

11. The system according to claim 1, wherein movement of the motor is initiated upon the force sensor detecting the user-applied force exceeding a preset activation threshold.

12. The system according to claim 1, further comprising at least one contact switch monitored by the controller for sensing that the body part is in proper contact with the user engagement portion.

13. The system according to claim 1, further comprising at least one contact switch monitored by the controller for sensing that the user is in proper contact with the user support portion.

* * * * *